US009805640B2

(12) United States Patent
Jin et al.

(10) Patent No.: US 9,805,640 B2
(45) Date of Patent: Oct. 31, 2017

(54) GATE DRIVE APPARATUS AND DISPLAY APPARATUS

(71) Applicants: SHANGHAI AVIC OPTO ELECTRONICS CO., LTD., Shanghai (CN); TIANMA MICRO-ELECTRONICS CO., LTD., Shenzhen (CN)

(72) Inventors: Huijun Jin, Shanghai (CN); Zhiqiang Xia, Shanghai (CN)

(73) Assignees: SHANGHAI AVIC OPTOELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 15/219,009

(22) Filed: Jul. 25, 2016

(65) Prior Publication Data

US 2016/0351110 A1 Dec. 1, 2016

Related U.S. Application Data

(62) Division of application No. 14/459,145, filed on Aug. 13, 2014, now Pat. No. 9,449,576.

(30) Foreign Application Priority Data

Dec. 30, 2013 (CN) ..... 2013 1 0749727

(51) Int. Cl.
*G09G 3/20* (2006.01)
*G09G 5/00* (2006.01)

(52) U.S. Cl.
CPC ..... *G09G 3/2092* (2013.01); *G09G 3/20* (2013.01); *G09G 5/003* (2013.01); *G09G 2300/08* (2013.01); *G09G 2310/0205* (2013.01); *G09G 2310/0251* (2013.01); *G09G 2310/0267* (2013.01); *G09G 2310/0283* (2013.01); *G09G 2310/0286* (2013.01); *G09G 2310/08* (2013.01)

(58) Field of Classification Search
None
See application file for complete search history.

(56) References Cited

U.S. PATENT DOCUMENTS

2011/0090183 A1 4/2011 Yamazaki et al.
2011/0310074 A1* 12/2011 Ochiai ..... G09G 3/3674 345/208
2013/0077736 A1* 3/2013 Son ..... G09G 3/20 377/69

* cited by examiner

*Primary Examiner* — Joseph Haley
*Assistant Examiner* — Emily Frank
(74) *Attorney, Agent, or Firm* — Alston & Bird LLP

(57) ABSTRACT

Embodiments of the invention provide a gate drive apparatus and a display apparatus. With the gate drive apparatus, a clock signal is used in place of a forward scan signal and/or a clock signal is used in place of a backward scan signal and/or a reset signal and a first initial trigger signal (or a second initial trigger signal) are used in place of a low level signal and/or the same signal is used as a first initial trigger signal and a second initial trigger signal to thereby reduce the number of transmission lines for signals driving the gate drive apparatus.

18 Claims, 37 Drawing Sheets

--Prior Art--

GATE DRIVE APPARATUS AND DISPLAY APPARATUS

CROSS-REFERENCES TO RELATED APPLICATIONS

This application is a divisional application of the U.S. application Ser. No. 14/459,145, filed on Aug. 13, 2014, and claiming the benefit of Chinese Patent Application No. 201310749727.5, filed with the State Intellectual Property Office of People's Republic of China on Dec. 30, 2013 and entitled "Gate drive apparatus and display apparatus", which is hereby incorporated by reference in its entirety.

TECHNICAL FIELD

The present invention relates to the field of display technologies and particularly to a gate drive apparatus and a display apparatus.

BACKGROUND OF THE INVENTION

A liquid Crystal Display (LCD) or an Organic Light-Emitting Diode (OLED) has the advantages of low radiation, a small volume, low energy consumption, etc., and has gradually superseded a traditional Cathode Ray Tube (CRT) display in some applications. LCD or OLED devices have been widely applied to notebook computers, Personal Digital Assistances (PDAs), flat televisions, mobile phones, and other information products. A practice of a traditional liquid crystal display is to drive a chip on a panel by an external drive chip to display an image, but in order to reduce the number of elements and lower the cost of manufacturing, the structure of the driver has gradually evolved in recent years to be fabricated directly on the display panel, for example, using the technology of Gate On Array in which a gate driver is integrated on a liquid crystal panel.

Ten (10) signal lines are required to drive a currently common gate drive apparatus into which a plurality of shift register units are connected. FIG. 1 illustrates a gate drive apparatus including an even number N of shift register units, where N is indivisible by 4. In the gate drive apparatus, a forward select signal terminal GN−1 of each of the shift register units other than the first two shift register units receives the signal output by the second shift register unit preceding to the shift register unit; and a backward select signal terminal GN+1 of each of the shift register units other than the last two shift register units receives the signal output by the second shift register unit succeeding to the shift register unit. A forward select signal terminal GN−1 of the first shift register unit in the gate drive apparatus receives a first initial trigger signal STV1, and a forward select signal terminal GN−1 of the second shift register unit in the gate drive apparatus receives a second initial trigger signal STV2; and if there are an even number of shift register units included in the gate drive apparatus, then a backward select signal terminal GN+1 of the last shift register unit in the gate drive apparatus receives the second initial trigger signal STV2, and a backward select signal terminal GN+1 of the second last shift register unit in the gate drive apparatus receives the first initial trigger signal STV1; or if there are an odd number of shift register units included in the gate drive apparatus, then the backward select signal terminal GN+1 of the last shift register unit in the gate drive apparatus receives the first initial trigger signal STV1, and the backward select signal terminal GN+1 of the second last shift register unit in the gate drive apparatus receives the second initial trigger signal STV2. A forward scan signal FW terminal of each of the shift register units in the gate drive apparatus receives a forward scan signal FW, and a backward scan signal BW terminal of each of the shift register units receives a backward scan signal BW; and when the forward scan signal FW is at a high level, the backward scan signal BW is at a low level, and the gate drive apparatus scans forward a scan line, and when the forward scan signal FW is at the low level, the backward scan signal BW is at the high level, and the gate drive apparatus scans backward the scan line. A reset signal RST terminal of each of the shift register units in the gate drive apparatus receives a reset signal RST, and a low level signal VGL terminal of each of the shift register units receives a low level signal.

In the gate drive apparatus illustrated in FIG. 1, a clock block signal CLKB of each of the shift register units receives a mod((N−1)/4)-th clock signal, and a clock signal CLK of each of the shift register units receives a mod((mod((N−1)/4)+2)/4)-th clock signal, for example, for the first shift register unit, N=1, and then the clock block signal CLKB of the shift register unit receives a zero-th clock signal CLK0, and the clock signal CLK of the shift register unit receives a second clock signal CLK2; for the second shift register unit, N=2, and then the clock block signal CLKB of the shift register unit receives a first clock signal CLK1, and the clock signal CLK of the shift register unit receives a third clock signal CLK3; for the third shift register unit, N=3, and then the clock block signal CLKB of the shift register unit receives the second clock signal CLK2, and the clock signal CLK of the shift register unit receives the zero-th clock signal CLK0; and for the fourth shift register unit, N=4, and then the clock block signal CLKB of the shift register unit receives the third clock signal CLK3, and the clock signal CLK of the shift register unit receives the first clock signal CLK1, where when the zero-th clock signal is at the high level, the second clock signal is at the low level, and when the second clock signal is at the high level, the zero-th clock signal is at the low level; and when the first clock signal is at the high level, the third clock signal is at the low level, and when the third clock signal is at the high level, the first clock signal is at the low level; and the reset signal RST can control the respective shift register units in the gate drive apparatus to be reset to output low level signals.

In summary, since the 10 signal lines including the forward scan signal FW, the backward scan signal BW, the first initial trigger signal STV1, the second initial trigger signal STV2, the zero-th clock signal CLK0, the first clock signal CLK1, the second clock signal CLK2, the third clock signal CLK3, the low level signal VGL and the reset signal RST are required to drive the currently common gate drive apparatus, they occupy a width of approximately 0.3 mm in a display panel, and this may result in wider edge frames of the display panel using the gate drive apparatus and consequently in a larger amount of consumed raw materials in manufacturing a display apparatus including the gate drive apparatus, thus making the display apparatus relatively costly.

BRIEF SUMMARY OF THE INVENTION

Embodiments of the invention provide a gate drive apparatus and a display apparatus so as to address such a problem that 10 signal lines required to drive an existing gate drive apparatus may result in wider edge frames of a display panel using the gate drive apparatus and consequently in a larger amount of consumed raw materials in manufacturing a display apparatus including the gate drive apparatus, thus making the display apparatus relatively costly.

In view of the problem above, an embodiment of the invention provides a gate drive apparatus including N shift register units;

a forward select signal terminal of the p-th shift register unit receives a signal output by the (p−2)-th shift register unit, wherein p=3, 4, . . . , N, and a backward select signal terminal of the r-th shift register unit receives a signal output by the (r+2)-th shift register unit, wherein r=1, 2, . . . , N−2; a forward select signal terminal of the first shift register unit receives a first initial trigger signal, and a forward select signal terminal of the second shift register unit receives a second initial trigger signal; and if N represents an even number, then a backward select signal terminal of the second last shift register unit receives the first initial trigger signal, and a backward select signal terminal of the last shift register unit receives the second initial trigger signal; and if N represents an odd number, then the backward select signal terminal of the last shift register unit receives the first initial trigger signal, and the backward select signal terminal of the second last shift register unit receives the second initial trigger signal; a low level signal terminal of each of the shift register units receives a low level signal; and a reset signal terminal of each of the shift register units receives a reset signal which is at a high level after the end of scanning a preceding frame and before the start of scanning a current frame and at a low level in scanning the current frame;

a clock block signal terminal of the k-th shift register unit receives a mod((k−1)/4)-th clock signal, wherein k=1, 2, . . . , N; a signal received by a forward scan signal terminal of each of the shift register units other than the first two shift register units is the same as the signal received by the clock block signal terminal of the preceding shift register unit to the shift register unit, a forward scan signal terminal of the first shift register unit receives a second clock signal, and a forward scan signal terminal of the second shift register unit receives a third clock signal; when the 0th clock signal is at the high level, the second clock signal is at the low level, and when the second clock signal is at the high level, the 0th clock signal is at the low level; when the first clock signal is at the high level, the third clock signal is at the low level, and when the third clock signal is at the high level, the first clock signal is at the low level; and a period of time in which the n-th clock signal is at the high level overlaps with a period of time in which the (n+1)-th clock signal is at the high level by a length of time no less than a first preset length of time, wherein n=0, 1, 2, 3, and when n+1>3, the (n+1)-th clock signal is a mod((n+1)/4)-th clock signal; and in forward scanning, a period of time in which the first initial trigger signal is at the high level overlaps with the period of time in which the second clock signal is at the high level at a time by a length of time no less than a period of time it takes to charge a gate of a transistor of a drive gate line in the first shift register unit to the voltage at which the transistor can be turned on stably and no more than one cycle of the second clock signal, and a period of time in which the second initial trigger signal is at the high level overlaps with the period of time in which the third clock signal is at the high level at a time by a length of time no less than a period of time it takes to charge a gate of a transistor of a drive gate line in the second shift register unit to the voltage at which the transistor can be turned on stably and no more than one cycle of the third clock signal.

An embodiment of the invention provides a gate drive apparatus including N shift register units;

a forward select signal terminal of the p-th shift register unit receives a signal output by the (p−2)-th shift register unit, wherein p=3, 4, . . . , N, and a backward select signal terminal of the r-th shift register unit receives a signal output by the (r+2)-th shift register unit, wherein r=1, 2, . . . , N−2; a forward select signal terminal of the first shift register unit receives a first initial trigger signal, and a forward select signal terminal of the second shift register unit receives a second initial trigger signal; and if N represents an even number, then the backward select signal terminal of the (N−1)-th shift register unit receives the first initial trigger signal, and the backward select signal terminal of the N-th shift register unit receives the second initial trigger signal; and if N represents an odd number, then the backward select signal terminal of the N-th shift register unit receives the first initial trigger signal, and the backward select signal terminal of the (N−1)-th shift register unit receives the second initial trigger signal; a low level signal terminal of each of the shift register units receives a low level signal terminal; and a reset signal terminal of each of the shift register units receives a reset signal which is at a high level after the end of scanning a preceding frame and before the start of scanning a current frame and at a low level in scanning the current frame;

a clock block signal terminal of the k-th shift register unit receives a mod((k−1)/4)-th clock signal, wherein k=1, 2, . . . , N; signal received by backward scan signal terminal of each of the shift register units other than the last two shift register units is the same as the signal received by the clock block signal terminal of the succeeding shift register unit to the shift register unit, a backward scan signal terminal of the second last shift register unit receives a mod((mod((N−2)/4)+2)/4)-th clock signal, and a backward scan signal terminal of the last shift register unit receives a mod((mod((N−1)/4)+2)/4)-th clock signal; when the 0th clock signal is at the high level, the second clock signal is at the low level, and when the second clock signal is at the high level, the 0th clock signal is at the low level; when the first clock signal is at the high level, the third clock signal is at the low level, and when the third clock signal is at the high level, the first clock signal is at the low level; and a period of time in which the n-th clock signal is at the high level overlaps with a period of time in which the (n+1)-th clock signal is at the high level by a length of time no less than a second preset length of time, wherein n=0, 1, 2, 3, and when n+1>3, the (n+1)-th clock signal is a mod((n+1)/4)-th clock signal; and in backward scanning, if N represents an odd number, then a period of time in which the first initial trigger signal is at the high level overlaps with the period of time in which the mod((mod((N−1)/4)+2)/4)-th clock signal is at the high level at a time by a length of time no less than a period of time it takes to charge a gate of a transistor of a drive gate line in the N-th shift register unit to the voltage at which the transistor can be turned on stably and no more than one cycle of the mod((mod((N−1)/4)+2)/4)-th clock signal, and a period of time in which the second initial trigger signal is at the high level overlaps with the period of time in which the mod((mod((N−2)/4)+2)/4)-th clock signal is at the high level at a time by a length of time no less than a period of time it takes to charge a gate of a transistor of a drive gate line in the (N−1)-th shift register unit to the voltage at which the transistor can be turned on stably and no more than one cycle of the mod((mod((N−2)/4)+2)/4)-th clock signal; and if N represents an even number, then the period of time in which the first initial trigger signal is at the high level overlaps with the period of time in which the mod((mod((N−2)/4)+2)/4)-th clock signal is at the high level at a time by a length of time no less than a period of time it takes to charge the gate of the transistor of the drive gate line in the (N−1)-th shift register unit to the voltage at which the transistor can be turned on stably and no more than one cycle of the mod((mod((N−2)/4)+2)/4)-th clock signal, and the period of time in which the second initial trigger signal is at the high level overlaps with the period of time in which the mod((mod((N−1)/4)+2)/4)-th clock signal is at the high level at a time by a length of time no less than a period of time it takes to charge the gate of the transistor of the drive gate line in the N-th shift register unit to the voltage at which the transistor can be turned on stably and no more than one cycle of the mod((mod((N−1)/4)+2)/4)-th clock signal.

An embodiment of the invention provides a gate drive apparatus including N shift register units;

a forward select signal terminal of the p-th shift register unit receives a signal output by the (p−2)-th shift register unit, wherein p=3, 4, . . . , N, and a backward select signal terminal of the r-th shift register unit receives a signal output by the (r+2)-th shift register unit, wherein r=1, 2, . . . , N−2; a forward select signal terminal of the first shift register unit receives a first initial trigger signal, and a forward select signal terminal of the second shift register unit receives a second initial trigger signal; and if N represents an even number, then a backward select signal terminal of the (N−1)-th shift register unit receives the first initial trigger signal, and a backward select signal terminal of the N-th shift register unit receives the second initial trigger signal; and if N represents an odd number, then the backward select signal terminal of the N-th shift register unit receives the first initial trigger signal, and the backward select signal terminal of the (N−1)-th shift register unit receives the second initial trigger signal; and a clock block signal terminal of the k-th shift register unit signal receives a mod((k−1)/4)-th clock signal, wherein k=1, 2, . . . , N;

a reset signal terminal of each of the shift register units receives a reset signal which is at a high level after the end of scanning a preceding frame and before the start of scanning a current frame and at a low level in scanning the current frame; and an initial trigger signal terminal of each of the shift register units in the gate drive apparatus receives the first initial trigger signal or the second initial trigger signal; and when the reset signal is at the high level, both the first initial trigger signal and the second initial trigger signal are at the low level, when the first initial trigger signal is at the high level, the reset signal is at the low level, and when the second initial trigger signal is at the high level, the reset signal is at the low level; and the respective shift register units each are configured to charge a gate of a transistor of a drive gate line therein by a high level signal received by a forward/backward scan signal terminal until the transistor is turned on stably when the forward/backward select signal terminal receives a high level signal and the forward/backward scan signal terminal receives the high level signal; to output the signal received by the clock block signal terminal after transistor is turned on stably; to discharge the gate of the transistor of the drive gate line therein by a low level signal received by the backward/forward scan signal terminal until the transistor is turned off stably when the backward/forward select signal terminal receives a high level signal and the backward/forward scan signal terminal receives the low level signal; and to pull down the potential at the gate of the transistor of the drive gate line therein by the signal received by the initial trigger signal terminal and output the signal received by the initial trigger signal terminal when the reset signal terminal is at the high level.

An embodiment of the invention provides a display apparatus including a gate drive apparatus according to any one of the embodiments of the invention.

Advantageous effects of the embodiments of the invention include:

With the gate drive apparatus and the display apparatus according to the embodiments of the invention, since each of the shift registers can use a clock signal as a forward scan signal, a forward scan signal link can be omitted among signal links driving the gate drive apparatus, or since each of the shift registers can use a clock signal as a backward scan signal, a backward scan signal link can be omitted among the signal links driving the gate drive apparatus, or since each of the shift registers can use a reset signal and an initial trigger signal as a low level signal, a low level signal link can be omitted among the signal links driving the gate drive apparatus, thereby reducing the number of signal lines driving the gate drive apparatus, decreasing the amount of consumed raw materials in manufacturing a display panel including the gate drive apparatus according to the embodiment of the invention and lowering a cost of the display apparatus including the gate drive apparatus according to the embodiment of the invention.

DETAILED DESCRIPTION OF THE PREFERRED EMBODIMENTS

Figure 2A:
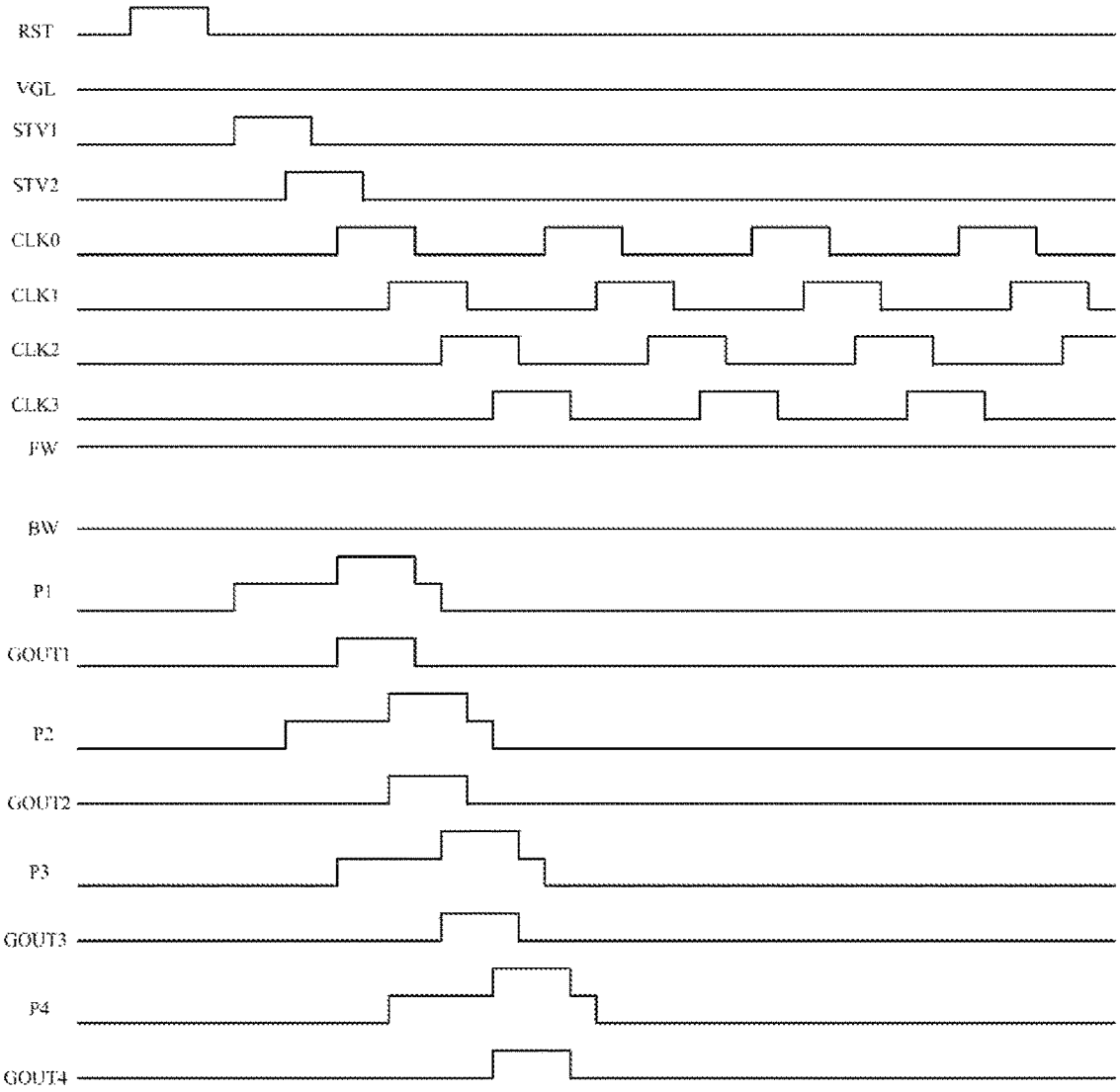
FIG. 2*a* is a timing diagram of the gate drive apparatus illustrated in FIG. 1 in forward scanning.
Figure 2B:
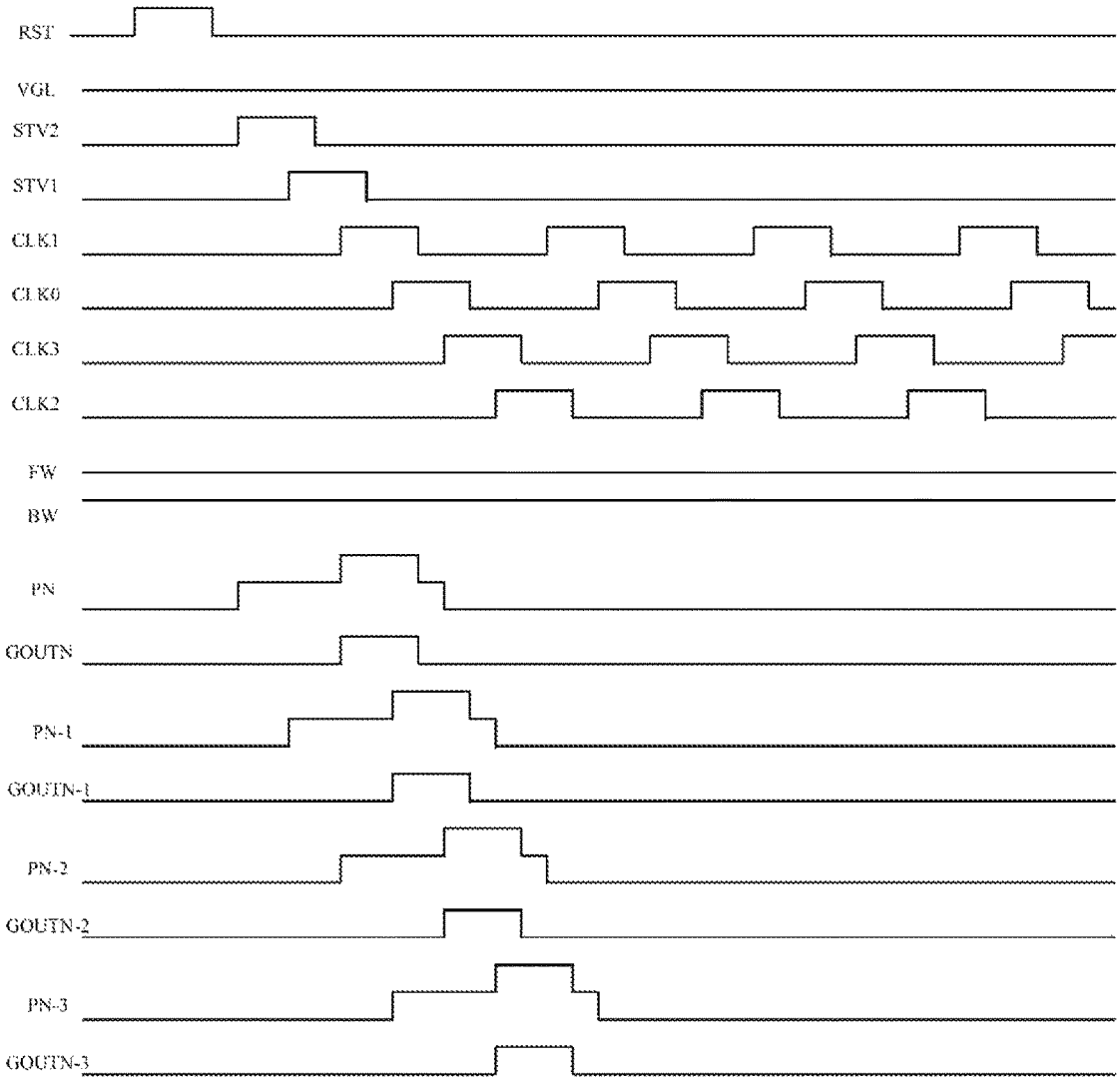
FIG. 2*b* is a timing diagram of the gate drive apparatus illustrated in FIG. 1 in backward scanning.

When a gate drive apparatus is driven by 10 signal lines, a timing diagram thereof in forward scanning is as illustrated in FIG. 2*a*, and a timing diagram thereof in backward scanning is as illustrated in FIG. 2*b*, where signals transmitted over the 10 signal line are a forward scan signal FW, a backward scan signal BW, a first initial trigger signal STV1, a second initial trigger signal STV2, a zero-th clock signal CLK0, a first clock signal CLK1, a second clock signal CLK2, a third clock signal CLK3, a low level signal VGL and a reset signal RST, and a period of time in which the zero-th clock signal is at a high level may or may not overlap with a period of time in which the first clock signal is at the high level; and a period of time in which the second clock signal is at a high level may or may not overlap with a period of time in which the third clock signal is at the high level.

Figure 1:
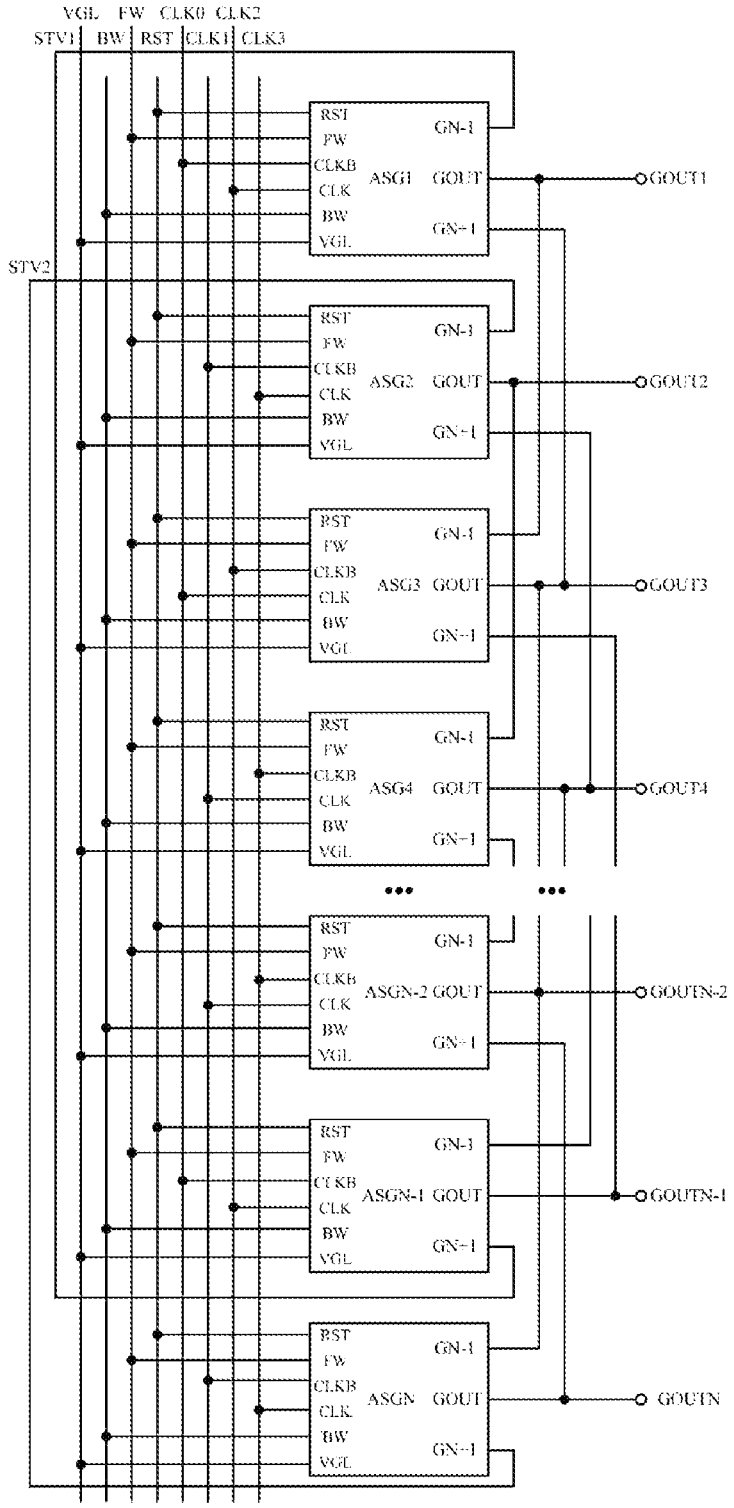
FIG. 1 is a schematic structural diagram of a gate drive apparatus in the prior art.

In FIG. 2*a*, P1 represents a signal at a gate of a transistor of a drive gate line in a first shift register unit in the gate drive apparatus illustrated in FIG. 1, and GOUT1 represents the signal output by the first shift register unit; P2 represents a signal at a gate of a transistor of a drive gate line in a second shift register unit in the gate drive apparatus illustrated in FIG. 1, and GOUT2 represents the signal output by the second shift register unit; P3 represents a signal at a gate of a transistor of a drive gate line in a third shift register unit in the gate drive apparatus illustrated in FIG. 1, and GOUT3 represents the signal output by the third shift register unit; and P4 represents a signal at a gate of a transistor of a drive gate line in a fourth shift register unit in the gate drive apparatus illustrated in FIG. 1, and GOUT4 represents the signal output by the fourth shift register unit. As illustrated in FIG. 2*a*, each of the shift register units charges the gate of the transistor of the drive gate line in the shift register unit by a high level signal received by a forward scan signal terminal FW until the transistor is turned on stably, when a forward select signal terminal GN−1 receives a high level signal outputs the signal CLKB received by a clock block signal CLKB terminal after the transistor is turned on stably; discharges the gate of the transistor of the drive gate line in the shift register unit by a low level signal received by a backward scan signal terminal BW until the transistor is turned off stably, when a backward select signal terminal GN+1 receives a high level signal; and pulls down the potential at the gate of the transistor of the drive gate line in the shift register unit by a signal received by a low level signal VGL terminal and outputs the signal VGL received by a low level signal VGL terminal, when a reset signal RST is at the high level. FIG. 2*a* illustrates an operating timing diagram of only the first four shift register units in the gate drive apparatus driven by the 10 signal lines.

In FIG. 2*b*, PN represents a signal at a gate of a transistor of a drive gate line in a last shift register unit in the gate drive apparatus illustrated in FIG. 1, and GOUTN represents the signal output by the last shift register unit; PN−1 represents a signal at a gate of a transistor of a drive gate line in a second last shift register unit in the gate drive apparatus illustrated in FIG. 1, and GOUTN−1 represents the signal output by the second last shift register unit; PN−2 represents a signal at a gate of a transistor of a drive gate line in a last third last shift register unit in the gate drive apparatus illustrated in FIG. 1, and GOUTN−2 represents the signal output by the third last shift register unit; and PN−3 represents a signal at a gate of a transistor of a drive gate line in a last fourth shift register unit in the gate drive apparatus illustrated in FIG. 1, and GOUTN−3 represents the signal output by the last fourth shift register unit. As illustrated in FIG. 2*b*, each of the shift register units charges the gate of the transistor of the drive gate line in the shift register unit by a high level signal received by a backward scan signal terminal BW until the transistor is turned on stably, when a backward select signal terminal GN+1 receives a high level signal outputs the signal CLKB received by a clock block signal CLKB terminal after the transistor is turned on stably; discharges the gate of the transistor of the drive gate line in the shift register unit by a low level signal received by a forward scan signal terminal FW until the transistor is turned off stably, when a forward select signal terminal GN−1 receives a high level signal; and pulls down the potential at the gate of the transistor of the drive gate line in the shift register unit by a signal received by a low level signal VGL terminal and outputs the signal VGL received by a low level signal VGL terminal, when a reset signal RST is at the high level. FIG. 2*b* illustrates an operating timing diagram of only the last four shift register units in the gate drive apparatus driven by the 10 signal lines.

With a gate drive apparatus and a display apparatus according to embodiments of the invention, since each of shift register units therein can use a clock signal as a forward scan signal, a forward scan signal line can be omitted among signal lines driving the gate drive apparatus, or since each of the shift register units therein can use a clock signal as a backward scan signal, a backward scan signal line can be omitted among the signal lines driving the gate drive apparatus, or since each of the shift register units therein can use a reset signal and an initial trigger signal as low level signals, a low level signal line can be omitted among the signal lines driving the gate drive apparatus, thereby reducing the number of signal lines driving the gate drive apparatus according to the embodiment of the invention, decreasing the amount of consumed raw materials in manufacturing a display panel including the gate drive apparatus according to the embodiment of the invention and lowering a cost of the display apparatus including the gate drive apparatus according to the embodiment of the invention.

Particular embodiments of a gate drive apparatus and a display apparatus according to embodiments of the invention will be described below with reference to the drawings. A connection structure and an operating timing of the gate drive apparatus according to the embodiments of the invention will be described below merely by way of an example in which shift register units in the gate drive apparatus according to the embodiments of the invention are amorphous silicon semiconductor shift register units, also known as Alpha Silica Gates (ASGs). Of course the shift register units in the gate drive apparatus according to the embodiments of the invention can alternatively be oxide semiconductor shift register units, low temperature poly-silicon shift register units, etc., with the same connection structures and operating timings as the connection structure and the operating timing respectively of the shift register units, which are alpha silica gates, in the gate drive apparatus according to the embodiments of the invention, so a repeated description thereof will be omitted herein.

Figure 3:
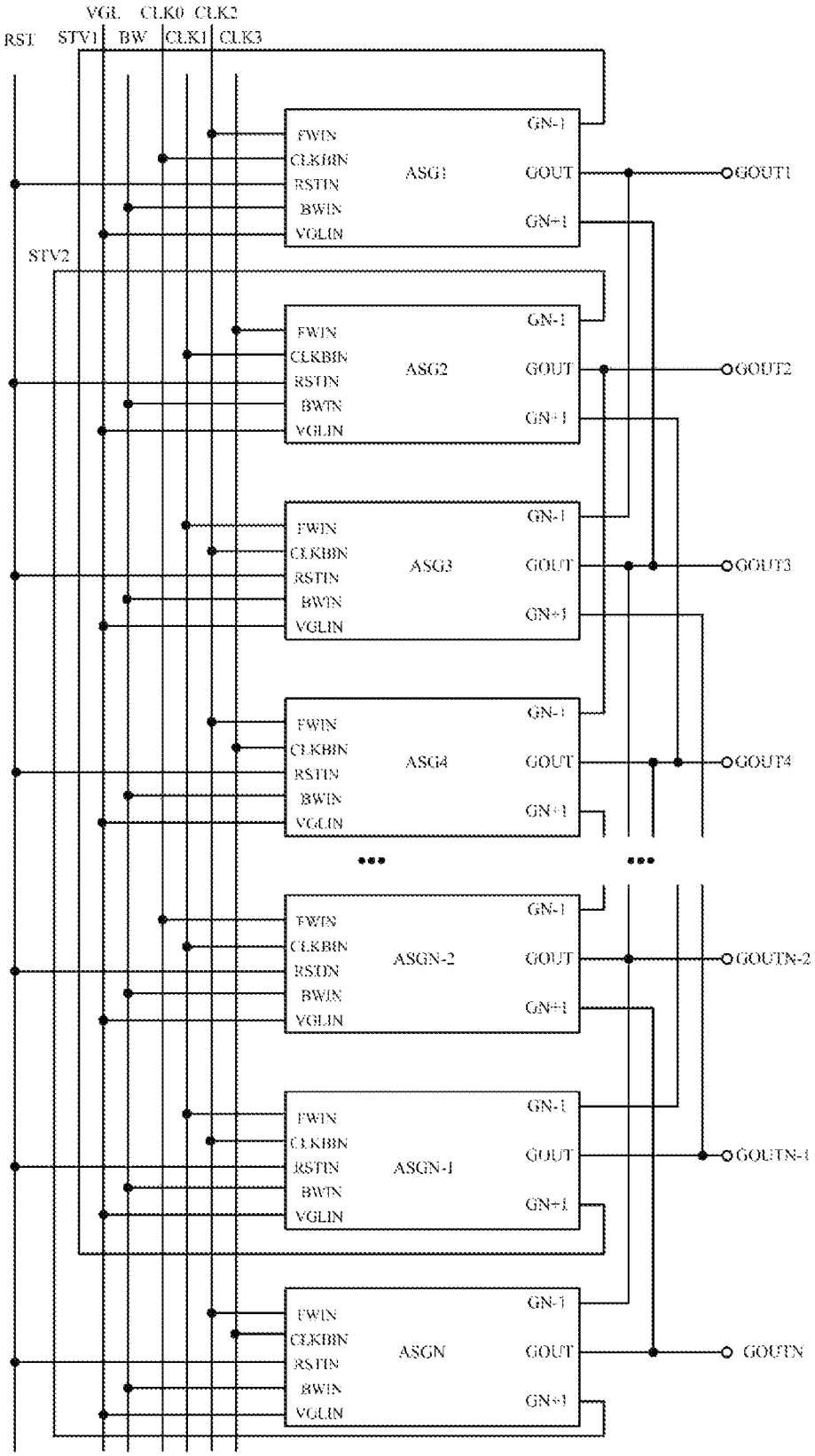
FIG. 3 is a first schematic structural diagram of a gate drive apparatus according to an embodiment of the present invention.

An embodiment of the invention provides a gate drive apparatus as illustrated in FIG. 3 including N shift register units, where:

A forward select signal terminal GN−1 of the p-th shift register unit ASGp receives a signal GOUTp−2 output by the (p−2)-th shift register unit ASGp−2, where p=3, 4, . . . , N, and a backward select signal terminal GN+1 of the r-th shift register unit ASGr receives a signal GOUTr+2 output by the (r+2)-th shift register unit ASGr+2, where r=1, 2, . . . , N−2; a forward select signal terminal GN−1 of the first shift register unit ASG1 receives a first initial trigger signal STV1, and a forward select signal terminal GN−1 of the second shift register unit ASG2 receives a second initial trigger signal STV2; and if N represents an even number, then a backward select signal terminal GN+1 of the second last shift register unit ASGN−1 receives the first initial trigger signal STV1, and a backward select signal terminal GN+1 of the last shift register unit ASGN receives the second initial trigger signal STV2; and if N represents an odd number, then the backward select signal terminal GN+1 of the last shift register unit ASGN receives the first initial trigger signal STV1, and the backward select signal terminal GN+1 of the second last shift register unit ASGN−1 receives the second initial trigger signal STV2; a low level signal terminal VGLIN of each of the shift register units receives a low level signal VGL; and a reset signal terminal RSTIN of each of the shift register units receives a reset signal RST which is at a high level after the end of scanning a preceding frame and before the start of scanning a current frame and at a low level in scanning the current frame;

A clock block signal terminal CLKBIN of the k-th shift register unit ASGk receives a mod((k−1)/4)-th clock signal CLK mod((k−1)/4), where k=1, 2, . . . , N, for example, the clock block signal terminal CLKBIN of the first shift register unit ASG1 receives the 0th clock signal CLK0; a signal received by a forward scan signal terminal FWIN of each of the shift register units other than the first two shift register units, i.e., the first shift register unit ASG1 and the second shift register unit ASG2, is the same as the signal received by the clock block signal terminal CLKBIN of the preceding shift register unit to the shift register unit, that is, the forward scan signal terminal FWIN of the l-th shift register unit ASG1 receives a mod((l−2)/4)-th clock signal CLK mod((l−2)/4), where l=3, 4, . . . , N, a forward scan signal terminal FWIN of the first shift register unit ASG1 receives a second clock signal CLK2, and a forward scan signal terminal FWIN of the second shift register unit ASG2 receives a third clock signal CLK3; when the 0th clock signal CLK0 is at the high level, the second clock signal CLK2 is at the low level, and when the second clock signal CLK2 is at the high level, the 0th clock signal CLK0 is at the low level; when the first clock signal CLK1 is at the high level, the third clock signal CLK3 is at the low level, and when the third clock signal CLK3 is at the high level, the first clock signal CLK1 is at the low level; and a period of time in which the n-th clock signal CLKn is at the high level overlaps with a period of time in which the (n+1)-th clock signal CLKn+1 is at the high level by a length of time no less than a first preset length of time, where n=0, 1, 2, 3, and when n+1>3, the (n+1)-th clock signal CLKn+1 is a mod ((n+1)/4)-th clock signal CLK mod((n+1)/4); and In forward scanning, a period of time in which the first initial trigger signal STV1 is at the high level overlaps with the period of time in which the second clock signal CLK2 is at the high level at a time by a length of time no less than a period of time it takes to charge a gate of a transistor of a drive gate line in the first shift register unit ASG1 to the voltage at which the transistor can be turned on stably and no more than one cycle of the second clock signal CLK2, and a period of time in which the second initial trigger signal STV2 is at the high level overlaps with the period of time in which the third clock signal CLK3 is at the high level at a time by a length of time no less than a period of time it takes to charge a gate of a transistor of a drive gate line in the second shift register unit ASG2 to the voltage at which the transistor can be turned on stably and no more than one cycle of the third clock signal CLK3.

Figure 4:
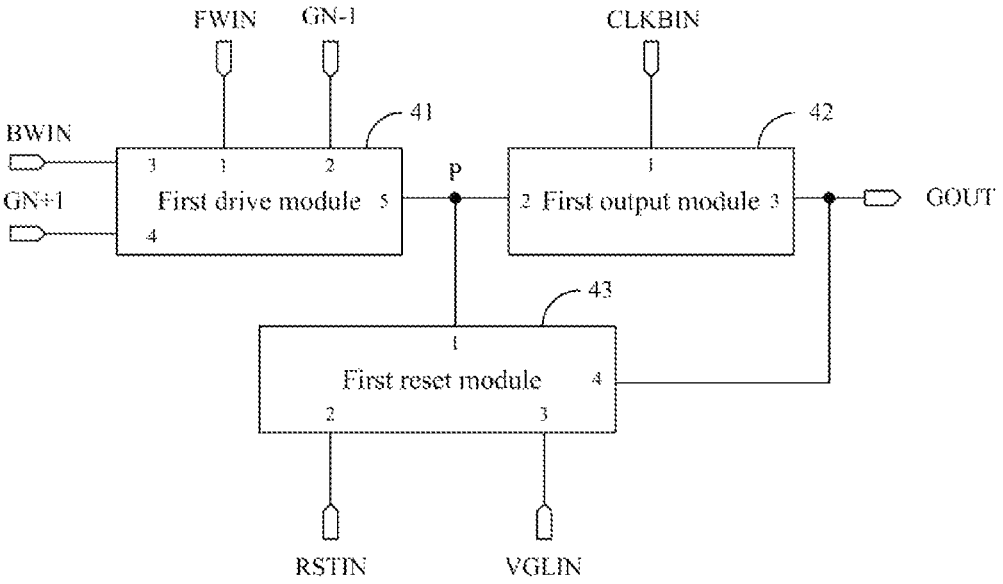
FIG. 4 is a first schematic structural diagram of a shift register unit in a gate drive apparatus according to an embodiment of the present invention.

The respective shift register units in the gate drive apparatus illustrated in FIG. 3 can be structured as a shift register unit illustrated in FIG. 4 or of course can be embodied as a shift register unit in another structure, and the shift register units in the gate drive apparatus will not be limited in structure as long as scanning can be performed with the connection scheme illustrated in FIG. 3. The shift register unit illustrated in FIG. 4 includes a first drive module 41, a first output module 42 and a first reset module 43, where:

A first terminal of the first drive module 41 is the forward scan signal terminal FWIN of the shift register unit, a second terminal of the first drive module 41 is the forward select signal terminal GN−1 of the shift register unit, a third terminal of the first drive module 41 is the backward scan signal terminal BWIN of the shift register unit, a fourth terminal of the first drive module 41 is the backward select signal terminal GN+1 of the shift register unit, and a fifth terminal of the first drive module 41 is connected with a second terminal of the first output module 42; a first terminal of the first output module 42 is the clock block signal terminal CLKBIN of the shift register unit, and a third terminal of the first output module 42 is the output terminal GOUT of the shift register unit; and a first terminal of the first reset module 43 is connected with the second terminal of the first output module 42, a second terminal of the first reset module 43 is the reset signal terminal RSTIN of the shift register unit, a third terminal of the first reset module 43 is the low level signal terminal VGLIN of the shift register unit, and a fourth terminal of the first reset module 43 is the third terminal of the first output module 42;

The first drive module 41 is configured to output the signal received by the forward scan signal terminal FWIN through the fifth terminal thereof when the forward select signal terminal GN−1 receives a high level signal; and to output the signal received by the backward scan signal terminal BWIN through the fifth terminal thereof when the backward select signal terminal GN+1 receives a high level signal;

The first reset module 43 is configured to output the signal received by the low level signal terminal VGLIN through the first terminal and the fourth terminal thereof respectively when the reset signal terminal RSTIN receives a high level signal; and The first output terminal 42 is configured, upon reception of a high level signal through the second terminal thereof, to store the high level signal and to output the signal received by the clock block signal terminal CLKBIN through the output terminal GOUT of the shift register unit; and upon reception of a low level signal through the second terminal thereof, to store the low level signal without outputting the signal received by the clock block signal terminal CLKBIN through the output terminal GOUT of the shift register unit.

A node where the first drive module 41, the first output module 42 and the first reset module 43 in FIG. 4 are connected is a pull-up node P.

Figure 5:
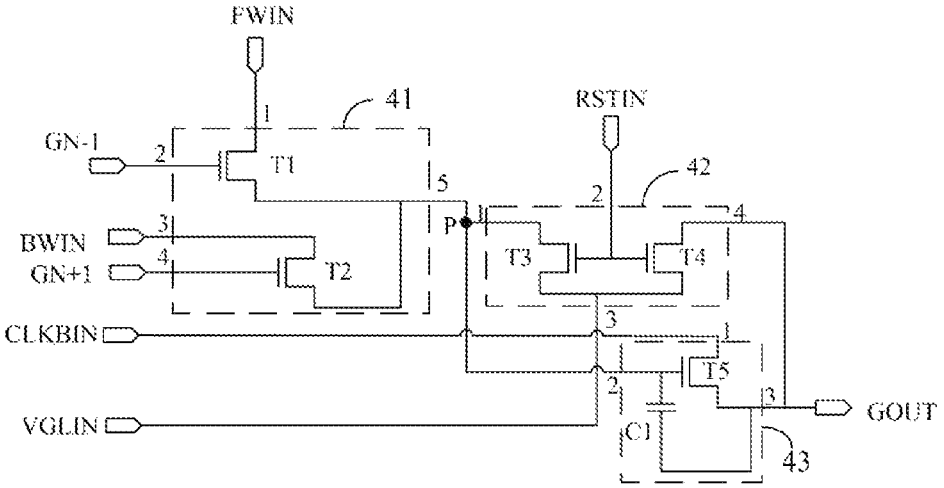
FIG. 5 is a first circuit diagram of a shift register unit in a gate drive apparatus according to an embodiment of the present invention.

Furthermore, the first drive module 41 in FIG. 4 can be structured as illustrated in FIG. 5 where the first drive module 41 includes a first transistor T1 and a second transistor T2; a first S/D (source/drain) of the first transistor T1 is the first terminal of the first drive module 41, a gate of the first transistor T1 is the second terminal of the first drive module 41, and a second S/D of the first transistor T1 is the fifth terminal of the first drive module 41; a first S/D of the second transistor T2 is the fifth terminal of the first drive module 41, a gate of the second transistor T2 is the fourth terminal of the first drive module 41, and a second S/D of the second transistor T2 is the third terminal of the first drive module 41; the first transistor T1 is configured to be turned on to transmit the signal received by the forward scan signal terminal FWIN to the fifth terminal of the first drive module 41 when the forward select signal terminal GN−1 receives the high level signal; and to be turned off without further transmitting the signal received by the forward scan signal terminal FWIN to the fifth terminal of the first drive module 41 when the forward select signal terminal GN−1 receives a low level signal; and the second transistor T2 is configured to be turned on to transmit the signal received by the backward scan signal terminal BWIN to the fifth terminal of the first drive module 41 when the backward select signal terminal GN+1 receives the high level signal; and to be turned off without further transmitting the signal received by the backward scan signal terminal BWIN to the fifth terminal of the first drive module 41 when the backward select signal terminal GN+1 receives a low level signal.

Furthermore the first reset module 43 in FIG. 4 can be structured as illustrated in FIG. 5 where the first reset module 43 includes a third transistor T3 and a fourth transistor T4; a first S/D of the third transistor T3 is the first terminal of the first reset module 43, a gate of the third transistor T3 is the second terminal of the first reset module 43, and a second S/D of the third transistor T3 is the third terminal of the first reset module 43; a first S/D of the fourth transistor T4 is the third terminal of the first reset module 43, the gate of the fourth transistor T4 is the second terminal of the first reset module 43, and a second S/D of the fourth transistor T4 is the fourth terminal of the first reset module 43; the third transistor T3 is configured to be turned on to transmit the signal received by the low level signal terminal VGLIN to the first terminal of the first reset module 43 when the reset signal terminal RSTIN is at the high level and to be turned off when the reset signal terminal RSTIN is at the low level; and the fourth transistor T4 is configured to be turned on to transmit the signal received by the low level signal terminal VGLIN to the fourth terminal of the first reset module 43 when the reset signal terminal RSTIN is at the high level and to be turned off when the reset signal terminal RSTIN is at the low level.

Furthermore the first output module 42 in FIG. 4 can be structured as illustrated in FIG. 5 where the first output module 42 includes a fifth transistor T5 and a first capacitor C1; a first S/D of the fifth transistor T5 is the first terminal of the first output module 42, a gate of the fifth transistor T5 is connected with one terminal of the first capacitor C1, the gate of the fifth transistor T5 is the second terminal of the first output module 42, a second S/D of the fifth transistor T5 is the third terminal of the first output module 42, and the other terminal of the first capacitor C1 is connected with the second S/D of the fifth transistor T5; the fifth transistor T5 is configured to be turned on to transmit the signal received by the clock block signal terminal CLKBIN to the output terminal GOUT of the shift register unit when the gate thereof is at the high level and to be turned off when the gate thereof is at the high level; and the first capacitor C1 is configured to storage the signal at the gate of the fifth transistor T5.

Figure 6A:
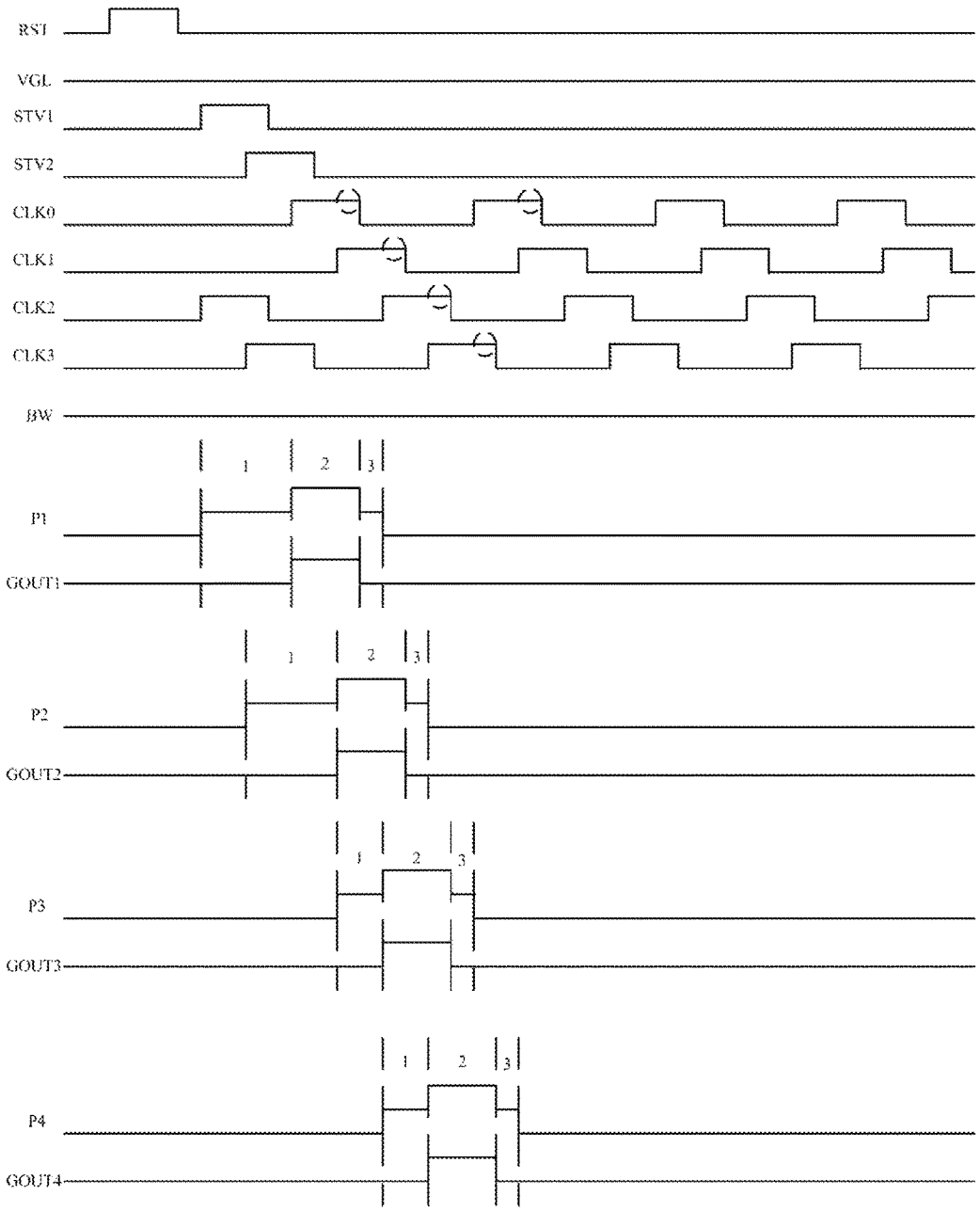
FIG. 6*a* is a timing diagram of the gate drive apparatus illustrated in FIG. 3 in forward scanning.
Figure 6B:
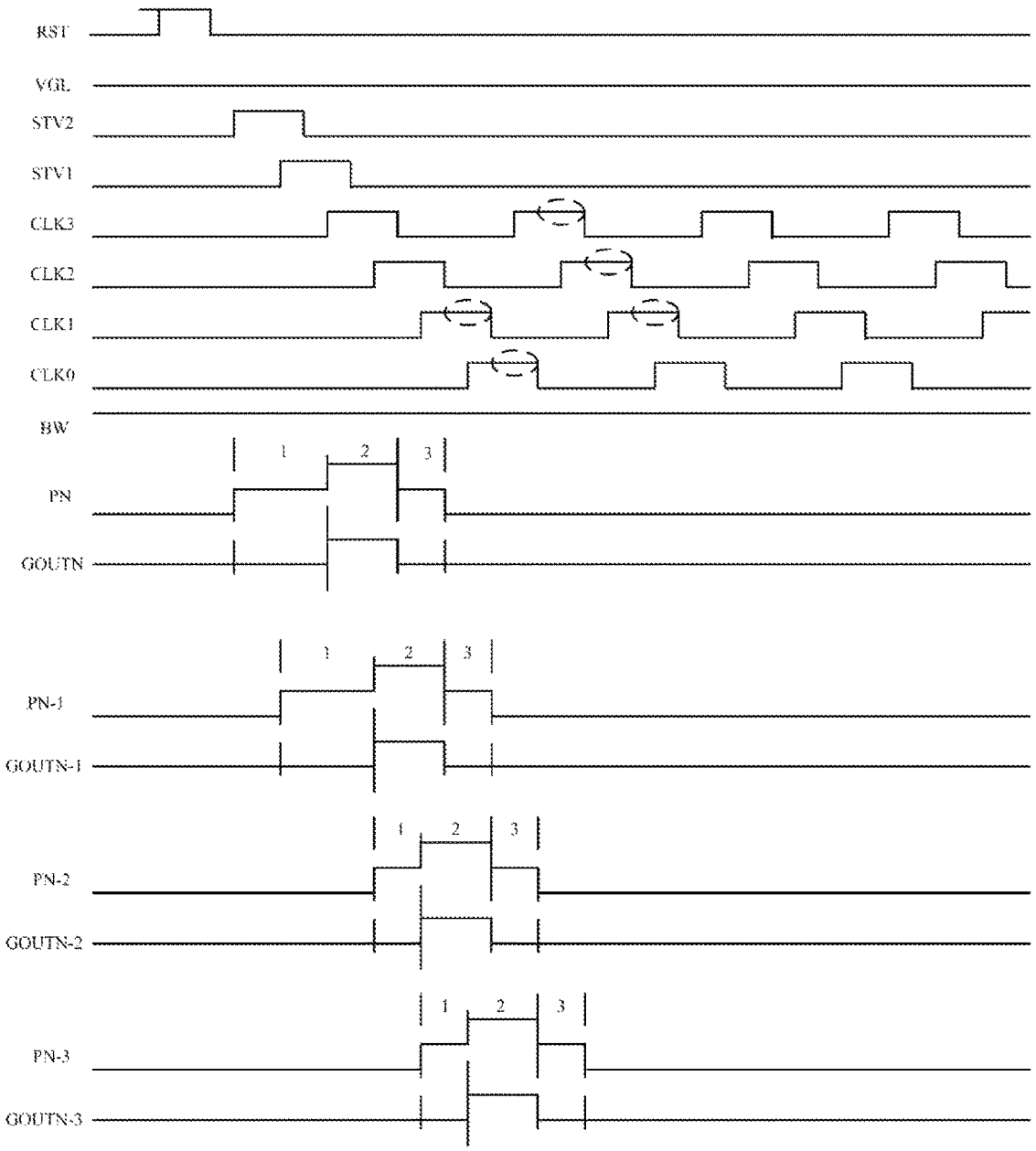
FIG. 6*b* is a timing diagram of the gate drive apparatus illustrated in FIG. 3 in backward scanning.

Operating conditions of the gate drive apparatus illustrated in FIG. 3 in forward scanning and backward scanning will be described below by way of an example where the respective shift register units in the gate drive apparatus illustrated in FIG. 3 each are structured as the shift register unit illustrated in FIG. 5. An operating timing diagram of the gate drive apparatus illustrated in FIG. 3 in forward scanning is as illustrated in FIG. 6*a*, and an operating timing diagram of the gate drive apparatus illustrated in FIG. 3 in backward scanning is as illustrated in FIG. 6*b*, where FIG. 6*a* illustrates an operating timing diagram of only the first four shift register units in the gate shift register units in the gate drive apparatus, and FIG. 6*b* illustrates an operating timing diagram of only the last four shift register units in the gate shift register units in the gate drive apparatus. N shift register units are assumed included in the gate drive apparatus illustrated in FIG. 3, and an operating principle of the gate drive apparatus will be described below by way of an example where N represents an integer multiple of 4. An operating principle of the gate drive apparatus with N being an integer other than an integer multiple of 4 will be similar to the operating principle of the gate drive apparatus with N being an integer multiple of 4, so a repeated description thereof will be omitted here.

In FIG. 6*a*, in a first period of time of the first shift register unit ASG1, the first initial trigger signal STV1 received by the forward select signal terminal GN−1 thereof is at the high level, and the first transistor T1 in the first shift register unit ASG1 is turned on, and in the meantime the second clock signal CLK2 received by the forward scan signal terminal FWIN thereof is at the high level, so the first capacitor C1 in the first shift register unit ASG1 starts to be charged, and when the first capacitor C1 is charged until the transistor of the drive gate line in the first shift register unit ASG1, i.e., the fifth transistor T5, can be turned on, the fifth transistor T5 is turned on, and the signal received by the clock block signal terminal CLKBIN of the first shift register unit ASG1, i.e., the 0th clock signal CLK0, will be output from the output terminal GOUT1 of the first shift register unit ASG1 through the fifth transistor T5, and in the first period of time of the first shift register unit ASG1, the 0th clock signal CLK0 is at the low level, so the output terminal GOUT1 of the first shift register unit ASG1 outputs a low level signal; and when the 0th clock signal CLK0 is changed from the low level to the high level, the first shift register unit ASG1 proceeds from the first period of time to a second period of time. In the second period of time of the first shift register unit ASG1, the first initial trigger signal STV1 is at the low level, so the first transistor T1 in the first shift register unit ASG1 is turned off, but since the first capacitor C1 stores the voltage signal at the pull-up node P1 in the first shift register unit ASG1, the fifth transistor T5 in the first shift register unit ASG1 is still turned on, and since the 0th clock signal CLK0 is at the high level in this period of time, the output terminal GOUT1 of the first shift register unit ASG1 outputs a high level signal, and a bootstrap effect of the first capacitor C1 will have the potential at the pull-up node P1 of the first shift register unit ASG1 further boosted; and when the 0th clock signal CLK0 is changed from the high level to the low level, the first shift register unit ASG1 proceeds from the second period of time to a third period of time. In the third period of time of the first shift register unit ASG1, the first initial trigger signal STV1 is at the low level, so the first transistor T1 in the first shift register unit ASG1 is turned off, but due to the storage function of the first capacitor C1 in the first shift register unit ASG1, the fifth transistor T5 in the first shift register unit ASG1 is still turned on, and since the 0th clock signal CLK0 is at the low level in this period of time, the output terminal GOUT1 of the first shift register unit ASG1 outputs a low level signal, when the backward select signal terminal GN+1 of the first shift register unit ASG1 receives a high level signal and the backward scan signal terminal BWIN thereof receives a low level signal, that is, the output terminal GOUT3 of the third shift register unit ASG3 outputs a high level signal (when the second clock signal CLK2 is at the high level, the output terminal GOUT3 of the third shift register unit ASG3 outputs a high level signal) and the backward scan signal BW is at the low level (the backward scan signal BW is at the low level all the time in FIG. 6*a*), the first capacitor C1 in the first shift register unit ASG1 is discharged, and when it is discharged until the voltage at the gate of the fifth transistor T5 in the first shift register unit ASG1 is below the voltage at which the fifth transistor T5 can be turned on, the fifth transistor T5 in the first shift register unit ASG1 is turned off, and the third period of time of the first shift register unit ASG1 ends, where the first period of time, the second period of time and the third period of time of the first shift register unit ASG1 are periods of time in which the gate line connected with the first shift register unit ASG1 is enabled.

Since the first capacitor C1 in the first shift register unit ASG1 is charged when the first initial trigger signal STV1 is at the high level and the second clock signal CLK2 is at the high level, in order to ensure that the fifth transistor T5 in the first shift register unit ASG1 can be turned on stably, the period of time in which the first initial trigger signal STV1 is at the high level overlaps with the period of time in which the second clock signal CLK2 is at the high level by a length of time no less than the length of time it takes to charge the first capacitor C1 in the first shift register unit ASG1 to the voltage at which the fifth transistor T5 in the first shift register unit ASG1 can be turned on stably.

In FIG. 6*a*, in a first period of time of the second shift register unit ASG2, the second initial trigger signal STV2 received by the forward select signal terminal GN−1 thereof is at the high level, and the first transistor T1 in the second shift register unit ASG2 is turned on, and in the meantime the third clock signal CLK3 received by the forward scan signal terminal FWIN thereof is at the high level, so the first capacitor C1 in the second shift register unit ASG2 starts to be charged, and when the first capacitor C1 is charged until the transistor of the drive gate line in the second shift register unit ASG2, i.e., the fifth transistor T5, can be turned on, the fifth transistor T5 is turned on, and the signal received by the clock block signal terminal CLKBIN of the second shift register unit ASG2, i.e., the first clock signal CLK1, will be output from the output terminal GOUT2 of the second shift register unit ASG2 through the fifth transistor T5, and in the first period of time of the second shift register unit ASG2, the first clock signal CLK1 is at the low level, so the output terminal GOUT2 of the second shift register unit ASG2 outputs a low level signal; and when the first clock signal CLK1 is changed from the low level to the high level, the second shift register unit ASG2 proceeds from the first period of time to a second period of time. In the second period of time of the second shift register unit ASG2, the second initial trigger signal STV2 is at the low level, and the first transistor T1 in the second shift register unit ASG2 is turned off, but since the first capacitor C1 stores the voltage signal at the pull-up node P2 in the second shift register unit ASG2, the fifth transistor T5 in the second shift register unit ASG2 is still turned on, and since the first clock signal CLK1 is at the high level in this period of time, the output terminal GOUT2 of the second shift register unit ASG2 outputs a high level signal, and a bootstrap effect of the first capacitor C1 will have the potential at the pull-up node P2 of the second shift register unit ASG2 further boosted; and when the first clock signal CLK1 is changed from the high level to the low level, the second shift register unit ASG2 proceeds from the second period of time to a third period of time. In the third period of time of the second shift register unit ASG2, the second initial trigger signal STV2 is at the low level, so the first transistor T1 in the second shift register unit ASG2 is turned off, but due to the storage function of the first capacitor C1 in the second shift register unit ASG2, the fifth transistor T5 in the second shift register unit ASG2 is still turned on, and since the first clock signal CLK1 is at the low level in this period of time, the output terminal GOUT2 of the second shift register unit ASG2 outputs a low level signal, when the backward select signal terminal GN+1 of the second shift register unit ASG2 receives a high level signal and the backward scan signal terminal BWIN thereof receives a low level signal, that is, the output terminal GOUT4 of the fourth shift register unit ASG4 outputs a high level signal (when the third clock signal CLK3 is at the high level, the output terminal GOUT4 of the fourth shift register unit ASG4 outputs a high level signal) and the backward scan signal BW is at the low level (the backward scan signal BW is at the low level all the time in FIG. 6*a*), the first capacitor C1 in the second shift register unit ASG2 is discharged, and when it is discharged until the voltage at the gate of the fifth transistor T5 in the second shift register unit ASG2 is below the voltage at which the fifth transistor T5 can be turned on, the fifth transistor T5 in the second shift register unit ASG2 is turned off, and the third period of time of the second shift register unit ASG2 ends, where the first period of time, the second period of time and the third period of time of the second shift register unit ASG2 are periods of time in which the gate line connected with the second shift register unit ASG2 is enabled.

Since the first capacitor C1 in the second shift register unit ASG2 is charged when the second initial trigger signal STV2 is at the high level and the third clock signal CLK3 is at the high level, in order to ensure that the fifth transistor T5 in the second shift register unit ASG2 can be turned on stably, the period of time in which the second initial trigger signal STV2 is at the high level overlaps with the period of time in which the third clock signal CLK3 is at the high level by a length of time no less than the length of time it takes to charge the first capacitor C1 in the second shift register unit ASG2 to the voltage at which the fifth transistor T5 in the second shift register unit ASG2 can be turned on stably.

In FIG. 6*a*, in a first period of time of the q-th (q=3, 4, . . . , N) shift register unit ASGq, the output terminal GOUTq−2 of the (q−2)-th shift register unit ASGq−2 received by the forward select signal terminal GN−1 thereof is at the high level (when the mod((q−3)/4)-th clock signal CLK mod((q−3)/4) is at the high level, the output terminal GoutTq−2 of the (q−2)-th shift register unit ASGq−2 outputs a high level signal) and the first transistor T1 in the q-th shift register unit ASGq is turned on, and in the meantime the mod((q−2)/4)-th clock signal CLK mod((q−2)/4) received by the forward scan signal terminal FWIN thereof is at the high level, so the first capacitor C1 in the q-th shift register unit ASGq starts to be charged, and when the first capacitor C1 is charged until the transistor of the drive gate line in the q-th shift register unit ASGq, i.e., the fifth transistor T5, can be turned on, the fifth transistor T5 is turned on, and the signal received by the clock block signal terminal CLKBIN of the q-th shift register unit ASGq, i.e., the mod((q−1)/4)-th clock signal CLK mod((q−1)/4), will be output from the output terminal GOUTq of the q-th shift register unit ASGq through the fifth transistor T5, and in the first period of time of the q-th shift register unit ASGq, the mod((q−1)/4)-th clock signal CLK mod((q−1)/4) is at the low level, so the output terminal GOUTq of the q-th shift register unit ASGq outputs a low level signal; and in the first period of time of the q-th shift register unit ASGq, the first capacitor C1 in the q-th shift register unit ASGq can be charged only when the mod((q−3)/4)-th clock signal CLK mod((q−3)/4) is at the high level and the mod((q−2)/4)-th clock signal CLK mod ((q−2)/4) is at the high level, so in order to ensure that the fifth transistor T5 in the q-th shift register unit ASGq can be turned on stably, the period of time in which the mod((q−3)/4)-th clock signal CLK mod((q−3)/4) is at the high level shall overlap with the period of time in which the mod((q−2)/4)-th clock signal CLK mod((q−2)/4) is at the high level by a length of time no less than the first preset length of time, where the first preset length of time is the length of time it takes to charge the first capacitor C1 in the q-th shift register unit ASGq to the voltage at which the fifth transistor T5 therein can be turned on stably; and where a period of time in which the first capacitor C1 in the q-th shift register unit ASGq can be charged is a period of time denoted in FIG. 6*a* by a dotted circle; and after the mod((q−3)/4)-th clock signal CLK mod((q−3)/4) is changed from the high level to the low level, the first capacitor C1 in the q-th shift register unit ASGq will not be further charged but can only perform the storage function even if the mod((q−2)/4)-th clock signal CLK mod((q−2)/4) is at the high level, and after the mod ((q−1)/4)-th clock signal CLK mod((q−1)/4) is changed from the low level to the high level, the first period of time of the q-th shift register unit ASGq ends, and the q-th shift register unit ASGq proceeds to a second period of time. In the second period of time of the q-th shift register unit ASGq, the mod((q−3)/4)-th clock signal CLK mod((q−3)/4) is at the low level, and the first transistor T1 in the q-th shift register unit ASGq is turned off, and no matter whether the mod((q−2)/4)-th clock signal CLK mod((q−2)/4) is at the high level or the low level, the signal at the pull-up node Pq in the q-th shift register unit ASGq can only be such a signal stored on the first capacitor C1 in the q-th shift register unit ASGq that can have the fifth transistor T5 in the q-th shift register unit ASGq turned on, and since the mod((q−1)/4)-th clock signal CLK mod((q−1)/4) is at the high level in this period of time, the output terminal GOUTq of the q-th shift register unit ASGq outputs a high level signal, and a bootstrap effect of the first capacitor C1 will have the potential at the pull-up node Pq of the q-th shift register unit ASGq further boosted. After the mod((q−1)/4)-th clock signal CLK mod((q−1)/4) is changed from the high level to the low level, the second period of time of the q-th shift register unit ASGq ends, and the q-th shift register unit ASGq proceeds to a third period of time. In the third period of time of the q-th shift register unit ASGq, the mod((q−3)/4)-th clock signal CLK mod((q−3)/4) is at the low level, and the first transistor T1 in the q-th shift register unit ASGq is turned off, but due to the storage function of the first capacitor C1 in the q-th shift register unit ASGq, the fifth transistor T5 in the q-th shift register unit ASGq is still turned on, and since the mod((q−1)/4)-th clock signal CLK mod((q−1)/4) is at the low level in this period of time, the output terminal GOUTq of the q-th shift register unit ASGq outputs a low level signal, and when the backward select signal terminal GN+1 of the q-th shift register unit ASGq receives a high level signal and the backward scan signal terminal BWIN thereof receives a low level signal, that is, the output terminal GOUTq+2 of the (q+2)-th shift register unit ASGq+2 outputs a high level signal (when the mod((q+1)/4)-th clock signal CLK mod((q+1)/4) is at the high level, the output terminal GOUTq+2 of the (q+2)-th shift register unit ASGq+2 outputs a high level signal) and the backward scan signal BW is at the low level (the backward scan signal BW is at the low level all the time in FIG. 6*a*), the first capacitor C1 in the q-th shift register unit ASGq is discharged, and when it is discharged until the voltage at the gate of the fifth transistor T5 in the q-th shift register unit ASGq is below the voltage at which the fifth transistor T5 can be turned on, the fifth transistor T5 in the q-th shift register unit ASGq is turned off, and the third period of time of the q-th shift register unit ASGq ends.

In FIG. 6*a*, since the signal received by the backward select signal terminal GN+1 of the (N−1)-th shift register unit ASGN−1 is the first initial trigger signal STV1 which will be at the high level to thereby trigger the start of scanning only when one frame starts to be scanned and which will be at the low level at other times, the backward select signal terminal GN+1 of the (N−1)-th shift register unit ASGN−1 will be at the high level only when one frame starts to be scanned and will be at the low level at other times, so the second transistor T2 in the (N−1)-th shift register unit ASGN−1 can not be turned on so that the first capacitor C1 in the (N−1)-th shift register unit ASGN−1 can not be discharged through the second transistor T2 so that the fifth transistor T5 in the (N−1)-th shift register unit ASGN−1 can not be turned off; and the fifth transistor T5 in the (N−1)-th shift register unit ASGN−1 can have the signal at the gate thereof (i.e., the signal stored on the first capacitor C1) released through the third transistor T3 in the (N−1)-th shift register unit ASGN−1 to thereby be turned off only when the reset signal terminal RSTIN in the (N−1)-th shift register unit ASGN−1 receives a high level signal (that is, the reset signal RST is at the high level after the end of scanning a preceding frame and before the start of scanning a next frame); and when the reset signal RST is at the high level, the fourth transistor T4 in the (N−1)-th shift register unit ASGN−1 is turned on so that the gate line connected with the (N−1)-th shift register unit ASGN−1 receives a low level signal. Thus the third period of time of the (N−1)-th shift register unit ASGN−1 will end only when the reset signal terminal RSTIN thereof receives a high level signal (that is, the reset signal RST is changed from the low level signal to the high level signal).

In FIG. 6*a*, since the signal received by the backward select signal terminal GN+1 of the N-th shift register unit ASGN is the second initial trigger signal STV2 which will be at the high level to thereby trigger the start of scanning only when one frame starts to be scanned and which will be at the low level at other times, the backward select signal terminal GN+1 of the N-th shift register unit ASGN will be at the high level only when one frame starts to be scanned and will be at the low level at other times, so the second transistor T2 in the N-th shift register unit ASGN can not be turned on so that the first capacitor C1 in the N-th shift register unit ASGN can not be discharged through the second transistor T2, so the fifth transistor T5 in the N-th shift register unit ASGN can not be turned off; and the fifth transistor T5 in the N-th shift register unit ASGN can have the signal at the gate thereof (i.e., the signal stored on the first capacitor C1) released through the third transistor T3 in the N-th shift register unit ASGN to thereby be turned off only when the reset signal terminal RSTIN in the N-th shift register unit ASGN receives a high level signal (that is, the reset signal RST is at the high level after the end of scanning a preceding frame and before the start of scanning a next frame); and when the reset signal RST is at the high level, the fourth transistor T4 in the N-th shift register unit ASGN is turned on so that the gate line connected with the N-th shift register unit ASGN receives a low level signal. Thus the third period of time of the N-th shift register unit ASGN will end only when the reset signal terminal RSTIN thereof receives a high level signal (that is, the reset signal RST is changed from the low level signal to the high level signal).

In FIG. 6*a*, with each of the shift register units, when the reset signal terminal RSTIN thereof receives a high level signal (that is, the reset signal RST is at the high level), the gate of the fifth transistor T5 therein will receive a low level signal so that the fifth transistor T5 will be turned off, and the gate line connected with the each shift register unit will also receive a low level signal to thereby eliminate an influence of a residual signal after the end of scanning the preceding frame upon the succeeding frame.

Particularly the first period of time, the second period of time and the third period of time of the q-th shift register unit ASGq are periods of time in which the gate line connected with the q-th shift register unit ASGq is enabled.

In FIG. 6*b*, in a first period of time of the N-th (N represents an integer multiple of 4) shift register unit ASGN, the second initial trigger signal STV2 received by the backward select signal terminal GN+1 thereof is at the high level, and the second transistor T2 in the N-th shift register unit ASGN is turned on, and in the meantime the backward scan signal BW received by the backward scan signal terminal BWIN thereof is at the high level (the backward scan signal BW is at the high level all the time in FIG. 6*b*), so the first capacitor C1 in the N-th shift register unit ASGN starts to be charged, and when the first capacitor C1 is charged until the transistor of the drive gate line in the N-th shift register unit ASGN, i.e., the fifth transistor T5, can be turned on, the fifth transistor T5 is turned on, and the signal received by the clock block signal terminal CLKBIN of the N-th shift register unit ASGN, i.e., the third clock signal CLK3, will be output from the output terminal GOUTN of the N-th shift register unit ASGN through the fifth transistor T5, and in the first period of time of the N-th shift register unit ASGN, the third clock signal CLK3 is at the low level, so the output terminal GOUTN of the N-th shift register unit ASGN outputs a low level signal; and when the third clock signal CLK3 is changed from the low level to the high level, the N-th shift register unit ASGN proceeds from the first period of time to a second period of time. In the second period of time of the N-th shift register unit ASGN, the second initial trigger signal STV2 is at the low level, so the second transistor T2 in the N-th shift register unit ASGN is turned off, but since the first capacitor C1 stores the voltage signal at the pull-up node P2 in the N-th shift register unit ASGN, the fifth transistor T5 in the N-th shift register unit ASGN is still turned on, and since the third clock signal CLK3 is at the high level in this period of time, the output terminal GOUTN of the N-th shift register unit ASGN outputs a high level signal, and a bootstrap effect of the first capacitor C1 will have the potential at the pull-up node PN of the N-th shift register unit ASGN further boosted; and when the third clock signal CLK3 is changed from the high level to the low level, the N-th shift register unit ASGN proceeds from the second period of time to a third period of time. In the third period of time of the N-th shift register unit ASGN, the second initial trigger signal STV2 is at the low level, so the second transistor T2 in the N-th shift register unit ASGN is turned off, but due to the storage function of the first capacitor C1 in the N-th shift register unit ASGN, the fifth transistor T5 in the N-th shift register unit ASGN is still turned on, and since the third clock signal CLK3 is at the low level in this period of time, the output terminal GOUTN of the N-th shift register unit ASGN outputs a low level signal, when the forward select signal terminal GN−1 of the N-th shift register unit ASGN receives a high level signal and the forward scan signal terminal FWIN terminal thereof receives a low level signal, that is, the output terminal GOUTN−2 of the (N−2)-th shift register unit ASGN−2 outputs a high level signal (when the first clock signal CLK1 is at the high level, the output terminal GOUTN−2 of the (N−2)-th shift register unit ASGN−2 outputs a high level signal) and the second clock signal CLK2 is at the low level, the first capacitor C1 in the N-th shift register unit ASGN is discharged, and when it is discharged until the voltage at the gate of the fifth transistor T5 in the N-th shift register unit ASGN is below the voltage at which the fifth transistor T5 can be turned on, the fifth transistor T5 in the N-th shift register unit ASGN is turned off, and the third period of time of the N-th shift register unit ASGN ends, where the first period of time, the second period of time and the third period of time of the N-th shift register unit ASGN are periods of time in which the gate line connected with the N-th shift register unit ASGN is enabled.

Since the first capacitor C1 in the N-th shift register unit ASGN is discharged when the first clock signal CLK1 is at the high level and the second clock signal CLK2 is at the low level, in order to ensure that the fifth transistor T5 in the N-th shift register unit ASGN can be turned off, the period of time in which the first clock signal CLK1 is at the high level overlaps with the period of time in which the second clock signal CLK2 is at the low level by a length of time no less than the length of time it takes to discharge the first capacitor C1 in the N-th shift register unit ASGN to the voltage at which the fifth transistor T5 in the N-th shift register unit ASGN can be turned off.

In FIG. 6*b*, in a first period of time of the (N−1)-th shift register unit ASGN−1, the first initial trigger signal STV1 received by the backward select signal terminal GN+1 thereof is at the high level, and the second transistor T2 in the (N−1)-th shift register unit ASGN−1 is turned on, and in the meantime the backward scan signal BW received by the backward scan signal terminal BWIN thereof is at the high level (the backward scan signal BW is at the high level all the time in FIG. 6*b*), so the first capacitor C1 in the (N−1)-th shift register unit ASGN−1 starts to be charged, and when the first capacitor C1 is charged until the transistor of the drive gate line in the (N−1)-th shift register unit ASGN−1, i.e., the fifth transistor T5, can be turned on, the fifth transistor T5 is turned on, and the signal received by the clock block signal terminal CLKBIN of the (N−1)-th shift register unit ASGN−1, i.e., the second clock signal CLK2, will be output from the output terminal GOUTN−1 of the (N−1)-th shift register unit ASGN−1 through the fifth transistor T5, and in the first period of time of the (N−1)-th shift register unit ASGN−1, the second clock signal CLK2 is at the low level, so the output terminal GOUTN−1 of the (N−1)-th shift register unit ASGN−1 outputs a low level signal; and when the second clock signal CLK2 is changed from the low level to the high level, the (N−1)-th shift register unit ASGN−1 proceeds from the first period of time to a second period of time. In the second period of time of the (N−1)-th shift register unit ASGN−1, the first initial trigger signal STV1 is at the low level, so the second transistor T2 in the (N−1)-th shift register unit ASGN−1 is turned off, but due to the storage function of the first capacitor C1, the fifth transistor T5 in the (N−1)-th shift register unit ASGN−1 is still turned on, and since the second clock signal CLK2 is at the high level in this period of time, the output terminal GOUTN−1 of the (N−1)-th shift register unit ASGN−1 outputs a high level signal, and a bootstrap effect of the first capacitor C1 will have the potential at the pull-up node PN−1 of the (N−1)-th shift register unit ASGN−1 further boosted; and when the second clock signal CLK2 is changed from the high level to the low level, the (N−1)-th shift register unit ASGN−1 proceeds from the second period of time to a third period of time. In the third period of time of the (N−1)-th shift register unit ASGN−1, the first initial trigger signal STV1 is at the low level, so the second transistor T2 in the (N−1)-th shift register unit ASGN−1 is turned off, but due to the storage function of the first capacitor C1 in the (N−1)-th shift register unit ASGN−1, the fifth transistor T5 in the (N−1)-th shift register unit ASGN−1 is still turned on, and since the second clock signal CLK2 is at the low level in this period of time, the output terminal GOUTN−1 of the (N−1)-th shift register unit ASGN−1 outputs a low level signal, when the forward select signal terminal GN−1 of the (N−1)-th shift register unit ASGN−1 receives a high level signal and the forward scan signal terminal FWIN thereof receives a low level signal, that is, the output terminal GOUTN−3 of the (N−3)-th shift register unit ASGN−3 outputs a high level signal (when the 0th clock signal CLK0 is at the high level, the output terminal GOUTN−3 of the (N−3)-th shift register unit ASGN−3 outputs a high level signal) and the first clock signal CLK1 is at the low level (a period of time denoted in FIG. 6*b* by a dotted circle), the first capacitor C1 in the (N−1)-th shift register unit ASGN−1 is discharged, and when it is discharged until the voltage at the gate of the fifth transistor T5 in the (N−1)-th shift register unit ASGN−1 is below the voltage at which the fifth transistor T5 can be turned on, the fifth transistor T5 in the (N−1)-th shift register unit ASGN−1 is turned off, and the third period of time of the (N−1)-th shift register unit ASGN−1 ends, where the first period of time, the second period of time and the third period of time of the (N−1)-th shift register unit ASGN−1 are periods of time in which the gate line connected with the (N−1)-th shift register unit ASGN−1 is enabled.

Since the first capacitor C1 in the (N−1)-th shift register unit ASGN−1 is discharged when the 0th clock signal CLK0 is at the high level and the first clock signal CLK1 is at the low level, in order to ensure that the fifth transistor T5 in the (N−1)-th shift register unit ASGN−1 can be turned off, the period of time in which the 0th clock signal CLK0 is at the high level overlaps with the period of time in which the first clock signal CLK1 is at the low level by a length of time no less than the length of time it takes to discharge the first capacitor C1 in the (N−1)-th shift register unit ASGN−1 to the voltage at which the fifth transistor T5 in the (N−1)-th shift register unit ASGN−1 can be turned off.

In FIG. 6*b*, in a first period of time of the q-th (q=1, 2, 3, 4, . . . , N−2) shift register unit ASGq, the output terminal GOUTq+2 of the (q+2)-th shift register unit ASGq+2 received by the backward select signal terminal GN+1 thereof is at the high level (when the mod((q+1)/4)-th clock signal CLK mod((q+1)/4) is at the high level, the output terminal GOUTq+2 of the (q+2)-th shift register unit ASGq+2 outputs a high level signal) and the backward scan signal BW received by the backward scan signal terminal BWIN thereof is at the high level, the first capacitor C1 in the q-th shift register unit ASGq is charged, and when the first capacitor C1 is charged until the transistor of the drive gate line in the q-th shift register unit ASGq, i.e., the fifth transistor T5, can be turned on, the fifth transistor T5 is turned on, and the signal received by the clock block signal terminal CLKBIN of the q-th shift register unit ASGq, i.e., the mod((q−1)/4)-th clock signal CLK mod((q−1)/4), will be output from the output terminal GOUTq of the q-th shift register unit ASGq through the fifth transistor T5, and in the first period of time of the q-th shift register unit ASGq, the mod((q−1)/4)-th clock signal CLK mod((q−1)/4) is at the low level, so the output terminal GOUTq of the q-th shift register unit ASGq outputs a low level signal; and after the mod((q+1)/4)-th clock signal CLK mod((q+1)/4) is changed from the high level to the low level, the first capacitor C1 in the q-th shift register unit ASGq will not be further charged but can only perform the storage function even if the backward scan signal BW is at the high level, and after the mod((q−1)/4)-th clock signal CLK mod((q−1)/4) is changed from the low level to the high level, the first period of time of the q-th shift register unit ASGq ends, and the q-th shift register unit ASGq proceeds to a second period of time. In the second period of time of the q-th shift register unit ASGq, the mod((q+1)/4)-th clock signal CLK mod((q+1)/4) is at the low level, the second transistor T2 in the q-th shift register unit ASGq is turned off, and the signal at the pull-up node Pq in the q-th shift register unit ASGq can only be such a signal stored on the first capacitor C1 in the q-th shift register unit ASGq that can have the fifth transistor T5 in the q-th shift register unit ASGq turned on, and since the mod((q−1)/4)-th clock signal CLK mod((q−1)/4) is at the high level in this period of time, the output terminal GOUTq of the q-th shift register unit ASGq outputs a high level signal, and a bootstrap effect of the first capacitor C1 will have the potential at the pull-up node Pq of the q-th shift register unit ASGq further boosted. After the mod((q−1)/4)-th clock signal CLK mod((q−1)/4) is changed from the high level to the low level, the second period of time of the q-th shift register unit ASGq ends, and the q-th shift register unit ASGq proceeds to a third period of time. In the third period of time of the q-th shift register unit ASGq, the mod((q+1)/4)-th clock signal CLK mod((q+1)/4) is at the low level, and the second transistor T2 in the q-th shift register unit ASGq is turned off, but due to the storage function of the first capacitor C1 in the q-th shift register unit ASGq, the fifth transistor T5 in the q-th shift register unit ASGq is still turned on, and since the mod((q−1)/4)-th clock signal CLK mod((q−1)/4) is at the low level in this period of time, the output terminal GOUTq of the q-th shift register unit ASGq outputs a low level signal, and when the forward select signal terminal GN−1 of the q-th shift register unit ASGq receives a high level signal and the forward scan signal terminal FWIN thereof receives a low level signal, that is, the output terminal GOUTq−2 of the (q−2)-th shift register unit ASGq−2 outputs a high level signal (when the mod((q−3)/4)-th clock signal CLK mod((q−3)/4) is at the high level, the output terminal GOUTq−2 of the (q−2)-th shift register unit ASGq−2 outputs a high level signal) and the mod((q−2)/4)-th clock signal CLK mod((q−2)/4) received by the clock block signal terminal CLKBIN of the (q−1)-th shift register unit ASGq−1 is at the low level, the first capacitor C1 in the q-th shift register unit ASGq is discharged, and when it is discharged until the voltage at the gate of the fifth transistor T5 in the q-th shift register unit ASGq is below the voltage at which the fifth transistor T5 can be turned on, the fifth transistor T5 in the q-th shift register unit ASGq is turned off, and the third period of time of the q-th shift register unit ASGq ends.

In FIG. 6*b*, since in the third period of time of the q-th shift register unit ASGq, the first capacitor C1 in the q-th shift register unit ASGq can be discharged only when the mod((q−3)/4)-th clock signal CLK mod((q−3)/4) is at the high level and the mod((q−2)/4)-th clock signal CLK mod((q−2)/4) is at the low level, in order to ensure that the fifth transistor T5 in the q-th shift register unit ASGq can be turned off, the period of time in which the mod((q−3)/4)-th clock signal CLK mod((q−3)/4) is at the high level shall overlap with the period of time in which the mod((q−2)/4)-th clock signal CLK mod((q−2)/4) is at the low level by a length of time no less than the length of time it takes to discharge the first capacitor C1 in the q-th shift register unit ASGq until the voltage at the gate of the fifth transistor T5 therein is below the voltage at which the fifth transistor T5 can be turned on, where a period of time in which the first capacitor C1 in the q-th shift register unit ASGq can be discharged is a period of time denoted in FIG. 6*b* by a dotted ellipse.

In FIG. 6*b*, since the signal received by the forward select signal terminal GN−1 of the first shift register unit ASG1 is the first initial trigger signal STV1 which will be at the high level to thereby trigger the start of scanning only when one frame starts to be scanned and which will be at the low level at other times, the forward select signal terminal GN−1 of the first shift register unit ASG1 will be at the high level only when one frame starts to be scanned and will be at the low level at other times, so the first transistor T1 in the first shift register unit ASG1 can not be turned on so that the first capacitor C1 in the first shift register unit ASG1 can not be discharged through the first transistor T1, so that the fifth transistor T5 in the first shift register unit ASG1 can not be turned off; and the fifth transistor T5 in the first shift register unit ASG1 can have the signal at the gate thereof (i.e., the signal stored on the first capacitor C1) released through the third transistor T3 in the first shift register unit ASG1 to thereby be turned off only when the reset signal terminal RSTIN in the first shift register unit ASG1 receives a high level signal (that is, the reset signal RST is at the high level after the end of scanning a preceding frame and before the start of scanning a next frame); and when the reset signal RST is at the high level, the fourth transistor T4 in the first shift register unit ASG1 is turned on so that the gate line connected with the first shift register unit ASG1 receives a low level signal. Thus the third period of time of the first shift register unit ASG1 will end only when the reset signal terminal RSTIN thereof receives a high level signal (that is, the reset signal RST is changed from the low level signal to the high level signal).

In FIG. 6*b*, since the signal received by the forward select signal terminal GN−1 of the second shift register unit ASG2 is the second initial trigger signal STV2 which will be at the high level to thereby trigger the start of scanning only when one frame starts to be scanned and which will be at the low level at other times, the forward select signal terminal GN−1 of the second shift register unit ASG2 will be at the high level only when one frame starts to be scanned and will be at the low level at other times, so the first transistor T1 in the second shift register unit ASG2 can not be turned on so that the first capacitor C1 in the second shift register unit ASG2 can not be discharged through the first transistor T1, so that the fifth transistor T5 in the second shift register unit ASG2 can not be turned off; and the fifth transistor T5 in the second shift register unit ASG2 can have the signal at the gate thereof (i.e., the signal stored on the first capacitor C1) released through the third transistor T3 in the second shift register unit ASG2 to thereby be turned off only when the reset signal terminal RSTIN in the second shift register unit ASG2 receives a high level signal (that is, the reset signal RST is at the high level after the end of scanning a preceding frame and before the start of scanning a next frame); and when the reset signal RST is at the high level, the fourth transistor T4 in the second shift register unit ASG2 is turned on so that the gate line connected with the second shift register unit ASG2 receives a low level signal. Thus the third period of time of the second shift register unit ASG2 will end only when the reset signal terminal RSTIN thereof receives a high level signal (that is, the reset signal RST is changed from the low level signal to the high level signal).

In FIG. 6*b*, with each of the shift register units, when the reset signal terminal RSTIN thereof receives a high level signal (that is, the reset signal RST is at the high level), the gate of the fifth transistor T5 therein will receive a low level signal so that the fifth transistor T5 will be turned off, and the gate line connected with the each shift register unit will also receive a low level signal to thereby eliminate an influence of a residual signal after the end of scanning the preceding frame upon the succeeding frame.

Particularly the first period of time, the second period of time and the third period of time of the q-th shift register unit ASGq are periods of time in which the gate line connected with the q-th shift register unit ASGq is enabled.

Figure 7:
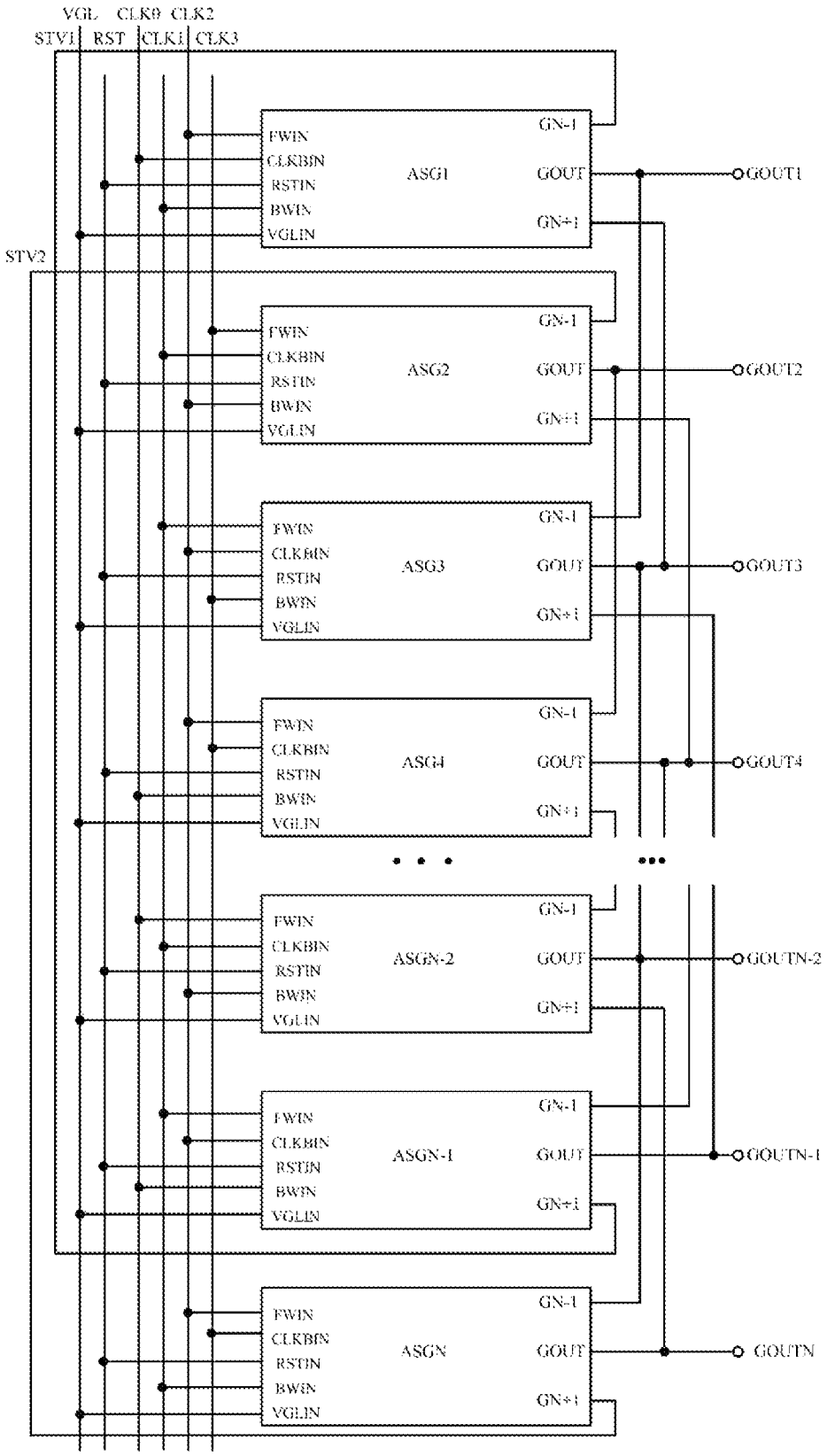
FIG. 7 is a second schematic structural diagram of a gate drive apparatus according to an embodiment of the present invention.

Furthermore respective clocks signals can also be reused as backward scan signals BWs in a gate drive apparatus according to an embodiment of the invention, and the gate drive apparatus can be structured as illustrated in FIG. 7, where the number N of shift register units in the gate drive apparatus illustrated in FIG. 7 is an integer multiple of 4. The gate drive apparatus in FIG. 7 is different from the gate drive apparatus in FIG. 3 in that a transmission line is required to be specially arranged to transmit the backward scan signals received by the respective register units in the gate drive apparatus illustrated in FIG. 3, and the clock signals can be reused as the backward scan signals received by the respective register units in the gate drive apparatus illustrated in FIG. 7. The clock signals can be reused as the backward scan signals received by the respective register units in the gate drive apparatus illustrated in FIG. 7 particularly as follows: the signal received by the backward scan signal terminal BWIN of each of the shift register units other than the last two shift register units is the same as the signal received by the clock block signal terminal CLKBIN of the succeeding shift register unit to the shift register unit, the backward scan signal terminal BWIN of the (N−1)-th shift register unit ASGN−1 receives the 0th clock signal CLK0, and the backward scan signal terminal BWIN of the N-th shift register unit ASGN receives the first clock signal CLK1; and In backward scanning, a period of time in which the first initial trigger signal STV1 is at the high level overlaps with the period of time in which the 0th clock signal CLK0 is at the high level at a time by a length of time no less than a period of time it takes to charge a gate of a transistor of a drive gate line in the (N−1)-th shift register unit ASGN−1 to the voltage at which the transistor can be turned on stably and no more than one cycle of the 0th clock signal CLK0, and a period of time in which the second initial trigger signal STV2 is at the high level overlaps with the period of time in which the first clock signal CLK1 is at the high level at a time by a length of time no less than a period of time it takes to charge a gate of a transistor of a drive gate line in the N-th shift register unit ASGN to the voltage at which the transistor can be turned on stably and no more than one cycle of the first clock signal CLK1.

The number N of shift register units in the gate drive apparatus illustrated in FIG. 7 is an integer multiple of 4, which can ensure scanning from the first shift register unit ASG1 to the N-th shift register unit ASGN in forward scanning as well as scanning from the N-th shift register unit ASGN to the first shift register unit ASG1 in backward scanning to thereby avoid scanning from being started concurrently from the first shift register unit ASG1 and the (N−1)-th shift register unit ASGN−1 and/or scanning from being started concurrently from the second shift register unit ASG2 and the N-th shift register unit ASGN.

The respective shift register units in the gate drive apparatus illustrated in FIG. 7 each can be structured as the shift register unit illustrated in FIG. 5 or can alternatively be embodied as a shift register unit in another structure. The shift register units in the gate drive apparatus will not be limited in structure as long as scanning can be performed with the connection scheme illustrated in FIG. 7.

Figure 8A:
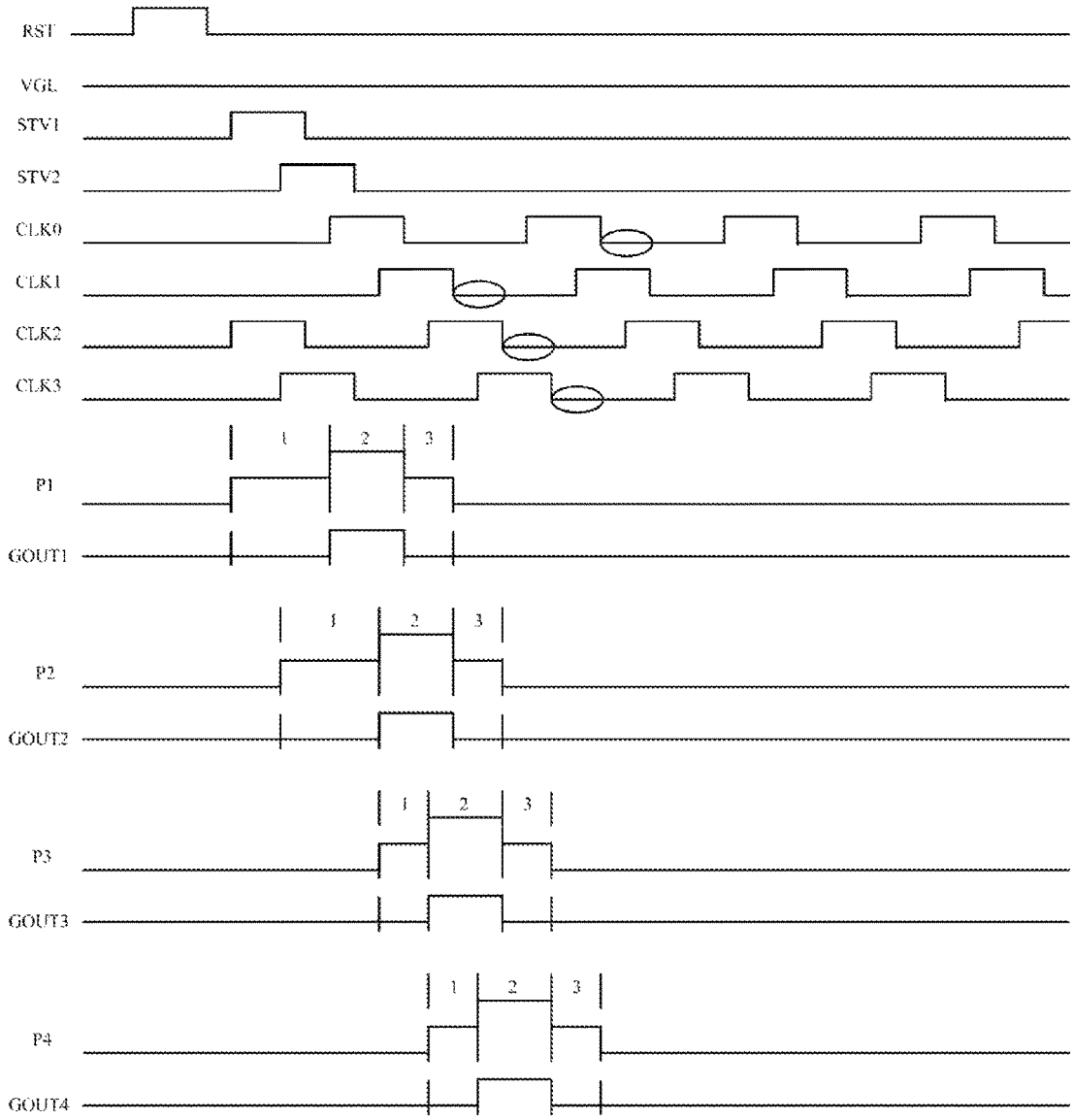
FIG. 8*a* is a timing diagram of the gate drive apparatus illustrated in FIG. 7 in forward scanning.
Figure 8B:
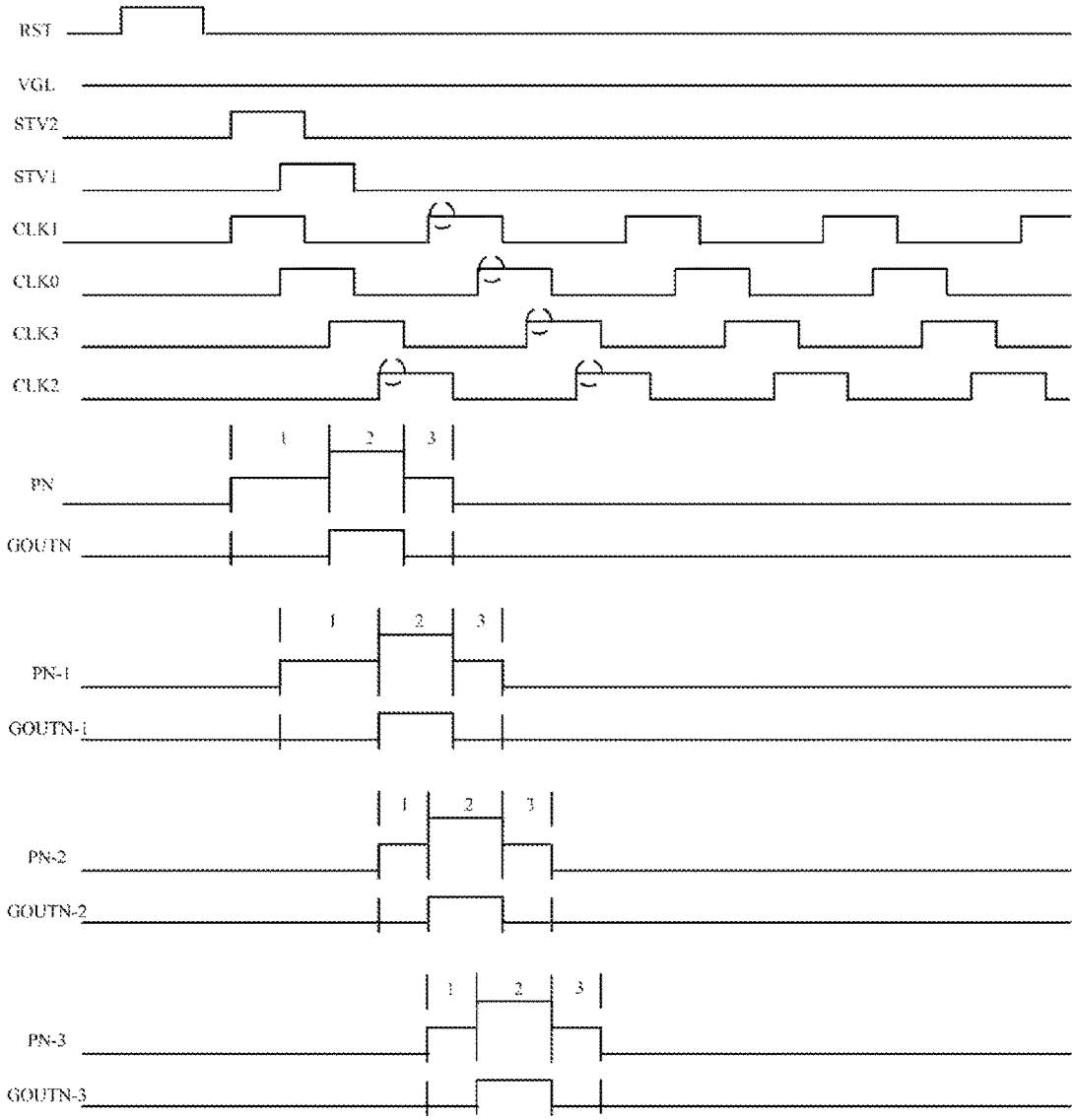
FIG. 8*b* is a timing diagram of the gate drive apparatus illustrated in FIG. 7 in backward scanning.

Operating timings of the gate drive apparatus illustrated in FIG. 7 in forward scanning and backward scanning will be described below by way of an example where the respective shift register units in the gate drive apparatus illustrated in FIG. 7 each are structured as the shift register unit illustrated in FIG. 5. FIG. 8*a* illustrates an operating timing diagram of the gate drive apparatus illustrated in FIG. 7 in forward scanning, and FIG. 8*b* illustrates an operating timing diagram of the gate drive apparatus illustrated in FIG. 7 in backward scanning, where FIG. 8*a* illustrates an operating timing diagram of only the first four shift register units in the gate drive apparatus, and FIG. 8*b* illustrates an operating timing diagram of only the last four shift register units in the gate drive apparatus.

An operating principle of the first shift register unit ASG1 in FIG. 8*a* in a first period of time is the same as the operating principle of the first shift register unit ASG1 in FIG. 6*a* in the first period of time; and an operating principle of the first shift register unit ASG1 in FIG. 8*a* in a second period of time is the same as the operating principle of the first shift register unit ASG1 in FIG. 6*a* in the second period of time.

As illustrated in FIG. 8*a*, in a third period of time of the first shift register unit ASG1, the first initial trigger signal STV1 is at the low level, so the first transistor T1 in the first shift register unit ASG1 is turned off, but due to the storage function of the first capacitor C1 in the first shift register unit ASG1, the fifth transistor T5 in the first shift register unit ASG1 is still turned on, and since the 0th clock signal CLK0 is at the low level in this period of time, the output terminal GOUT1 of the first shift register unit ASG1 outputs a low level signal, when the backward select signal terminal GN+1 of the first shift register unit ASG1 receives a high level signal and the backward scan signal terminal BWIN thereof receives a low level signal, that is, the output terminal GOUT3 of the third shift register unit ASG3 outputs a high level signal (when the second clock signal CLK2 is at the high level, the output terminal GOUT3 of the third shift register unit ASG3 outputs a high level signal) and the first clock signal CLK1 is at the low level, the first capacitor C1 in the first shift register unit ASG1 is discharged, and when it is discharged until the voltage at the gate of the fifth transistor T5 in the first shift register unit ASG1 is below the voltage at which the fifth transistor T5 can be turned on, the fifth transistor T5 in the first shift register unit ASG1 is turned off, and the third period of time of the first shift register unit ASG1 ends, where the first period of time, the second period of time and the third period of time of the first shift register unit ASG1 are periods of time in which the gate line connected with the first shift register unit ASG1 is enabled.

In FIG. 8*a*, since the first capacitor C1 in the first shift register unit ASG1 is discharged when the second clock signal CLK2 is at the high level and the first clock signal CLK1 is at the low level, in order to ensure that the fifth transistor T5 in the first shift register unit ASG1 can be turned off, the period of time in which the second clock signal CLK2 is at the high level overlaps with the period of time in which the first clock signal CLK1 is at the low level by a length of time no less than the length of time it takes to discharge the first capacitor C1 in the first shift register unit ASG1 until the voltage at the gate of the fifth transistor T5 in the first shift register unit ASG1 is below the voltage at which the fifth transistor T5 can be turned on.

An operating principle of the second shift register unit ASG2 in FIG. 8*a* in a first period of time is the same as the operating principle of the second shift register unit ASG2 in FIG. 6*a* in the first period of time; and an operating principle of the second shift register unit ASG2 in FIG. 8*a* in a second period of time is the same as the operating principle of the second shift register unit ASG2 in FIG. 6*a* in the second period of time.

As illustrated in FIG. 8*a*, in a third period of time of the second shift register unit ASG2, the second initial trigger signal STV2 is at the low level, and the first transistor T1 in the second shift register unit ASG2 is turned off, but due to the storage function of the first capacitor C1 in the second shift register unit ASG2, the fifth transistor T5 in the second shift register unit ASG2 is still turned on, and since the first clock signal CLK1 is at the low level in this period of time, the output terminal GOUT2 of the second shift register unit ASG2 outputs a low level signal, when the backward select signal terminal GN+1 of the second shift register unit ASG2 receives a high level signal and the backward scan signal terminal BWIN thereof receives a low level signal, that is, the output terminal GOUT4 of the fourth shift register unit ASG4 outputs a high level signal (when the third clock signal CLK3 is at the high level, the output terminal GOUT4 of the fourth shift register unit ASG4 outputs a high level signal) and the second clock signal CLK2 is at the low level, the first capacitor C1 in the second shift register unit ASG2 is discharged, and when it is discharged until the voltage at the gate of the fifth transistor T5 in the second shift register unit ASG2 is below the voltage at which the fifth transistor T5 can be turned on, the fifth transistor T5 in the second shift register unit ASG2 is turned off, and the third period of time of the second shift register unit ASG2 ends, where the first period of time, the second period of time and the third period of time of the second shift register unit ASG2 are periods of time in which the gate line connected with the second shift register unit ASG2 is enabled.

Since the first capacitor C1 in the second shift register unit ASG2 is discharged when the third clock signal CLK3 is at the high level and the third clock signal CLK2 is at the low level, in order to ensure that the fifth transistor T5 in the second shift register unit ASG2 can be turned off, the period of time in which the third clock signal CLK3 is at the high level overlaps with the period of time in which the second clock signal CLK2 is at the low level by a length of time no less than the length of time it takes to discharge the first capacitor C1 in the second shift register unit ASG2 until the voltage at the gate of the fifth transistor T5 in the second shift register unit ASG2 is below the voltage at which the fifth transistor T5 can be turned on.

An operating principle of the q-th (q=3, 4, . . . , N) shift register unit ASGq in FIG. 8*a* in a first period of time is the same as the operating principle of the q-th shift register unit ASGq in FIG. 6*a* in the first period of time; and an operating principle of the q-th shift register unit ASGq in FIG. 8*a* in a second period of time is the same as the operating principle of the q-th shift register unit ASGq in FIG. 6*a* in the second period of time.

As illustrated in FIG. 8*a*, in a third period of time of the q-th shift register unit ASGq, the mod((q−3)/4)-th clock signal CLK mod((q−3)/4) is at the low level, and the first transistor T1 in the q-th shift register unit ASGq is turned off, but due to the storage function of the first capacitor C1 in the q-th shift register unit ASGq, the fifth transistor T5 in the q-th shift register unit ASGq is still turned on, and since the mod((q−1)/4)-th clock signal CLK mod((q−1)/4) is at the low level in this period of time, the output terminal GOUTq of the q-th shift register unit ASGq outputs a low level signal, and when the backward select signal terminal GN+1 of the q-th shift register unit ASGq receives a high level signal and the backward scan signal terminal BWIN thereof receives a low level signal, that is, the output terminal GOUTq+2 of the (q+2)-th shift register unit ASGq+2 outputs a high level signal (when the mod((q+1)/4)-th clock signal CLK mod((q+1)/4) is at the high level, the output terminal GOUTq+2 of the (q+2)-th shift register unit ASGq+2 outputs a high level signal) and the mod(q/4)-th clock signal CLK mod(q/4) is at the low level, the first capacitor C1 in the q-th shift register unit ASGq is discharged, and when it is discharged until the voltage at the gate of the fifth transistor T5 in the q-th shift register unit ASGq is below the voltage at which the fifth transistor T5 can be turned on, the fifth transistor T5 in the q-th shift register unit ASGq is turned off, and the third period of time of the q-th shift register unit ASGq ends.

An operating principle of the (N−1)-th shift register unit ASGN−1 in FIG. 8*a* in a third period of time is the same as the operating principle of the (N−1)-th shift register unit ASGN−1 in FIG. 6*a* in the third period of time; and an operating principle of the N-th shift register unit ASGN−1 in FIG. 8*a* in a third period of time is the same as the operating principle of the N-th shift register unit ASGN−1 in FIG. 6*a* in the third period of time.

In FIG. 8*a*, with each of the shift register units, when the reset signal terminal RSTIN thereof receives a high level signal (that is, the reset signal RST is at the high level), the gate of the fifth transistor T5 therein will receive a low level signal so that the fifth transistor T5 will be turned off, and the gate line connected with the each shift register unit will also receive a low level signal to thereby eliminate an influence of a residual signal after the end of scanning the preceding frame upon the succeeding frame.

Particularly the first period of time, the second period of time and the third period of time of the q-th shift register unit ASGq are periods of time in which the gate line connected with the q-th shift register unit ASGq is enabled.

Since the first capacitor C1 in the q-th shift register unit ASGq in FIG. 8*a* is discharged when the mod((q+1)/4)-th clock signal CLK mod((q+1)/4) is at the high level and the mod(q/4)-th clock signal CLK mod(q/4) is at the low level, in order to ensure that the fifth transistor T5 in the q-th shift register unit ASGq can be turned off, the period of time in which the mod((q+1)/4)-th clock signal CLK mod((q+1)/4) is at the high level shall overlap with the period of time in which the mod(q/4)-th clock signal CLK mod(q/4) is at the low level by a length of time (a period of time denoted in FIG. 8*a* by a solid ellipse is a period of time in which the first capacitor C1 in the q-th shift register unit ASGq can be discharged) no less than the length of time it takes to discharge the first capacitor C1 in the q-th shift register unit ASGq until the voltage at the gate of the fifth transistor T5 in the q-th shift register unit ASGq is below the voltage at which the fifth transistor T5 can be turned on.

In FIG. 8*b*, in a first period of time of the N-th (N represents an integer multiple of 4) shift register unit ASGN, the second initial trigger signal STV2 received by the backward select signal terminal GN+1 thereof is at the high level, and the second transistor T2 in the N-th shift register unit ASGN is turned on, and in the meantime the backward scan signal BW received by the backward scan signal terminal BWIN thereof, i.e., the first clock signal CLK1, is at the high level, so the first capacitor C1 in the N-th shift register unit ASGN starts to be charged, and when the first capacitor C1 is charged until the transistor of the drive gate line in the N-th shift register unit ASGN, i.e., the fifth transistor T5, can be turned on, the fifth transistor T5 is turned on, and the signal received by the clock block signal terminal CLKBIN of the N-th shift register unit ASGN, i.e., the third clock signal CLK3, will be output from the output terminal GOUTN of the N-th shift register unit ASGN through the fifth transistor T5, and in the first period of time of the N-th shift register unit ASGN, the third clock signal CLK3 is at the low level, so the output terminal GOUTN of the N-th shift register unit ASGN outputs a low level signal; and when the third clock signal CLK3 is changed from the low level to the high level, the N-th shift register unit ASGN proceeds from the first period of time to a second period of time.

In FIG. 8*b*, since the first capacitor C1 in the N-th shift register unit ASGN is charged when the second initial trigger signal STV2 is at the high level and the first clock signal CLK1 is at the high level, in order to ensure that the fifth transistor T5 in the N-th shift register unit ASGN can be turned on stably, the period of time in which the second initial trigger signal STV2 is at the high level overlaps with the period of time in which the first clock signal CLK1 is at the high level by a length of time no less than the length of time it takes to charge the first capacitor C1 in the N-th shift register unit ASGN to the voltage at which the fifth transistor T5 in the N-th shift register unit ASGN can be turned on.

An operating principle of the N-th shift register unit ASGN in FIG. 8*b* in a second period of time is the same as the operating principle of the N-th shift register unit ASGN in FIG. 6*b* in the second period of time; and an operating principle of the N-th shift register unit ASGN in FIG. 8*b* in a third period of time is the same as the operating principle of the N-th shift register unit ASGN in FIG. 6*b* in the third period of time.

In FIG. 8*b*, in a first period of time of the (N−1)-th shift register unit ASGN−1, the first initial trigger signal STV1 received by the backward select signal terminal GN+1 thereof is at the high level, and the second transistor T2 in the (N−1)-th shift register unit ASGN−1 is turned on, and in the meantime the backward scan signal BW received by the backward scan signal terminal BWIN thereof, i.e., the 0th clock signal CLK0, is at the high level, so the first capacitor C1 in the (N−1)-th shift register unit ASGN−1 starts to be charged, and when the first capacitor C1 is charged until the transistor of the drive gate line in the (N−1)-th shift register unit ASGN−1, i.e., the fifth transistor T5, can be turned on, the fifth transistor T5 is turned on, and the signal received by the clock block signal terminal CLKBIN of the (N−1)-th shift register unit ASGN−1, i.e., the second clock signal CLK2, will be output from the output terminal GOUTN−1 of the (N−1)-th shift register unit ASGN−1 through the fifth transistor T5, and in the first period of time of the (N−1)-th shift register unit ASGN−1, the second clock signal CLK2 is at the low level, so the output terminal GOUTN−1 of the (N−1)-th shift register unit ASGN−1 outputs a low level signal; and when the second clock signal CLK2 is changed from the low level to the high level, the (N−1)-th shift register unit ASGN−1 proceeds from the first period of time to a second period of time.

In FIG. 8*b*, since the first capacitor C1 in the (N−1)-th shift register unit ASGN−1 is charged when the first initial trigger signal STV1 is at the high level and the 0th clock signal CLK0 is at the high level, in order to ensure that the fifth transistor T5 in the (N−1)-th shift register unit ASGN−1 can be turned on stably, the period of time in which the first initial trigger signal STV is at the high level overlaps with the period of time in which the 0th clock signal CLK0 is at the high level by a length of time no less than the length of time it takes to charge the first capacitor C1 in the (N−1)-th shift register unit ASGN−1 to the voltage at which the fifth transistor T5 in the (N−1)-th shift register unit ASGN−1 can be turned on stably.

An operating principle of the (N−1)-th shift register unit ASGN−1 in FIG. 8*b* in a second period of time is the same as the operating principle of the (N−1)-th shift register unit ASGN−1 in FIG. 6*b* in the second period of time; and an operating principle of the (N−1)-th shift register unit ASGN−1 in FIG. 8*b* in a third period of time is the same as the operating principle of the (N−1)-th shift register unit ASGN−1 in FIG. 6*b* in the third period of time.

In FIG. 8*b*, in a first period of time of the q-th (q=1, 2, 3, 4, . . . , N−2) shift register unit ASGq, the output terminal GOUTq+2 of the (q+2)-th shift register unit ASGq+2 received by the backward select signal terminal GN+1 thereof is at the high level (when the mod((q+1)/4)-th clock signal CLK mod((q+1)/4) is at the high level, the output terminal GOUTq+2 of the (q+2)-th shift register unit ASGq+2 outputs a high level signal) and the mod(q/4)-th clock signal CLK mod(q/4) received by the backward scan signal terminal BWIN thereof is at the high level, the first capacitor C1 in the q-th shift register unit ASGq is charged, and when the first capacitor C1 is charged until the transistor of the drive gate line in the q-th shift register unit ASGq, i.e., the fifth transistor T5, can be turned on, the fifth transistor T5 is turned on, and the signal received by the clock block signal terminal CLKBIN of the q-th shift register unit ASGq, i.e., the mod((q−1)/4)-th clock signal CLK mod((q−1)/4), will be output from the output terminal GOUTq of the q-th shift register unit ASGq through the fifth transistor T5, and in the first period of time of the q-th shift register unit ASGq, the mod((q−1)/4)-th clock signal CLK mod((q−1)/4) is at the low level, so the output terminal GOUTq of the q-th shift register unit ASGq outputs a low level signal; and after the mod((q+1)/4)-th clock signal CLK mod((q+1)/4) is changed from the high level to the low level, the first capacitor C1 in the q-th shift register unit ASGq will not be further charged but can only perform the storage function even if the mod(q/4)-th clock signal CLK mod(q/4) is at the high level, and after the mod((q−1)/4)-th clock signal CLK mod((q−1)/4) is changed from the low level to the high level, the first period of time of the q-th shift register unit ASGq ends, and the q-th shift register unit ASGq proceeds to a second period of time.

In FIG. 8*b*, since in the first period of time of the q-th shift register unit ASGq, the first capacitor C1 in the q-th shift register unit ASGq can be charged only when the mod((q+1)/4)-th clock signal CLK mod((q+1)/4) is at the high level and the mod(q/4)-th clock signal CLK mod(q/4) is at the high level, in order to ensure that the fifth transistor T5 in the q-th shift register unit ASGq can be turned on stably, the period of time in which the mod((q+1)/4)-th clock signal CLK mod((q+1)/4) is at the high level shall overlap with the period of time in which the mod(q/4)-th clock signal CLK mod(q/4) is at the high level by a length of time no less than the length of time it takes to charge the first capacitor C1 in the q-th shift register unit ASGq to the voltage at which the fifth transistor T5 therein can be turned on stably; and where a period of time in which the first capacitor C1 in the q-th shift register unit ASGq can be charged is a period of time denoted in FIG. 8*b* by a dotted circle.

An operating principle of the q-th shift register unit ASGq in FIG. 8*b* in a second period of time is the same as the operating principle of the q-th shift register unit ASGq in FIG. 6*b* in the second period of time; and an operating principle of the q-th shift register unit ASGq in FIG. 8*b* in a third period of time is the same as the operating principle of the q-th shift register unit ASGq in FIG. 6*b* in the third period of time.

In FIG. 8*b*, since the signal received by the forward select signal terminal GN−1 of the first shift register unit ASG1 is the first initial trigger signal STV1 which will be at the high level to thereby trigger the start of scanning only when one frame starts to be scanned and which will be at the low level at other times, the forward select signal terminal GN−1 of the first shift register unit ASG1 will be at the high level only when one frame starts to be scanned and will be at the low level at other times, so the first transistor T1 in the first shift register unit ASG1 can not be turned on so that the first capacitor C1 in the first shift register unit ASG1 can not be discharged through the first transistor T1, so that the fifth transistor T5 in the first shift register unit ASG1 can not be turned off; and the fifth transistor T5 in the first shift register unit ASG1 can have the signal at the gate thereof (i.e., the signal stored on the first capacitor C1) released through the third transistor T3 in the first shift register unit ASG1 to thereby be turned off only when the reset signal terminal RSTIN in the first shift register unit ASG1 receives a high level signal (that is, the reset signal RST is at the high level after the end of scanning a preceding frame and before the start of scanning a next frame); and when the reset signal RST is at the high level, the fourth transistor T4 in the first shift register unit ASG1 is turned on so that the gate line connected with the first shift register unit ASG1 receives a low level signal. Thus the third period of time of the first shift register unit ASG1 will end only when the reset signal terminal RSTIN thereof receives a high level signal (that is, the reset signal RST is changed from the low level signal to the high level signal).

In FIG. 8*b*, since the signal received by the forward select signal terminal GN−1 of the second shift register unit ASG2 is the second initial trigger signal STV2 which will be at the high level to thereby trigger the start of scanning only when one frame starts to be scanned and which will be at the low level at other times, the forward select signal terminal GN−1 of the second shift register unit ASG2 will be at the high level only when one frame starts to be scanned and will be at the low level at other times, so the first transistor T1 in the second shift register unit ASG2 can not be turned on so that the first capacitor C1 in the second shift register unit ASG2 can not be discharged through the first transistor T1, so that the fifth transistor T5 in the second shift register unit ASG2 can not be turned off; and the fifth transistor T5 in the second shift register unit ASG2 can have the signal at the gate thereof (i.e., the signal stored on the first capacitor C1) released through the third transistor T3 in the second shift register unit ASG2 to thereby be turned off only when the reset signal terminal RSTIN in the second shift register unit ASG2 receives a high level signal (that is, the reset signal RST is at the high level after the end of scanning a preceding frame and before the start of scanning a next frame); and when the reset signal RST is at the high level, the fourth transistor T4 in the second shift register unit ASG2 is turned on so that the gate line connected with the second shift register unit ASG2 receives a low level signal. Thus the third period of time of the second shift register unit ASG2 will end only when the reset signal terminal RSTIN thereof receives a high level signal (that is, the reset signal RST is changed from the low level signal to the high level signal).

In FIG. 8*b*, with each of the shift register units, when the reset signal terminal RSTIN thereof receives a high level signal (that is, the reset signal RST is at the high level), the gate of the fifth transistor T5 therein will receive a low level signal so that the fifth transistor T5 will be turned off, and the gate line connected with the each shift register unit will also receive a low level signal to thereby eliminate an influence of a residual signal after the end of scanning the preceding frame upon the succeeding frame.

Particularly the first period of time, the second period of time and the third period of time of the q-th shift register unit ASGq are periods of time in which the gate line connected with the q-th shift register unit ASGq is enabled.

Furthermore the same signal can be used as the first initial trigger signal and the second initial trigger signal used by the gate drive apparatus illustrated in FIG. 7, and at this time a structure of the gate drive apparatus is as illustrated in FIG. 6. The structure of the gate drive apparatus illustrated in FIG. 9 is different from the structure of the gate drive apparatus illustrated in FIG. 7 only in that the forward select signal terminal GN−1 in the first shift register unit ASG1 in the gate drive apparatus illustrated in FIG. 7 receives the first initial trigger signal STV1, the forward select signal terminal GN−1 in the second shift register unit ASG2 receives the second initial trigger signal STV2, the backward select signal terminal GN+1 in the (N−1)-th shift register unit ASGN−1 receives the first initial trigger signal STV1, and the backward select signal terminal GN+1 in the N-th shift register unit ASGN receives the second initial trigger signal STV2; and the forward select signal terminal GN−1 in the first shift register unit ASG1, the forward select signal terminal GN−1 in the second shift register unit ASG2, the backward select signal terminal GN+1 in the (N−1)-th shift register unit ASGN−1 and the backward select signal terminal GN+1 in the N-th shift register unit ASGN in the gate drive apparatus illustrated in FIG. 9 each receive the same signal, i.e., an initial trigger signal STV.

Figure 9:
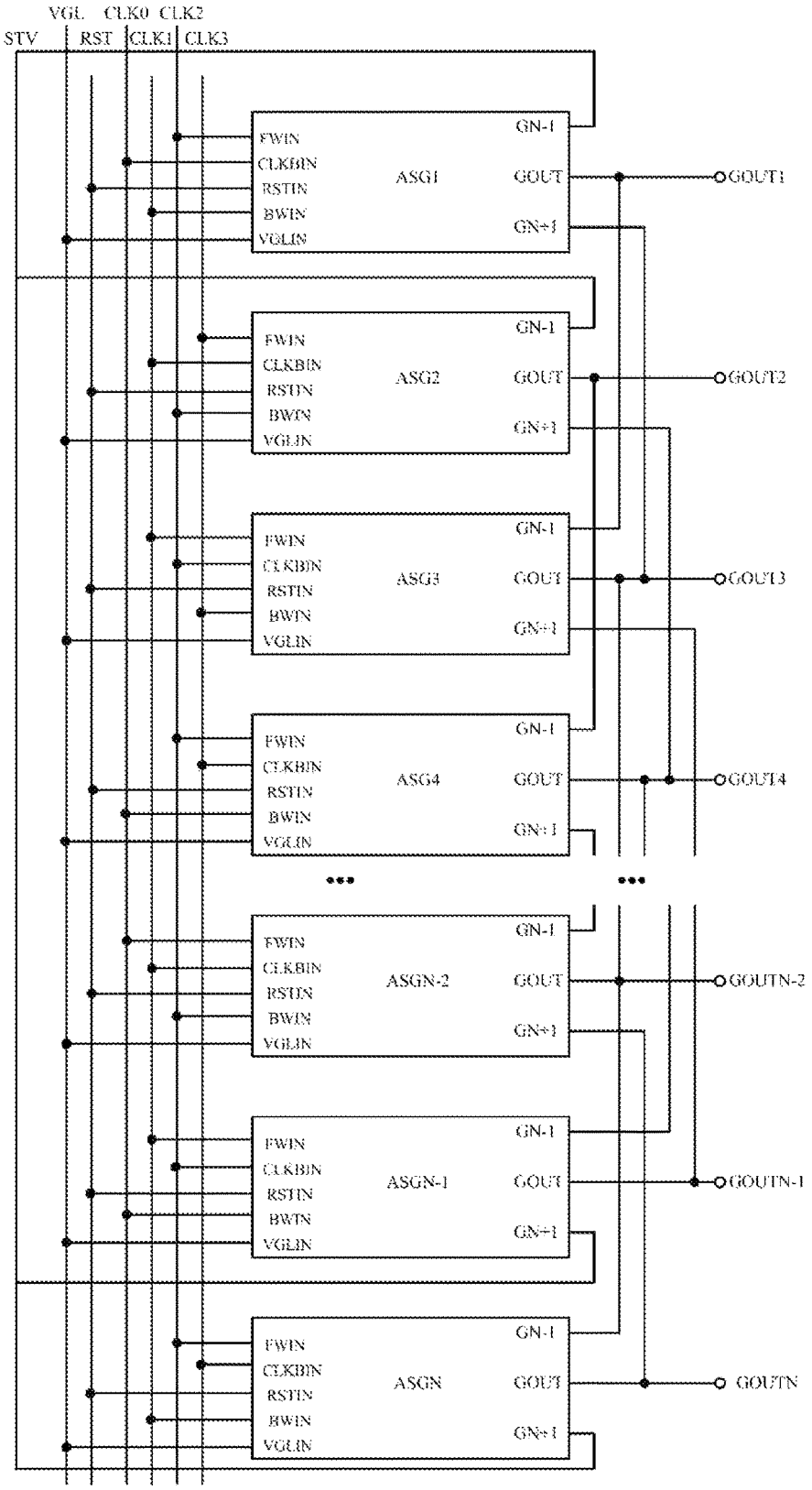
FIG. 9 is a third schematic structural diagram of a gate drive apparatus according to an embodiment of the present invention.

The number N of shift register units in the gate drive apparatus illustrated in FIG. 9 is also an integer multiple of 4, which can ensure scanning from the first shift register unit ASG1 to the N-th shift register unit ASGN in forward scanning as well as scanning from the N-th shift register unit ASGN to the first shift register unit ASG1 in backward scanning to thereby avoid scanning from being started concurrently from the first shift register unit ASG1 and the (N−1)-th shift register unit ASGN−1 and/or scanning from being started concurrently from the second shift register unit ASG2 and the N-th shift register unit ASGN.

The respective shift register units in the gate drive apparatus illustrated in FIG. 9 each can be structured as the shift register unit illustrated in FIG. 5 or can alternatively be embodied as a shift register unit in another structure. The shift register units in the gate drive apparatus will not be limited in structure as long as scanning can be performed with the connection scheme illustrated in FIG. 9.

Figure 10A:
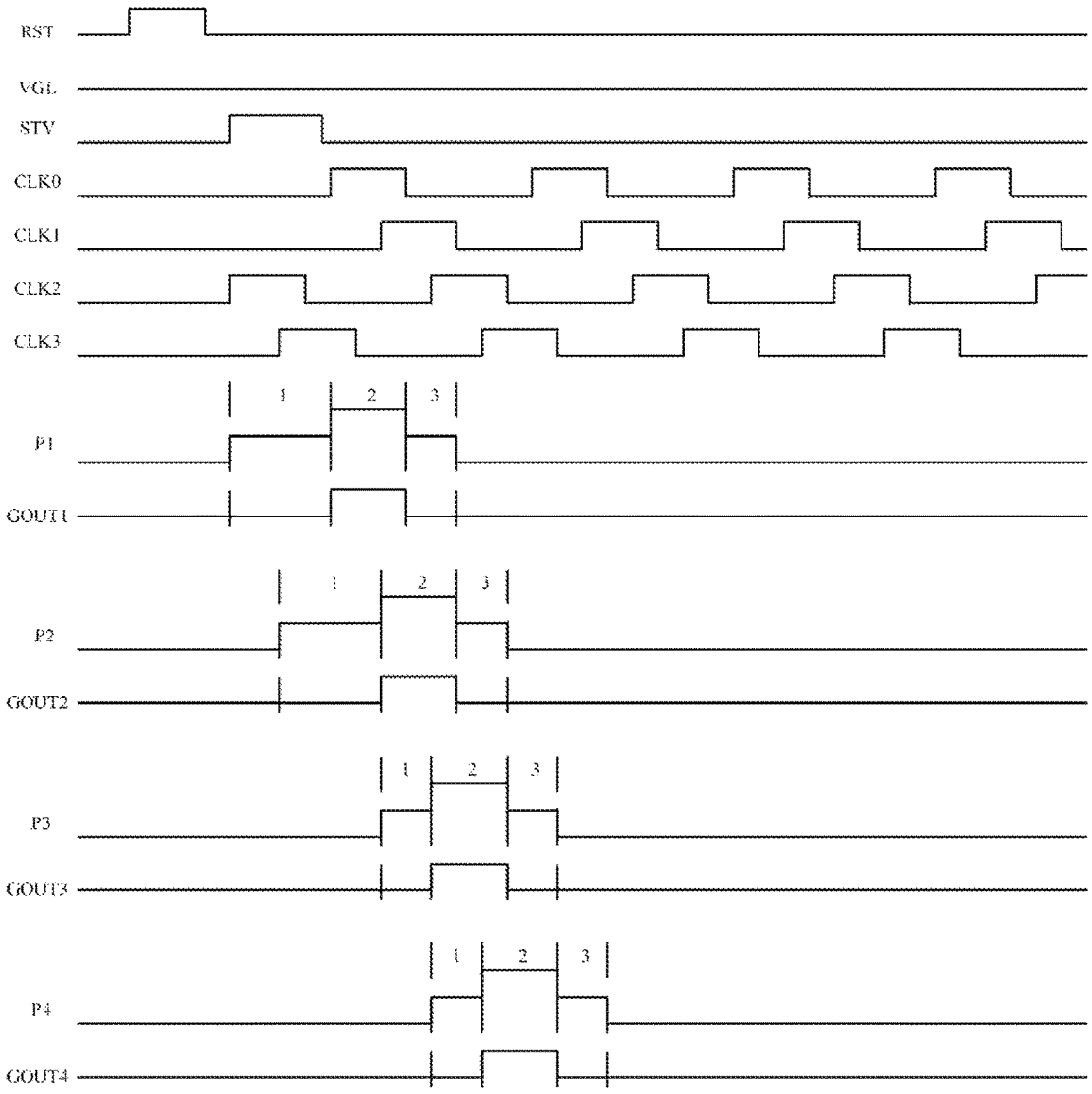
FIG. 10*a* is a timing diagram of the gate drive apparatus illustrated in FIG. 9 in forward scanning.
Figure 10B:
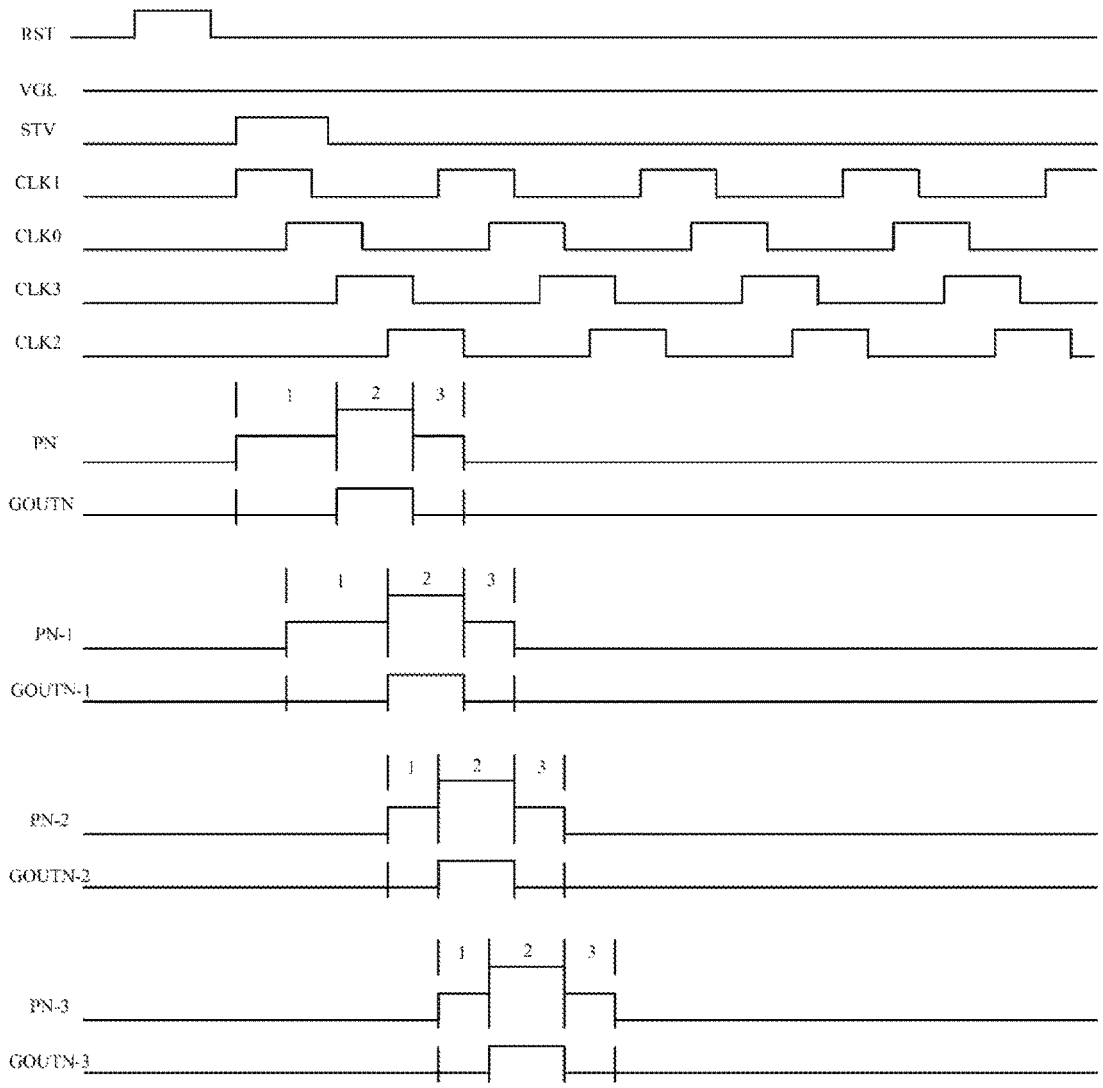
FIG. 10*b* is a timing diagram of the gate drive apparatus illustrated in FIG. 9 in backward scanning.

Operating timings of the gate drive apparatus illustrated in FIG. 9 in forward scanning and backward scanning will be described below by way of an example where the respective shift register units in the gate drive apparatus illustrated in FIG. 9 each are structured as the shift register unit illustrated in FIG. 5. FIG. 10*a* illustrates an operating timing diagram of the gate drive apparatus illustrated in FIG. 9 in forward scanning, and FIG. 10*b* illustrates an operating timing diagram of the gate drive apparatus illustrated in FIG. 9 in backward scanning.

In forward scanning by the gate drive apparatus illustrated in FIG. 9 (i.e., the timing diagram in FIG. 10*a*), an operating principle of the m-th (m=1, 2, . . . , N) shift register unit therein is the same as the operating principle of the m-th shift register unit in the gate drive apparatus illustrated in FIG. 8*a*, so a repeated description thereof will be omitted here. In backward scanning by the gate drive apparatus illustrated in FIG. 9 (i.e., the timing diagram in FIG. 10*b*), an operating principle of the m-th shift register unit therein is the same as the operating principle of the m-th shift register unit in the gate drive apparatus illustrated in FIG. 8*b*, so a repeated description thereof will be omitted here.

Figure 11:
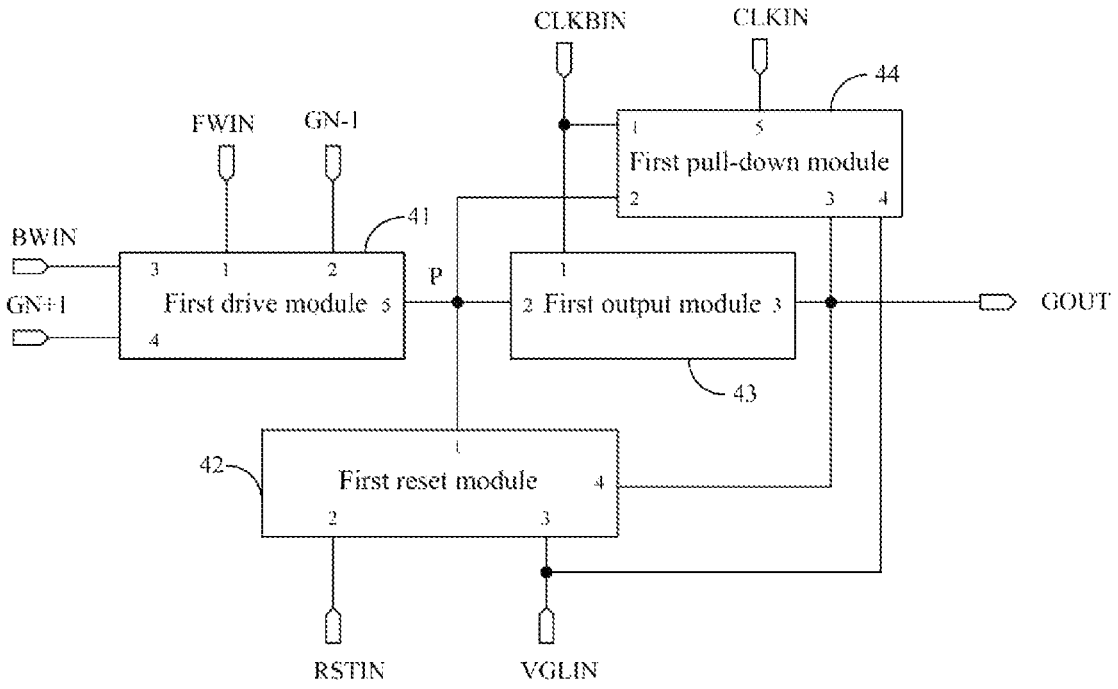
FIG. 11 is a second schematic structural diagram of a shift register unit in a gate drive apparatus according to an embodiment of the present invention.

Furthermore a first pull-down module can be further added to the structure of the shift register unit illustrated in FIG. 4, and the structure of the shift register unit with the first pull-down module added thereto is as illustrated in FIG. 11 where a clock signal terminal is added to each of the shift register units with the first pull-down module added thereto. As illustrated in FIG. 11, a first terminal of the first pull-down module 44 is the clock block signal terminal CLKBIN of each of the shift register units, a second terminal of the first pull-down module 44 is connected with the second terminal of the first output module 42, a third terminal of the first pull-down module 44 is connected with the third terminal of the first output module 42, a fourth terminal of the first pull-down module 44 is the low level signal terminal VGLIN of the shift register unit, and a fifth terminal of the first pull-down module 44 is the clock signal terminal CLKIN of the shift register unit; and the first pull-down module 44 is configured to output a low level signal received by the fourth terminal thereof through the second terminal and the third terminal thereof respectively when the second terminal thereof is at the low level and the clock block signal CLKB is at the high level, and to output the low level signal VGL received by the fourth terminal thereof through the third terminal thereof when the clock signal terminal CLKIN is at the high level.

When the respective shift register units in the gate drive apparatus each are structured as the shift register unit illustrated in FIG. 11, the clock signal terminal of the k-th (k=1, 2, . . . , N) shift register unit in the gate drive apparatus receives the mod((mod((k−1)/4)+2)/4)-th clock signal.

Figure 12:
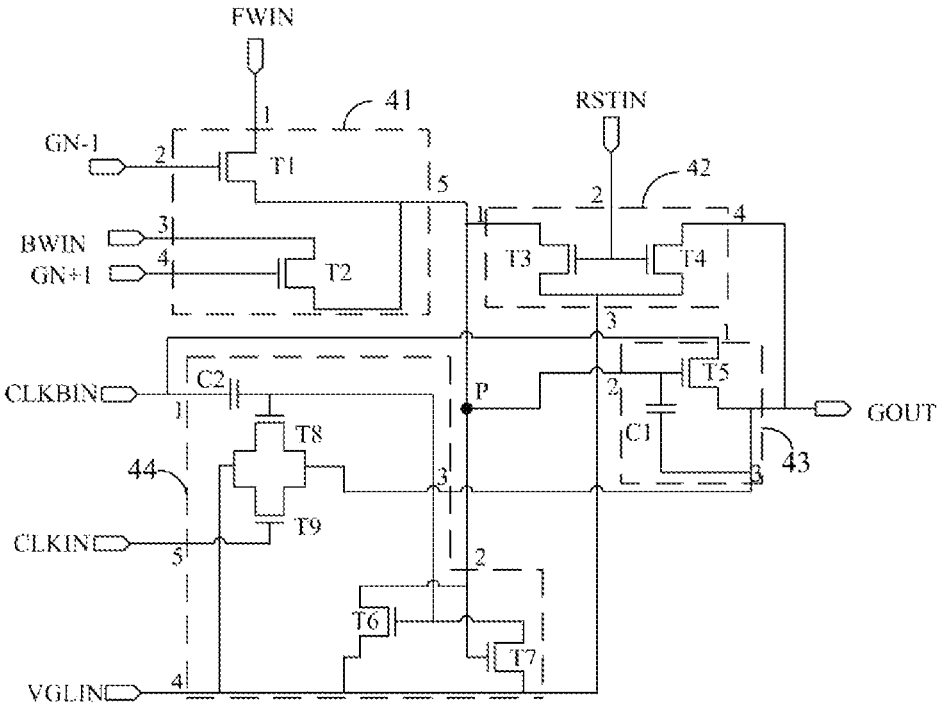
FIG. 12 is a second circuit diagram of a shift register unit in a gate drive apparatus according to an embodiment of the present invention.

Furthermore the shift register unit illustrated in FIG. 11 can be structured as a circuit structure illustrated in FIG. 12. As illustrated in FIG. 12, the first pull-down module 44 includes a second capacitor C2, a sixth transistor T6, a seventh transistor T7, an eighth transistor T8 and a ninth transistor T9; a first S/D of the sixth transistor T6 is the second terminal of the first pull-down module 44, a gate of the sixth transistor T6 is connected with the second capacitor C2, a second S/D of the sixth transistor T6 is the fourth terminal of the first pull-down module 44, and one terminal of the second capacitor C2 unconnected with the gate of the sixth transistor T6 is the first terminal of the first pull-down module 44; a first S/D of the seventh transistor T7 is connected with the gate of the sixth transistor T6, a gate of the seventh transistor T7 is the second terminal of the first pull-down module 44, and a second S/D of the seventh transistor T7 is the fourth terminal of the first pull-down module 44; a first S/D of the eighth transistor T8 is the third terminal of the first pull-down module 44, a gate of the eighth transistor T8 is connected with the gate of the sixth transistor T6, and a second S/D of the eighth transistor T8 is the fourth terminal of the first pull-down module 44; a first S/D of the ninth transistor T9 is the third terminal of the first pull-down module 44, a gate of the ninth transistor T9 is the fifth terminal of the first pull-down module 44, and a second S/D of the ninth transistor T9 is the fourth terminal of the first pull-down module 44; the sixth transistor T6 is configured to be turned on to pull the second terminal of the first pull-down module 44, i.e., the pull-up node P, down to the low level when the gate thereof is at the high level and to be turned off when the gate thereof is at the low level; the seventh transistor T7 is configured to be turned on to pull the level at the gate of the sixth transistor T6 down to the low level when the second terminal of the first pull-down module 44, i.e., the pull-up node P, is at the high level and to be turned off when the second terminal of the first pull-down module 44 is at the low level; the eighth transistor T8 is configured to be turned on to pull the output terminal GOUT of the shift register unit down to the low level when the gate thereof is at the high level and to be turned off when the gate thereof is at the low level; and the ninth transistor T9 is configured to be turned on to pull the output terminal GOUT of the shift register unit down to the low level when the clock signal terminal CLKIN is at the high level and to be turned off when the clock signal terminal CLKIN is at the low level.

Particularly the gate of the sixth transistor T6 and the gate of the eighth transistor T8 can be at the high level only when the pull-up node P is at the low level and the clock block terminal CLKBIN is at the high level.

The circuit in FIG. 12 other than the first pull-down module 44 is structurally the same as the circuit in FIG. 5, so a repeated description thereof will be omitted here.

In forward scanning, if the respective shift register units in the gate drive apparatus each include the first pull-down module, then a low level signal over the gate lines connected with the respective shift register units in the gate drive apparatus other than the last two shift register units will not be influenced by a clock signal at the high level in the period of time in which the gate lines thereof are disabled. In backward scanning, if the respective shift register units in the gate drive apparatus each include the first pull-down module, then a low level signal over the gate lines connected with the respective shift register units in the gate drive apparatus other than the first shift register unit and the second shift register unit will not be influenced by a clock signal at the high level in the period of time in which the gate lines thereof are disabled.

When the respective shift register units in the gate drive apparatus illustrated in FIG. 3 are structured as illustrated in FIG. 12, their timing diagrams in forward scanning are still as illustrated in FIG. 6*a*, and their timing diagrams in backward scanning are still as illustrated in FIG. 6*b*. When the respective shift register units in the gate drive apparatus illustrated in FIG. 7 are structured as illustrated in FIG. 12, their timing diagrams in forward scanning are still as illustrated in FIG. 8*a*, and their timing diagrams in backward scanning are still as illustrated in FIG. 8*b*. When the respective shift register units in the gate drive apparatus illustrated in FIG. 9 are structured as illustrated in FIG. 12, their timing diagrams in forward scanning are still as illustrated in FIG. 10*a*, and their timing diagrams in backward scanning are still as illustrated in FIG. 10*b*.

Figure 13:
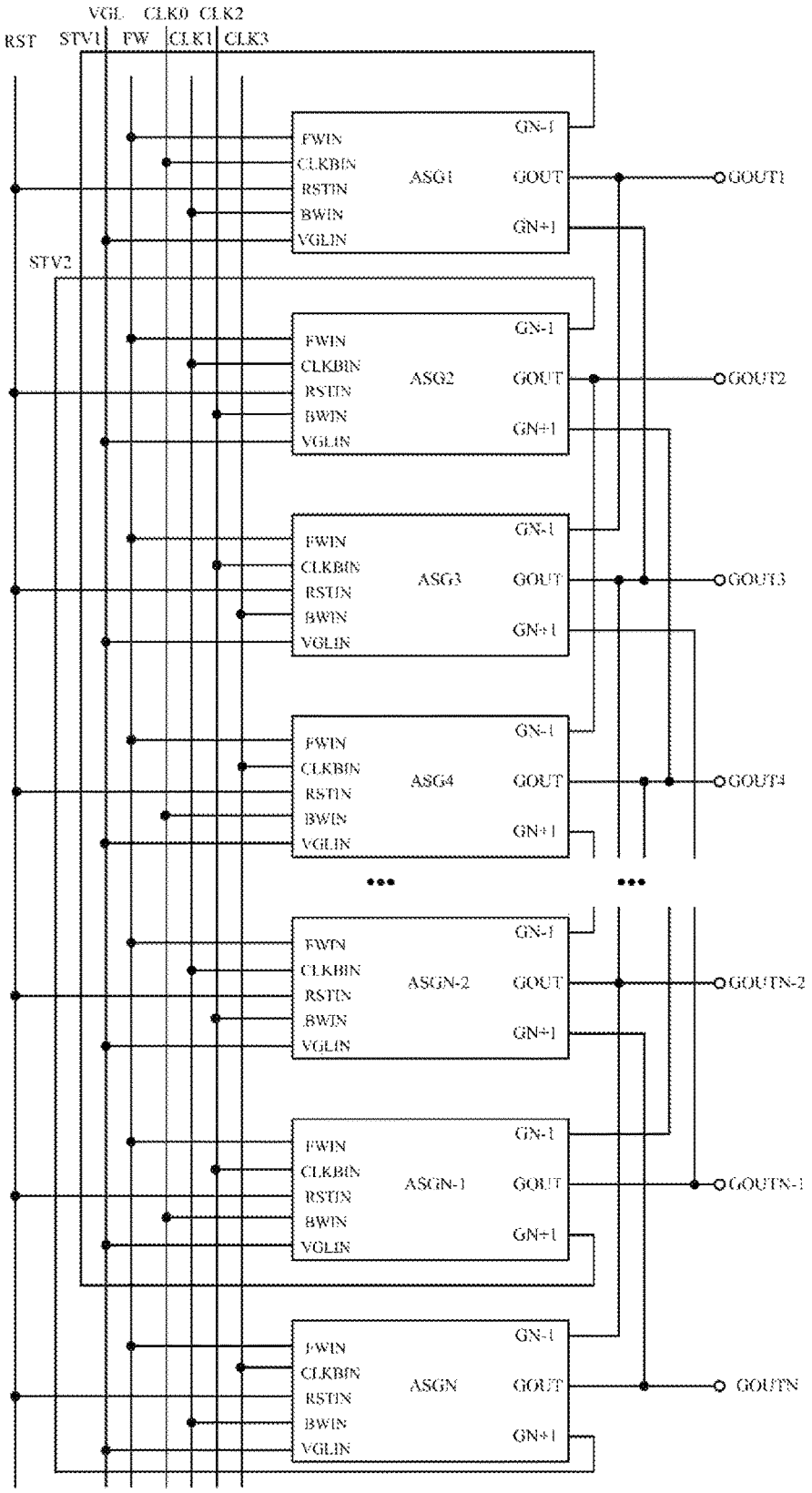
FIG. 13 is a fourth schematic structural diagram of a gate drive apparatus according to an embodiment of the present invention.

An embodiment of the invention provides a gate drive apparatus as illustrated in FIG. 13 including N shift register units, where:

A forward select signal terminal GN−1 of the p-th shift register unit ASGp receives a signal output by the (p−2)-th shift register unit ASGp−2, where p=3, 4, . . . , N, and a backward select signal terminal GN+1 of the r-th shift register unit ASGr receives a signal output by the (r+2)-th shift register unit ASGr+2, where r=1, 2, . . . , N−2; a forward select signal terminal GN−1 of the first shift register unit ASG1 receives a first initial trigger signal STV1, and a forward select signal terminal GN−1 of the second shift register unit ASG2 receives a second initial trigger signal STV2; and if N represents an even number, then a backward select signal terminal GN+1 of the (N−1)-th shift register unit ASGN−1 receives the first initial trigger signal STV1, and a backward select signal terminal GN+1 of the N-th shift register unit ASGN receives the second initial trigger signal STV2; and if N represents an odd number, then the backward select signal terminal GN+1 of the N-th shift register unit ASGN receives the first initial trigger signal STV1, and the backward select signal terminal GN+1 of the (N−1)-th shift register unit ASGN−1 receives the second initial trigger signal STV2; a low level signal terminal VGLIN of each of the shift register units receives a low level signal terminal; and a reset signal terminal RSTIN of each of the shift register units receives a reset signal RST which is at a high level after the end of scanning a preceding frame and before the start of scanning a current frame and at a low level in scanning the current frame;

A clock block signal terminal CLKBIN of the k-th shift register unit ASGk receives a mod((k−1)/4)-th clock signal CLK mod((k−1)/4), where k=1, 2, . . . , N; a signal received by a backward scan signal terminal BWIN of each of the shift register units other than the last two shift register units is the same as the signal received by the clock block signal terminal CLKBIN of the succeeding shift register unit to the shift register unit, a backward scan signal terminal BWIN of the (N−1)-th shift register unit ASGN−1 receives a mod ((mod((N−2)/4)+2)/4)-th clock signal CLK mod((mod((N−2)/4)+2)/4), and a backward scan signal terminal BWIN of the N-th shift register unit ASGN receives a mod((mod((N−1)/4)+2)/4)-th clock signal CLK mod((mod((N−1)/4)+2)/4); when the 0th clock signal is at the high level, the second clock signal CLK2 is at the low level, and when the second clock signal CLK2 is at the high level, the 0th clock signal CLK0 is at the low level; when the first clock signal CLK1 is at the high level, the third clock signal CLK3 is at the low level, and when the third clock signal CLK3 is at the high level, the first clock signal CLK1 is at the low level; and a period of time in which the n-th clock signal CLKn is at the high level overlaps with a period of time in which the (n+1)-th clock signal CLKn+1 is at the high level by a length of time no less than a second preset length of time, where n=0, 1, 2, 3, and when n+1>3, the (n+1)-th clock signal CLKn+1 is a mod((n+1)/4)-th clock signal CLK mod((n+1)/4); and In backward scanning, if N represents an odd number, then a period of time in which the first initial trigger signal STV1 is at the high level overlaps with the period of time in which the mod((mod((N−1)/4)+2)/4)-th clock signal CLK mod((mod((N−1)/4)+2)/4) is at the high level at a time by a length of time no less than a period of time it takes to charge a gate of a transistor of a drive gate line in the N-th shift register unit ASGN to the voltage at which the transistor can be turned on stably and no more than one cycle of the mod((mod((N−1)/4)+2)/4)-th clock signal CLK mod((mod ((N−1)/4)+2)/4), and a period of time in which the second initial trigger signal STV2 is at the high level overlaps with the period of time in which the mod((mod((N−2)/4)+2)/4)-th clock signal CLK mod((mod((N−2)/4)+2)/4) is at the high level at a time by a length of time no less than a period of time it takes to charge a gate of a transistor of a drive gate line in the (N−1)-th shift register unit ASGN−1 to the voltage at which the transistor can be turned on stably and no more than one cycle of the mod((mod((N−2)/4)+2)/4)-th clock signal CLK mod((mod((N−2)/4)+2)/4); and if N represents an even number, then the period of time in which the first initial trigger signal STV1 is at the high level overlaps with the period of time in which the mod((mod((N−2)/4)+2)/4)-th clock signal CLK mod((mod((N−2)/4)+2)/4) is at the high level at a time by a length of time no less than a period of time it takes to charge the gate of the transistor of the drive gate line in the (N−1)-th shift register unit ASGN−1 to the voltage at which the transistor can be turned on stably and no more than one cycle of the mod((mod((N−2)/4)+2)/4)-th clock signal CLK mod((mod((N−2)/4)+2)/4), and the period of time in which the second initial trigger signal STV2 is at the high level overlaps with the period of time in which the mod((mod((N−1)/4)+2)/4)-th clock signal CLK mod((mod((N−1)/4)+2)/4) is at the high level at a time by a length of time no less than a period of time it takes to charge the gate of the transistor of the drive gate line in the N-th shift register unit ASGN to the voltage at which the transistor can be turned on stably and no more than one cycle of the mod((mod((N−1)/4)+2)/4)-th clock signal CLK mod ((mod((N−1)/4)+2)/4).

The respective shift register units in the gate drive apparatus illustrated in FIG. 13 each can be structured as the shift register unit illustrated in FIG. 5 or can be structured as the shift register unit illustrated in FIG. 12. When the respective shift register units in the gate drive apparatus illustrated in FIG. 13 each can be structured as the shift register unit illustrated in FIG. 12, the respective shift register units each further includes a clock signal terminal. No matter whether the respective shift register units in the gate drive apparatus illustrated in FIG. 13 each are structured as the shift register unit illustrated in FIG. 5 or structured as the shift register unit illustrated in FIG. 12, all of their timing diagrams in forward scanning are the same, and all of their timing diagrams in backward scanning are also the same.

Figure 14A:
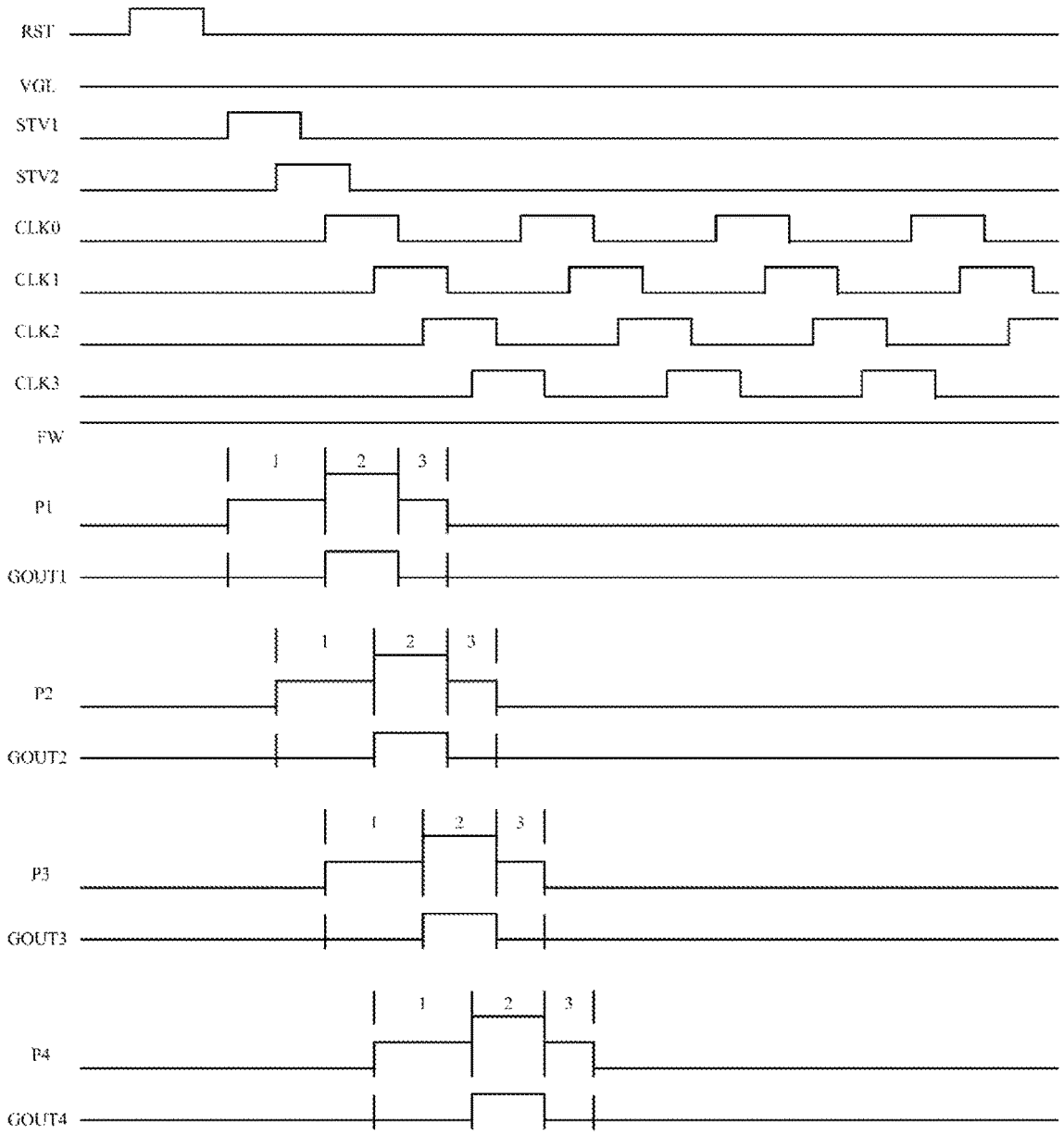
FIG. 14*a* is a timing diagram of the gate drive apparatus illustrated in FIG. 13 in forward scanning.
Figure 14B:
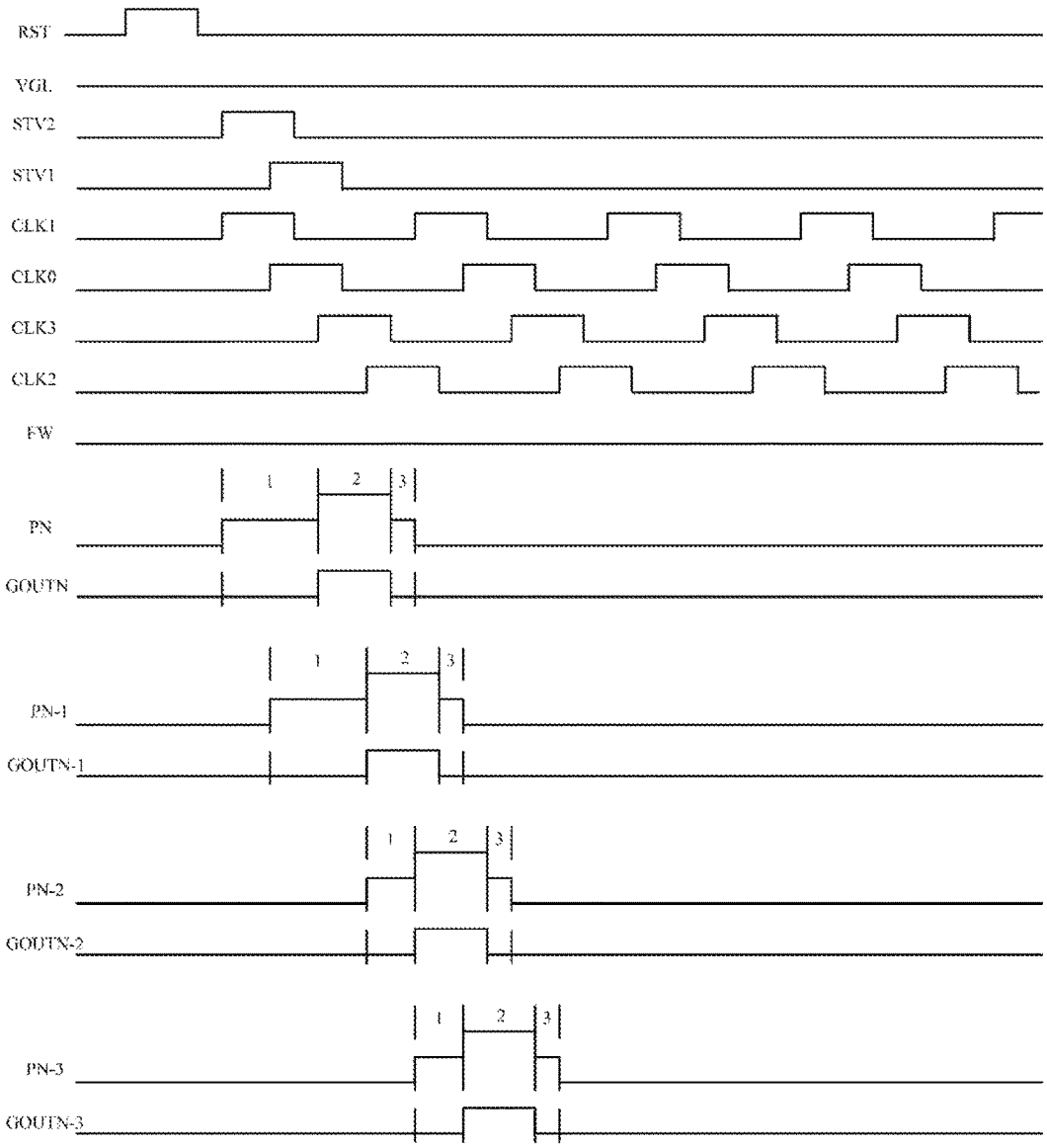
FIG. 14*b* is a timing diagram of the gate drive apparatus illustrated in FIG. 13 in backward scanning.

Operating conditions of the gate drive apparatus illustrated in FIG. 13 in forward scanning and backward scanning will be described below by way of an example where the respective shift register units in the gate drive apparatus illustrated in FIG. 13 each are structured as the shift register unit illustrated in FIG. 5. An operating timing diagram of the gate drive apparatus illustrated in FIG. 13 in forward scanning is as illustrated in FIG. 14*a*, where FIG. 14*a* illustrates an operating timing diagram of only the first four shift register units in the gate shift register units in the gate drive apparatus, and FIG. 14*b* illustrates an operating timing diagram of only the last four shift register units in the gate shift register units in the gate drive apparatus. An operating timing diagram of the gate drive apparatus illustrated in FIG. 13 in backward scanning is as illustrated in FIG. 14*b*. N shift register units are assumed included in the gate drive apparatus illustrated in FIG. 13, and an operating principle of the gate drive apparatus will be described below by way of an example where N represents an integer multiple of 4. An operating principle of the gate drive apparatus with N being an integer other than an integer multiple of 4 will be similar to the operating principle of the gate drive apparatus with N being an integer multiple of 4, so a repeated description thereof will be omitted here.

In FIG. 14*a*, in a first period of time of the first shift register unit ASG1, the first initial trigger signal STV1 received by the forward select signal terminal GN−1 thereof is at the high level, and the first transistor T1 in the first shift register unit ASG1 is turned on, and in the meantime the forward scan signal terminal FW received by the forward scan signal terminal FWIN thereof is at the high level (the forward scan signal terminal FW is at the high level all the time in FIG. 14*a*), so the first capacitor C1 in the first shift register unit ASG1 starts to be charged, and when the first capacitor C1 is charged until the transistor of the drive gate line in the first shift register unit ASG1, i.e., the fifth transistor T5, can be turned on, the fifth transistor T5 is turned on, and the signal received by the clock block signal terminal CLKBIN of the first shift register unit ASG1, i.e., the 0th clock signal CLK0, will be output from the output terminal GOUT1 of the first shift register unit ASG1 through the fifth transistor T5, and in the first period of time of the first shift register unit ASG1, the 0th clock signal CLK0 is at the low level, so the output terminal GOUT1 of the first shift register unit ASG1 outputs a low level signal; and when the 0th clock signal CLK0 is changed from the low level to the high level, the first shift register unit ASG1 proceeds from the first period of time to a second period of time.

An operating principle of the first shift register unit ASG1 in FIG. 14*a* in a second period of time is the same as the operating principle of the first shift register unit ASG1 in FIG. 8*a* in the second period of time; and an operating principle of the first shift register unit ASG1 in FIG. 14*a* in a third period of time is the same as the operating principle of the first shift register unit ASG1 in FIG. 8*a* in the third period of time.

In FIG. 14*a*, in a first period of time of the second shift register unit ASG2, the second initial trigger signal STV2 received by the forward select signal terminal GN−1 thereof is at the high level, and the first transistor T1 in the second shift register unit ASG2 is turned on, and in the meantime the forward scan signal terminal FW received by the forward scan signal terminal FWIN thereof is at the high level (the forward scan signal terminal FW is at the high level all the time in FIG. 14*a*), so the first capacitor C1 in the second shift register unit ASG2 starts to be charged, and when the first capacitor C1 is charged until the transistor of the drive gate line in the second shift register unit ASG2, i.e., the fifth transistor T5, can be turned on, the fifth transistor T5 is turned on, and the signal received by the clock block signal terminal CLKBIN of the second shift register unit ASG2, i.e., the first clock signal CLK1, will be output from the output terminal GOUT2 of the second shift register unit ASG2 through the fifth transistor T5, and in the first period of time of the second shift register unit ASG2, the first clock signal CLK1 is at the low level, so the output terminal GOUT2 of the second shift register unit ASG2 outputs a low level signal; and when the first clock signal CLK1 is changed from the low level to the high level, the second shift register unit ASG2 proceeds from the first period of time to a second period of time.

An operating principle of the second shift register unit ASG2 in FIG. 14*a* in a second period of time is the same as the operating principle of the second shift register unit ASG2 in FIG. 8*a* in the second period of time; and an operating principle of the second shift register unit ASG2 in FIG. 14*a* in a third period of time is the same as the operating principle of the second shift register unit ASG2 in FIG. 8*a* in the third period of time.

In FIG. 14*a*, in a first period of time of the q-th (q=3, 4, . . . , N) shift register unit ASGq, when the output terminal GOUTq−2 of the (q−2)-th shift register unit ASGq−2 received by the forward select signal terminal GN−1 thereof is at the high level (when the mod((q−3)/4)-th clock signal CLK mod((q−3)/4) is at the high level, the output terminal GoutTq−2 of the (q−2)-th shift register unit ASGq−2 outputs a high level signal) and the forward scan signal FW received by the forward scan signal terminal FWIN thereof is at the high level (the forward scan signal FW is at the high level all the time in FIG. 14*a*), the first capacitor C1 in the q-th shift register unit ASGq is charged, and when the first capacitor C1 is charged until the transistor of the drive gate line in the q-th shift register unit ASGq, i.e., the fifth transistor T5, can be turned on, the fifth transistor T5 is turned on, and the signal received by the clock block signal terminal CLKBIN of the q-th shift register unit ASGq, i.e., the mod((q−1)/4)-th clock signal CLK mod((q−1)/4), will be output from the output terminal GOUTq of the q-th shift register unit ASGq through the fifth transistor T5, and in the first period of time of the q-th shift register unit ASGq, the mod((q−1)/4)-th clock signal CLK mod((q−1)/4) is at the low level, so the output terminal GOUTq of the q-th shift register unit ASGq outputs a low level signal.

An operating principle of the q-th (q=3, 4, . . . , N) shift register unit ASGq in FIG. 14*a* in a second period of time is the same as the operating principle of the q-th shift register unit ASGq in FIG. 8*a* in the second period of time; and an operating principle of the q-th shift register unit ASGq in FIG. 14*a* in a third period of time is the same as the operating principle of the q-th shift register unit ASGq in FIG. 8*a* in the third period of time.

In FIG. 14*a*, with each of the shift register units, when the reset signal terminal RSTIN thereof receives a high level signal (that is, the reset signal RST is at the high level), the gate of the fifth transistor T5 therein will receive a low level signal so that the fifth transistor T5 will be turned off, and the gate line connected with the each shift register unit will also receive a low level signal to thereby eliminate an influence of a residual signal after the end of scanning the preceding frame upon the succeeding frame.

Particularly the first period of time, the second period of time and the third period of time of the q-th shift register unit ASGq are periods of time in which the gate line connected with the q-th shift register unit ASGq is enabled.

An operating principle of the N-th (N represents an integer multiple of 4) shift register unit ASGN in FIG. 14*b* in a first operating period is the same as the operating principle of the N-th shift register unit ASGN in FIG. 8*b* in the first operating period; and an operating principle of the N-th shift register unit ASGN in FIG. 14*b* in a second operating period is the same as the operating principle of the N-th shift register unit ASGN in FIG. 8*b* in the second operating period.

In FIG. 14*b*, in the third period of time of the N-th shift register unit ASGN, the second initial trigger signal STV2 is at the low level, so the second transistor T2 in the N-th shift register unit ASGN is turned off, but due to the storage function of the first capacitor C1 in the N-th shift register unit ASGN, the fifth transistor T5 in the N-th shift register unit ASGN is still turned on, and since the third clock signal CLK3 is at the low level in this period of time, the output terminal GOUTN of the N-th shift register unit ASGN outputs a low level signal, when the forward select signal terminal GN−1 of the N-th shift register unit ASGN receives a high level signal and the forward scan signal terminal FWIN terminal thereof receives a low level signal, that is, the output terminal GOUTN−2 of the (N−2)-th shift register unit ASGN−2 outputs a high level signal (when the first clock signal CLK1 is at the high level, the output terminal GOUTN−2 of the (N−2)-th shift register unit ASGN−2 outputs a high level signal) and the forward select signal FW is at the low level (the forward select signal FW is at the low level all the time in FIG. 14*b*), the first capacitor C1 in the N-th shift register unit ASGN is discharged, and when it is discharged until the voltage at the gate of the fifth transistor T5 in the N-th shift register unit ASGN is below the voltage at which the fifth transistor T5 can be turned on, the fifth transistor T5 in the N-th shift register unit ASGN is turned off, and the third period of time of the N-th shift register unit ASGN ends, where the first period of time, the second period of time and the third period of time of the N-th shift register unit ASGN are periods of time in which the gate line connected with the N-th shift register unit ASGN is enabled.

An operating principle of the (N−1)-th (N represents an integer multiple of 4) shift register unit ASGN−1 in FIG. 14*b* in a first operating period is the same as the operating principle of the (N−1)-th shift register unit ASGN−1 in FIG. 8*b* in the first operating period; and an operating principle of the (N−1)-th shift register unit ASGN−1 in FIG. 14*b* in a second operating period is the same as the operating principle of the (N−1)-th shift register unit ASGN−1 in FIG. 8*b* in the second operating period.

In FIG. 14*b*, in a third period of time of the (N−1)-th shift register unit ASGN−1, the first initial trigger signal STV1 is at the low level, so the second transistor T2 in the (N−1)-th shift register unit ASGN−1 is turned off, but due to the storage function of the first capacitor C1 in the (N−1)-th shift register unit ASGN−1, the fifth transistor T5 in the (N−1)-th shift register unit ASGN−1 is still turned on, and since the second clock signal CLK2 is at the low level in this period of time, the output terminal GOUTN−1 of the (N−1)-th shift register unit ASGN−1 outputs a low level signal, when the forward select signal terminal GN−1 of the (N−1)-th shift register unit ASGN−1 receives a high level signal and the forward scan signal terminal FWIN thereof receives a low level signal, that is, the output terminal GOUTN−3 of the (N−3)-th shift register unit ASGN−3 outputs a high level signal (when the 0th clock signal CLK0 is at the high level, the output terminal GOUTN−3 of the (N−3)-th shift register unit ASGN−3 outputs a high level signal) and the forward select signal FW is at the low level (the forward select signal FW is at the low level all the time in FIG. 14*b*), the first capacitor C1 in the (N−1)-th shift register unit ASGN−1 is discharged, and when it is discharged until the voltage at the gate of the fifth transistor T5 in the (N−1)-th shift register unit ASGN−1 is below the voltage at which the fifth transistor T5 can be turned on, the fifth transistor T5 in the (N−1)-th shift register unit ASGN−1 is turned off, and the third period of time of the (N−1)-th shift register unit ASGN−1 ends, where the first period of time, the second period of time and the third period of time of the (N−1)-th shift register unit ASGN−1 are periods of time in which the gate line connected with the (N−1)-th shift register unit ASGN−1 is enabled.

An operating principle of the q-th (q=1, 2, 3, 4, . . . , N−2, where N represents an integer multiple) shift register unit ASGq in FIG. 14*b* in a first operating period is the same as the operating principle of the q-th shift register unit ASGq in FIG. 8*b* in the first operating period; and an operating principle of the q-th shift register unit ASGq in FIG. 14*b* in a second operating period is the same as the operating principle of the q-th shift register unit ASGq in FIG. 8*b* in the second operating period.

In FIG. 14*b*, in a third period of time of the q-th shift register unit ASGq, the mod((q+1)/4)-th clock signal CLK mod((q+1)/4) is at the low level, and the second transistor T2 in the q-th shift register unit ASGq is turned off, but due to the storage function of the first capacitor C1 in the q-th shift register unit ASGq, the fifth transistor T5 in the q-th shift register unit ASGq is still turned on, and since the mod((q−1)/4)-th clock signal CLK mod((q−1)/4) is at the low level in this period of time, the output terminal GOUTq of the q-th shift register unit ASGq outputs a low level signal, and when the forward select signal terminal GN−1 of the q-th shift register unit ASGq receives a high level signal and the forward scan signal terminal FWIN thereof receives a low level signal, that is, the output terminal GOUTq−2 of the (q−2)-th shift register unit ASGq−2 outputs a high level signal (when the mod((q−3)/4)-th clock signal CLK mod ((q−3)/4) is at the high level, the output terminal GOUTq−2 of the (q−2)-th shift register unit ASGq−2 outputs a high level signal) and the forward select signal FW is at the low level (the forward select signal FW is at the low level at the time in FIG. 14*b*), the first capacitor C1 in the q-th shift register unit ASGq is discharged, and when it is discharged until the voltage at the gate of the fifth transistor T5 in the q-th shift register unit ASGq is below the voltage at which the fifth transistor T5 can be turned on, the fifth transistor T5 in the q-th shift register unit ASGq is turned off, and the third period of time of the q-th shift register unit ASGq ends.

In FIG. 14*b*, since the signal received by the forward select signal terminal GN−1 of the first shift register unit ASG1 is the first initial trigger signal STV1 which will be at the high level to thereby trigger the start of scanning only when one frame starts to be scanned and which will be at the low level at other times, the forward select signal terminal GN−1 of the first shift register unit ASG1 will be at the high level only when one frame starts to be scanned and will be at the low level at other times, so the first transistor T1 in the first shift register unit ASG1 can not be turned on so that the first capacitor C1 in the first shift register unit ASG1 can not be discharged through the first transistor T1, so that the fifth transistor T5 in the first shift register unit ASG1 can not be turned off; and the fifth transistor T5 in the first shift register unit ASG1 can have the signal at the gate thereof (i.e., the signal stored on the first capacitor C1) released through the third transistor T3 in the first shift register unit ASG1 to thereby be turned off only when the reset signal terminal RSTIN in the first shift register unit ASG1 receives a high level signal (that is, the reset signal RST is at the high level after the end of scanning a preceding frame and before the start of scanning a next frame); and when the reset signal RST is at the high level, the fourth transistor T4 in the first shift register unit ASG1 is turned on so that the gate line connected with the first shift register unit ASG1 receives a low level signal. Thus the third period of time of the first shift register unit ASG1 will end only when the reset signal terminal RSTIN thereof receives a high level signal (that is, the reset signal RST is changed from the low level signal to the high level signal).

In FIG. 14*b*, since the signal received by the forward select signal terminal GN−1 of the second shift register unit ASG2 is the second initial trigger signal STV2 which will be at the high level to thereby trigger the start of scanning only when one frame starts to be scanned and which will be at the low level at other times, the forward select signal terminal GN−1 of the second shift register unit ASG2 will be at the high level only when one frame starts to be scanned and will be at the low level at other times, so the first transistor T1 in the second shift register unit ASG2 can not be turned on so that the first capacitor C1 in the second shift register unit ASG2 can not be discharged through the first transistor T1, so that the fifth transistor T5 in the second shift register unit ASG2 can not be turned off; and the fifth transistor T5 in the second shift register unit ASG2 can have the signal at the gate thereof (i.e., the signal stored on the first capacitor C1) released through the third transistor T3 in the second shift register unit ASG2 to thereby be turned off only when the reset signal terminal RSTIN in the second shift register unit ASG2 receives a high level signal (that is, the reset signal RST is at the high level after the end of scanning a preceding frame and before the start of scanning a next frame); and when the reset signal RST is at the high level, the fourth transistor T4 in the second shift register unit ASG2 is turned on so that the gate line connected with the second shift register unit ASG2 receives a low level signal. Thus the third period of time of the second shift register unit ASG2 will end only when the reset signal terminal RSTIN thereof receives a high level signal (that is, the reset signal RST is changed from the low level signal to the high level signal).

In FIG. 14*b*, with each of the shift register units, when the reset signal terminal RSTIN thereof receives a high level signal (that is, the reset signal RST is at the high level), the gate of the fifth transistor T5 therein will receive a low level signal so that the fifth transistor T5 will be turned off, and the gate line connected with the each shift register unit will also receive a low level signal to thereby eliminate an influence of a residual signal after the end of scanning the preceding frame upon the succeeding frame.

Particularly the first period of time, the second period of time and the third period of time of the q-th shift register unit ASGq are periods of time in which the gate line connected with the q-th shift register unit ASGq is enabled.

Figure 15:
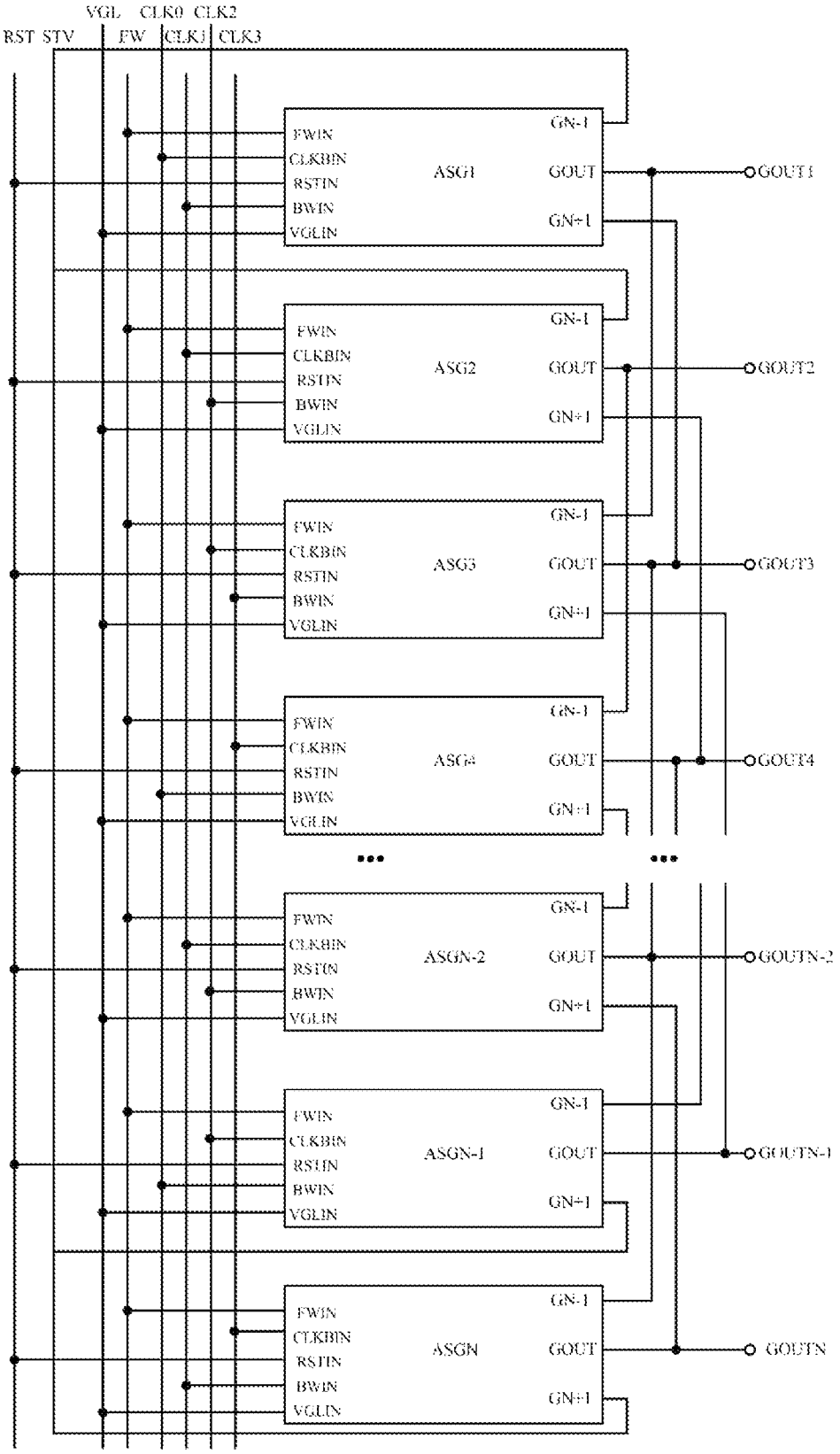
FIG. 15 is a fifth schematic structural diagram of a gate drive apparatus according to an embodiment of the present invention.

Furthermore the same signal can be used as the first initial trigger signal and the second initial trigger signal used by the gate drive apparatus illustrated in FIG. 13, and at this time a structure of the gate drive apparatus is as illustrated in FIG. 15. The structure of the gate drive apparatus illustrated in FIG. 15 is different from the structure of the gate drive apparatus illustrated in FIG. 13 only in that the forward select signal terminal GN−1 in the first shift register unit ASG1 in the gate drive apparatus illustrated in FIG. 13 receives the first initial trigger signal STV1, the forward select signal terminal GN−1 in the second shift register unit ASG2 receives the second initial trigger signal STV2, the backward select signal terminal GN+1 in the (N−1)-th shift register unit ASGN−1 receives the first initial trigger signal STV1, and the backward select signal terminal GN+1 in the N-th shift register unit ASGN receives the second initial trigger signal STV2; and the forward select signal terminal GN−1 in the first shift register unit ASG1, the forward select signal terminal GN−1 in the second shift register unit ASG2, the backward select signal terminal GN+1 in the (N−1)-th shift register unit ASGN−1 and the backward select signal terminal GN+1 in the N-th shift register unit ASGN in the gate drive apparatus illustrated in FIG. 15 each receive the same signal, i.e., an initial trigger signal STV.

The number N of shift register units in the gate drive apparatus illustrated in FIG. 15 is also an integer multiple of 4, which can ensure scanning from the first shift register unit ASG1 to the N-th shift register unit ASGN in forward scanning as well as scanning from the N-th shift register unit ASGN to the first shift register unit ASG1 in backward scanning to thereby avoid scanning from being started concurrently from the first shift register unit ASG1 and the (N−1)-th shift register unit ASGN−1 and/or scanning from being started concurrently from the second shift register unit ASG2 and the N-th shift register unit ASGN.

The respective shift register units in the gate drive apparatus illustrated in FIG. 15 each can be structured as the shift register unit illustrated in FIG. 5 or can be structured as the shift register unit illustrated in FIG. 12 or can alternatively be embodied as a shift register unit in another structure. The shift register units in the gate drive apparatus will not be limited in structure as long as scanning can be performed with the connection scheme illustrated in FIG. 15.

Figure 16A:
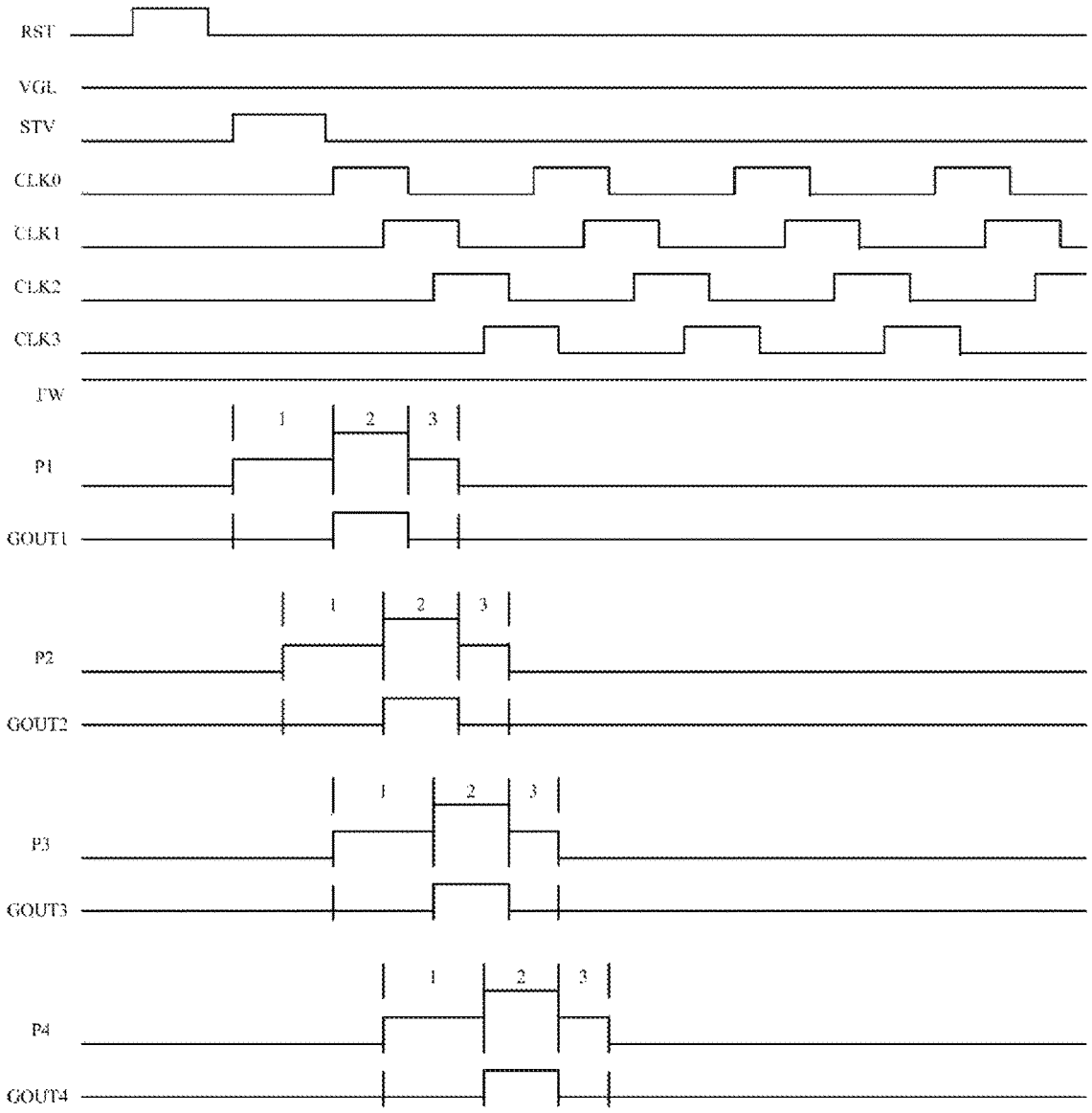
FIG. 16*a* is a timing diagram of the gate drive apparatus illustrated in FIG. 13 in forward scanning.
Figure 16B:
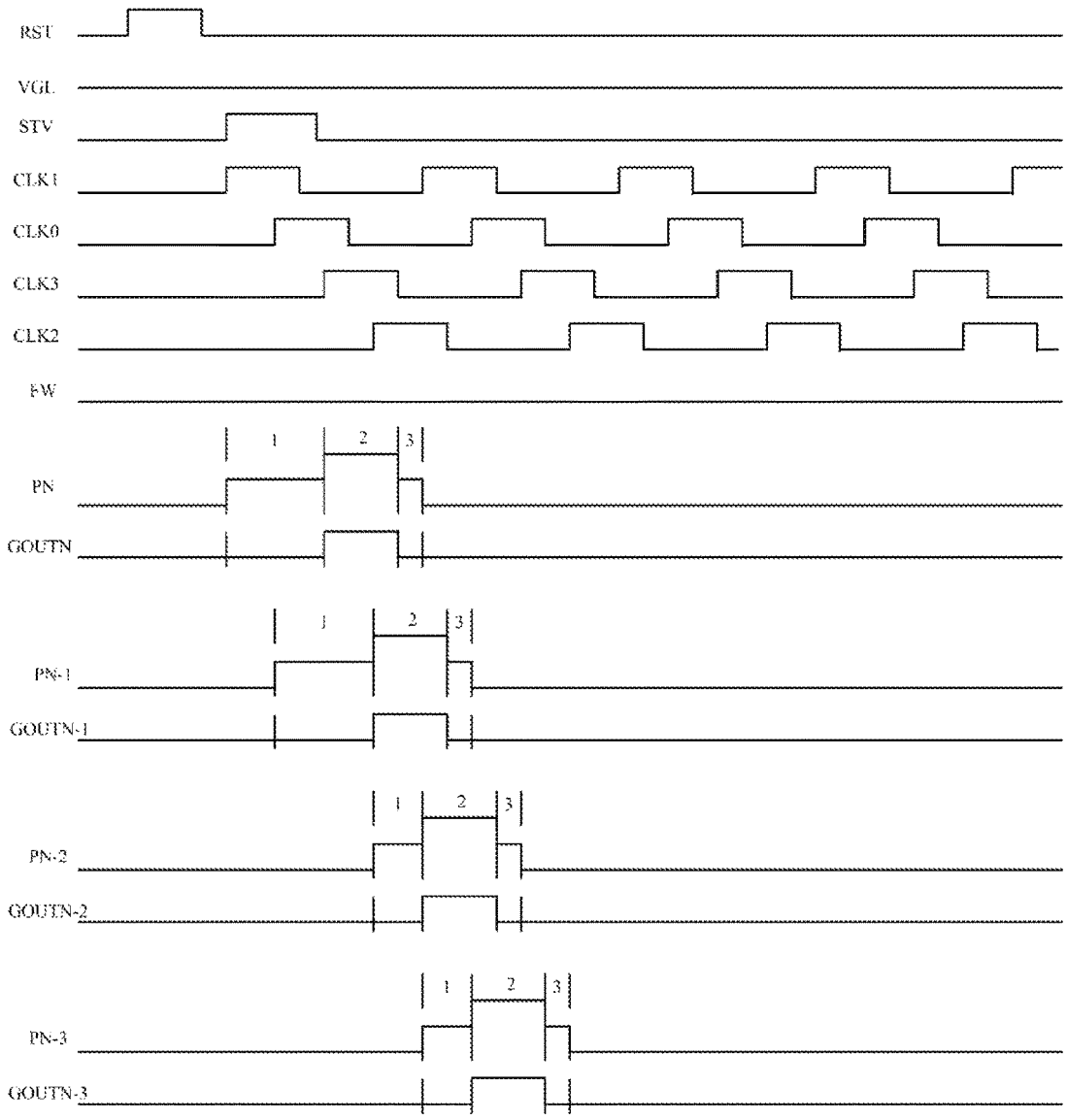
FIG. 16*b* is a timing diagram of the gate drive apparatus illustrated in FIG. 13 in backward scanning.

Operating timings of the gate drive apparatus illustrated in FIG. 15 in forward scanning and backward scanning will be described below by way of an example where the respective shift register units in the gate drive apparatus illustrated in FIG. 15 each are structured as the shift register unit illustrated in FIG. 5. FIG. 16*a* illustrates an operating timing diagram of the gate drive apparatus illustrated in FIG. 15 in forward scanning, and FIG. 16*b* illustrates an operating timing diagram of the gate drive apparatus illustrated in FIG. 15 in backward scanning.

In forward scanning by the gate drive apparatus illustrated in FIG. 15 (i.e., the timing diagram in FIG. 16*a*), an operating principle of the m-th (m=1, 2, . . . , N) shift register unit therein is the same as the operating principle of the m-th shift register unit in the gate drive apparatus illustrated in FIG. 14*a*, so a repeated description thereof will be omitted here. In backward scanning by the gate drive apparatus illustrated in FIG. 15 (i.e., the timing diagram in FIG. 16*b*), an operating principle of the m-th shift register unit therein is the same as the operating principle of the m-th shift register unit in the gate drive apparatus illustrated in FIG. 14*b*, so a repeated description thereof will be omitted here.

Figure 17:
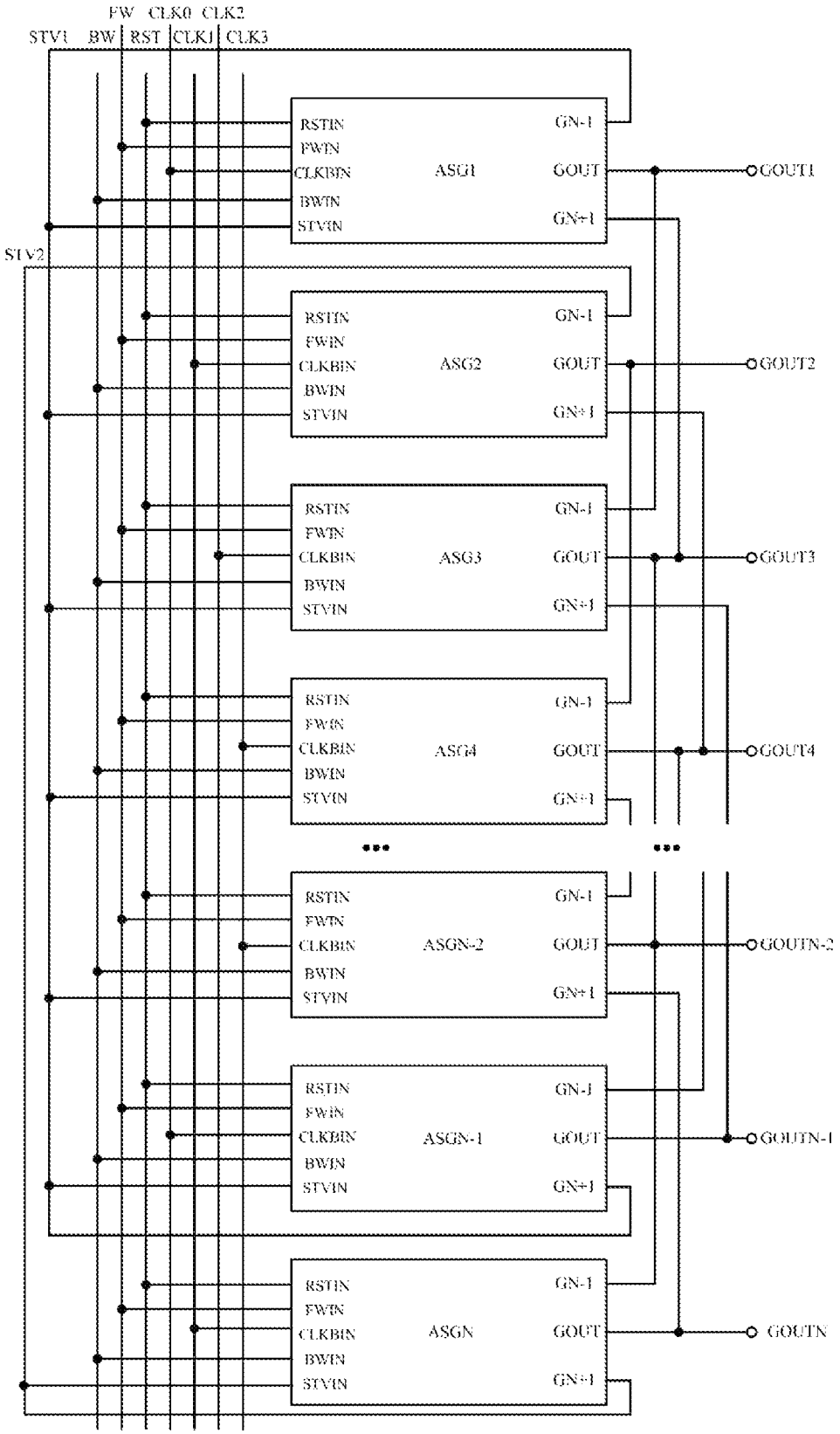
FIG. 17 is a sixth schematic structural diagram of a gate drive apparatus according to an embodiment of the present invention.

An embodiment of the invention provides a gate drive apparatus as illustrated in FIG. 17 including N shift register units, where:

A forward select signal terminal GN−1 of the p-th shift register unit ASGp receives a signal output by the (p−2)-th shift register unit ASGp−2, where p=3, 4, . . . , N, and a backward select signal terminal GN+1 of the r-th shift register unit ASGr receives a signal output by the (r+2)-th shift register unit ASGr+2, where r=1, 2, . . . , N−2; a forward select signal terminal GN−1 of the first shift register unit ASG1 receives a first initial trigger signal STV1, and a forward select signal terminal GN−1 of the second shift register unit ASG2 receives a second initial trigger signal STV2; and if N represents an even number, then a backward select signal terminal GN+1 of the (N−1)-th shift register unit ASGN−1 receives the first initial trigger signal STV1, and a backward select signal terminal GN+1 of the N-th shift register unit ASGN receives the second initial trigger signal STV2; and if N represents an odd number, then the backward select signal terminal GN+1 of the N-th shift register unit ASGN receives the first initial trigger signal STV1, and the backward select signal terminal GN+1 of the (N−1)-th shift register unit ASGN−1 receives the second initial trigger signal STV2; and a clock block signal terminal CLKBIN of the k-th shift register unit ASGk receives a mod((k−1)/4)-th clock signal CLK mod((k−1)/4), where k=1, 2, . . . , N;

A reset signal terminal RSTIN of each of the shift register units receives a reset signal RST which is at a high level after the end of scanning a preceding frame and before the start of scanning a current frame and at a low level in scanning the current frame; and an initial trigger signal terminal STVIN of each of the shift register units in the gate drive apparatus receives the first initial trigger signal STV1 or the second initial trigger signal STV2; when the reset signal RST is at the high level, both the first initial trigger signal STV1 and the second initial trigger signal STV2 are at the low level, when the first initial trigger signal STV1 is at the high level, the reset signal RST is at the low level, and when the second initial trigger signal STV2 is at the high level, the reset signal RST is at the low level; and in the gate drive apparatus illustrated in FIG. 17, the initial trigger signal terminals STVINs of the respective shift register units receive the first initial trigger signal STV1;

In forward scanning by the gate drive apparatus illustrated in FIG. 17, the respective shift register units each are configured to charge a gate of a transistor of a drive gate line therein by a high level signal received by a forward scan signal terminal FWIN until the transistor is turned on stably when the forward select signal terminal GN−1 receives a high level signal and the forward scan signal terminal FWIN receives the high level signal; to output the signal received by the clock block signal terminal CLKBIN after transistor is turned on stably; and to discharge the gate of the transistor of the drive gate line therein by a low level signal received by a backward scan signal terminal BWIN until the transistor is turned off stably when the backward select signal terminal GN+1 receives a high level signal and the backward scan signal terminal BWIN receives the low level signal;

In backward scanning by the gate drive apparatus illustrated in FIG. 17, the respective shift register units each are configured to charge the gate of the transistor of the drive gate line therein by a high level signal received by the backward scan signal terminal BWIN until the transistor is turned on stably when the backward select signal terminal GN+1 receives a high level signal and the backward scan signal terminal BWIN receives the high level signal; to output the signal received by the clock block signal terminal CLKBIN after transistor is turned on stably; and to discharge the gate of the transistor of the drive gate line therein by a low level signal received by the forward scan signal terminal FWIN until the transistor is turned off stably when the forward select signal terminal GN−1 receives a high level signal and the forward scan signal terminal FWIN receives the low level signal; and The respective shift register units in the gate drive apparatus illustrated in FIG. 17 each are configured to pull down the potential at the gate of the transistor of the drive gate line therein by the signal received by the initial trigger signal terminal STVIN and output the signal received by the initial trigger signal terminal STVIN when the reset signal terminal RSTIN is at the high level.

Figure 18:
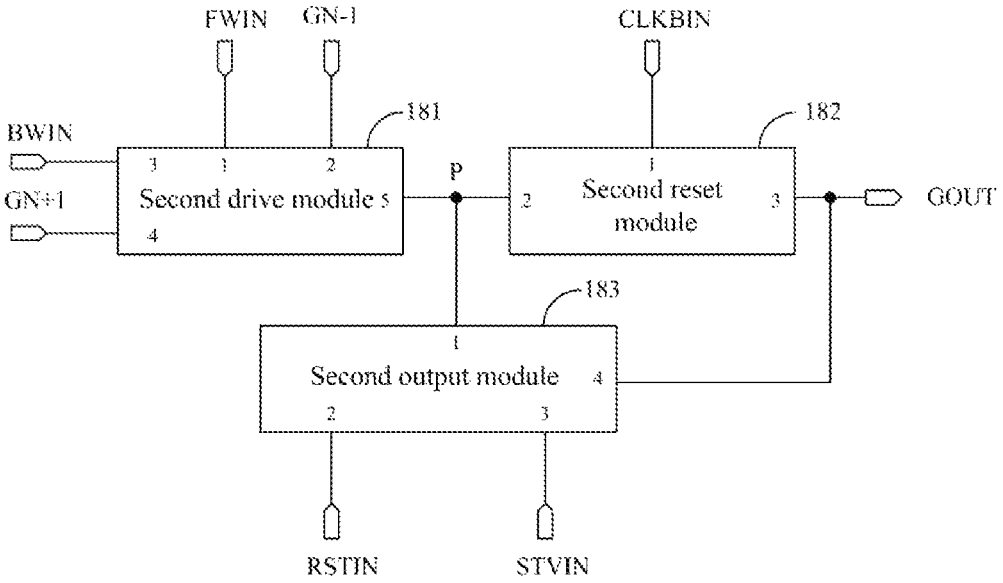
FIG. 18 is a third schematic structural diagram of a shift register unit in a gate drive apparatus according to an embodiment of the present invention.

The respective shift register units in the gate drive apparatus illustrated in FIG. 17 each can be structured as the shift register unit illustrated in FIG. 18 or of course can be embodied as a shift register unit in another structure, and the shift register units in the gate drive apparatus will not be limited in structure as long as scanning can be performed with the connection scheme illustrated in FIG. 17. The shift register unit illustrated in FIG. 18 includes a second drive module 181, a second output module 182, and a second reset module 183, where:

A first terminal of the second drive module 181 is the forward scan signal terminal FWIN of the shift register unit, a second terminal of the second drive module 181 is the forward select signal terminal GN−1 of the shift register unit, a third terminal of the second drive module 181 is the backward scan signal terminal BWIN of the shift register unit, a fourth terminal of the second drive module 181 is the backward select signal terminal GN+1 of the shift register unit, and a fifth terminal of the second drive module 181 is connected with a second terminal of the second output module 182; a first terminal of the second output module 182 is the clock block signal terminal CLKBIN of the shift register unit, and a third terminal of the second output module 182 is the output terminal GOUT of the shift register unit; and a first terminal of the second reset module 183 is connected with the second terminal of the second output module 182, a second terminal of the second reset module 183 is the reset signal terminal RSTIN of the shift register unit, a third terminal of the second reset module 183 is the initial trigger signal terminal STGIN of the shift register unit, and a fourth terminal of the second reset module 183 is the third terminal of the second output module 182, where a node where the fifth terminal of the second drive module 181, the second terminal of the second output module 182, and the first terminal and the third terminal of the second reset module 183 are connected is a pull-up node P;

The second drive module 181 is configured to output the signal received by the forward scan signal terminal FWIN through the fifth terminal thereof when the forward select signal terminal GN−1 is at the high level; and to output the signal received by the backward scan signal terminal BWIN through the fifth terminal thereof when the backward select signal terminal GN+1 is at the high level;

The second reset module 183 is configured to output the signal received by the initial trigger signal terminal STVIN of the shift register unit through the first terminal and the fourth terminal thereof respectively when the reset signal terminal RSTIN is at the high level; and The second output module 182 is configured, upon reception of a high level signal through the second terminal thereof, to store the high level signal and to output the signal received by the clock block signal terminal CLKBIN through the output terminal GOUT of the shift register unit; and upon reception of a low level signal through the second terminal thereof, to store the low level signal without outputting the signal received by the clock block signal terminal CLKBIN through the output terminal GOUT of the shift register unit.

Figure 19:
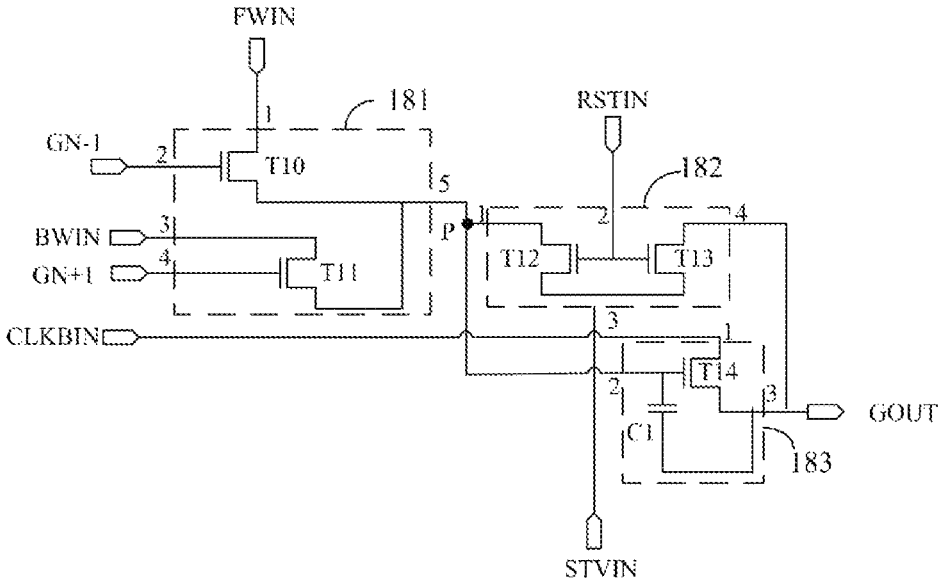
FIG. 19 is a third circuit diagram of a shift register unit in a gate drive apparatus according to an embodiment of the present invention.

Furthermore the second drive module 181 in FIG. 18 can be structured as illustrated in FIG. 19 where the second drive module 181 includes a tenth transistor T10 and an eleventh transistor T11; a first S/D of the tenth transistor T10 is the first terminal of the second drive module 181, a gate of the tenth transistor T10 is the second terminal of the second drive module 181, and a second S/D of the tenth transistor T10 is the fifth terminal of the second drive module 181; a first S/D of the eleventh transistor T11 is the fifth terminal of the second drive module 181, a gate of the eleventh transistor T11 is the fourth terminal of the second drive module 181, and a second S/D of the eleventh transistor T11 is the third terminal of the second drive module 181; the tenth transistor T10 is configured to be turned on to transmit the signal received by the forward scan signal terminal FWIN to the fifth terminal of the second drive module 181 when the forward select signal terminal GN−1 is at the high level; and to be turned off without further transmitting the signal received by the forward scan signal terminal FWIN to the fifth terminal of the second drive module 181 when the forward select signal terminal GN−1 is at the low level; and the eleventh transistor T11 is configured to be turned on to transmit the signal received by the backward scan signal terminal BWIN to the fifth terminal of the second drive module 181 when the backward select signal terminal GN+1 is at the high level; and to be turned off without further transmitting the signal received by the backward scan signal terminal BWIN to the fifth terminal of the second drive module 181 when the backward select signal terminal GN+1 is at the low level.

Furthermore the second reset module 183 in FIG. 18 can be structured as illustrated in FIG. 19 where the second reset module 183 includes a twelfth transistor T12 and a thirteenth transistor T13; a first S/D of the twelfth transistor T12 is the first terminal of the second reset module 183, a gate of the twelfth transistor T12 is the second terminal of the second reset module 183, a second S/D of the twelfth transistor T12 is the third terminal of the second reset module 183; a first S/D of the thirteenth transistor T13 is the third terminal of the second reset module 183, a gate of the thirteenth transistor T13 is the second terminal of the second reset module 183, and a second S/D of the thirteenth transistor T13 is the fourth terminal of the second reset module 183; the twelfth transistor T12 is configured to be turned on to transmit the signal received by the initial trigger signal terminal STVIN of the shift register unit to the first terminal of the second reset module 183 when the reset signal terminal RSTIN is at the high level and to be turned off when the reset signal terminal RSTIN is at the low level; and the thirteenth transistor T13 is configured to be turned on to transmit the signal received by the initial trigger signal terminal STVIN of the shift register unit to the fourth terminal of the second reset module 183 when the reset signal terminal RSTIN is at the high level and to be turned off when the reset signal terminal RSTIN is at the low level.

Furthermore the second output module 182 in FIG. 18 can be structured as illustrated in FIG. 19 where the second output module 182 includes a fourteenth transistor T14 and a third capacitor C3; a first S/D of the fourteenth transistor T14 is the first terminal of the second output module 182, a gate of the fourteenth transistor T14 is connected with the third capacitor C3, the gate of the fourteenth transistor T14 is the second terminal of the second output module 182, a second S/D of the fourteenth transistor T14 is the third terminal of the second output module 182, and one terminal of the third capacitor C3 unconnected with the gate of the fourteenth transistor T14 is the third terminal of the second output module 182; the fourteenth transistor T14 is configured to be turned on to transmit the signal received by the clock block signal terminal CLKBIN to the output terminal GOUT of the shift register unit when the gate thereof is at the high level and to be turned off when the gate thereof is at the high level; and the third capacitor C3 is configured to storage the signal at the gate of the fourteenth transistor T14.

Figure 20A:
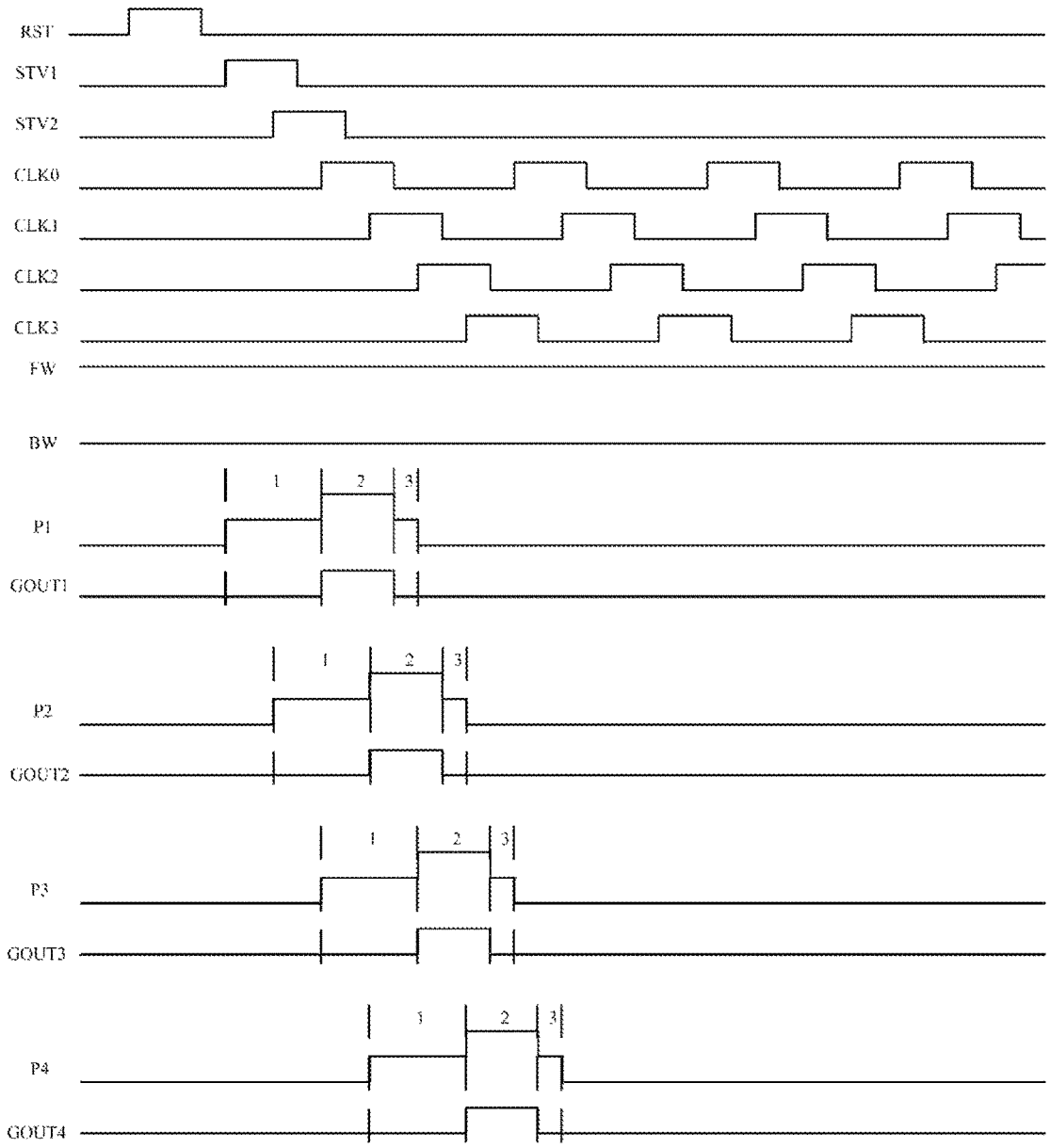
FIG. 20*a* is a timing diagram of the gate drive apparatus illustrated in FIG. 17 in forward scanning.
Figure 20B:
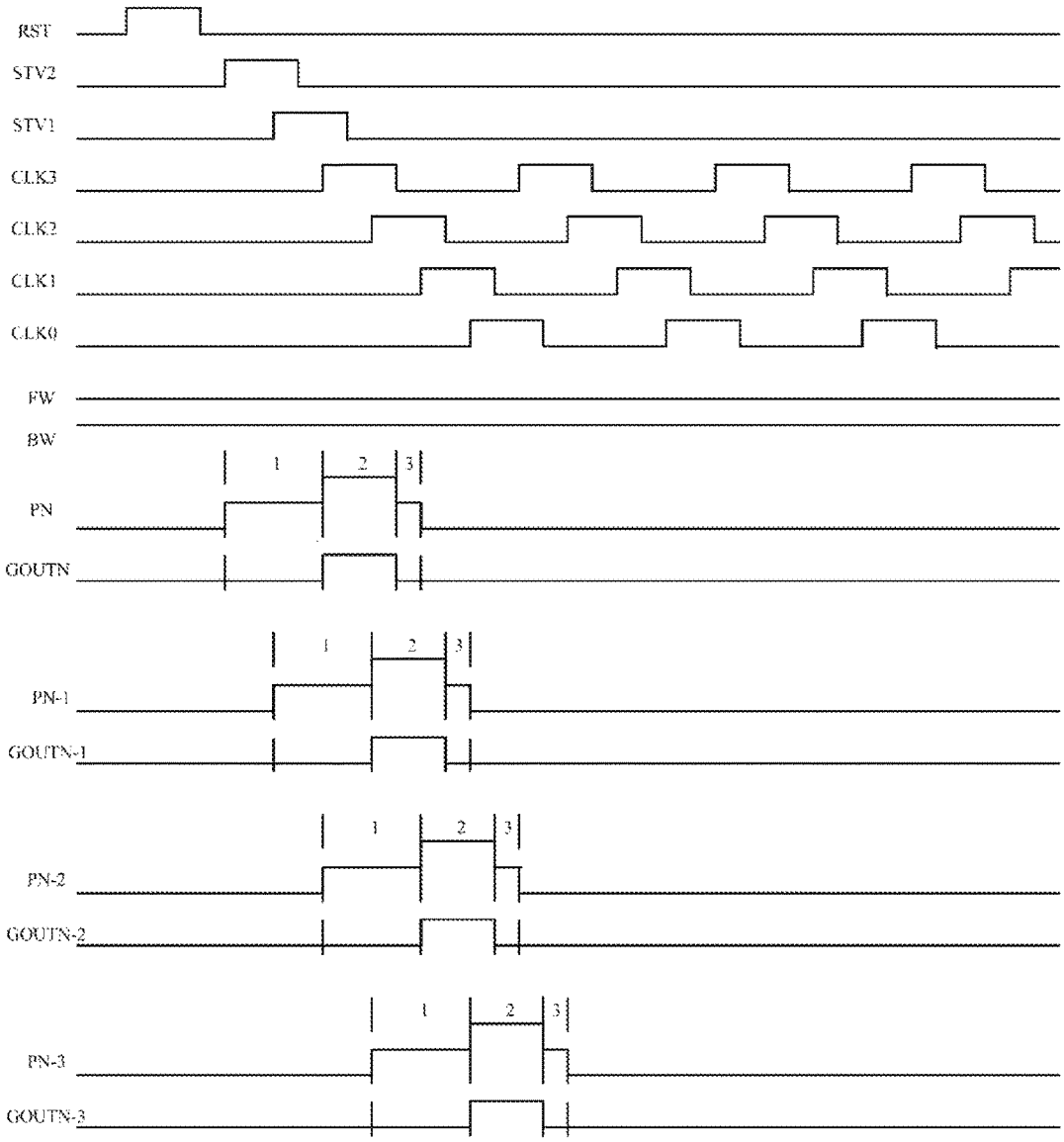
FIG. 20*b* is a timing diagram of the gate drive apparatus illustrated in FIG. 17 in backward scanning.

Operating conditions of the gate drive apparatus illustrated in FIG. 17 in forward scanning and backward scanning will be described below by way of an example where the respective shift register units in the gate drive apparatus illustrated in FIG. 17 each are structured as the shift register unit illustrated in FIG. 19. An operating timing diagram of the gate drive apparatus illustrated in FIG. 17 in forward scanning is as illustrated in FIG. 20*a*, and an operating timing diagram of the gate drive apparatus illustrated in FIG. 17 in backward scanning is as illustrated in FIG. 20*b*, where FIG. 20*a* illustrates an operating timing diagram of only the first four shift register units in the gate shift register units in the gate drive apparatus, and FIG. 20*b* illustrates an operating timing diagram of only the last four shift register units in the gate shift register units in the gate drive apparatus. N shift register units are assumed included in the gate drive apparatus illustrated in FIG. 17, and an operating principle of the gate drive apparatus will be described below by way of an example where N represents an integer multiple of 4. An operating principle of the gate drive apparatus with N being an integer other than an integer multiple of 4 will be similar to the operating principle of the gate drive apparatus with N being an integer multiple of 4, so a repeated description thereof will be omitted here.

In FIG. 20*a*, in a first period of time of the first shift register unit ASG1, the first initial trigger signal STV1 received by the forward select signal terminal GN−1 thereof is at the high level, and the tenth transistor T10 in the first shift register unit ASG1 is turned on, and in the meantime the forward scan signal terminal FW received by the forward scan signal terminal FWIN thereof is at the high level (the forward scan signal terminal FW is at the high level all the time in FIG. 20*a*), so the third capacitor C3 in the first shift register unit ASG1 starts to be charged, and when the third capacitor C3 is charged until the transistor of the drive gate line in the first shift register unit ASG1, i.e., the fourteenth transistor T14, can be turned on, the fourteenth transistor T14 is turned on, and the signal received by the clock block signal terminal CLKBIN of the first shift register unit ASG1, i.e., the 0th clock signal CLK0, will be output from the output terminal GOUT1 of the first shift register unit ASG1 through the fourteenth transistor T14, and in the first period of time of the first shift register unit ASG1, the 0th clock signal CLK0 is at the low level, so the output terminal GOUT1 of the first shift register unit ASG1 outputs a low level signal; and when the 0th clock signal CLK0 is changed from the low level to the high level, the first shift register unit ASG1 proceeds from the first period of time to a second period of time. In the second period of time of the first shift register unit ASG1, the first initial trigger signal STV1 is at the low level, so the tenth transistor T10 in the first shift register unit ASG1 is turned off, but since the third capacitor C3 stores the voltage signal at the pull-up node P1 in the first shift register unit ASG1, the fourteenth transistor T14 in the first shift register unit ASG1 is still turned on, and since the 0th clock signal CLK0 is at the high level in this period of time, the output terminal GOUT1 of the first shift register unit ASG1 outputs a high level signal, and a bootstrap effect of the third capacitor C3 will have the potential at the pull-up node P1 of the first shift register unit ASG1 further boosted; and when the 0th clock signal CLK0 is changed from the high level to the low level, the first shift register unit ASG1 proceeds from the second period of time to a third period of time. In the third period of time of the first shift register unit ASG1, the first initial trigger signal STV1 is at the low level, so the tenth transistor T10 in the first shift register unit ASG1 is turned off, but due to the storage function of the third capacitor C3 in the first shift register unit ASG1, the fourteenth transistor T14 in the first shift register unit ASG1 is still turned on, and since the 0th clock signal CLK0 is at the low level in this period of time, the output terminal GOUT1 of the first shift register unit ASG1 outputs a low level signal, when the backward select signal terminal GN+1 of the first shift register unit ASG1 receives a high level signal and the backward scan signal terminal BWIN thereof receives a low level signal, that is, the output terminal GOUT3 of the third shift register unit ASG3 outputs a high level signal (when the second clock signal CLK2 is at the high level, the output terminal GOUT3 of the third shift register unit ASG3 outputs a high level signal) and the backward scan signal BW is at the low level (the backward scan signal BW is at the low level all the time in FIG. 20*a*), the third capacitor C3 in the first shift register unit ASG1 is discharged, and when it is discharged until the voltage at the gate of the fourteenth transistor T14 in the first shift register unit ASG1 is below the voltage at which the fourteenth transistor T14 can be turned on, the fourteenth transistor T14 in the first shift register unit ASG1 is turned off, and the third period of time of the first shift register unit ASG1 ends, where the first period of time, the second period of time and the third period of time of the first shift register unit ASG1 are periods of time in which the gate line connected with the first shift register unit ASG1 is enabled.

In FIG. 20*a*, in a first period of time of the second shift register unit ASG2, the second initial trigger signal STV2 received by the forward select signal terminal GN−1 thereof is at the high level, and the tenth transistor T10 in the second shift register unit ASG2 is turned on, and in the meantime the forward scan signal FW received by the forward scan signal terminal FWIN thereof is at the high level (the forward scan signal FW is at the high level all the time in FIG. 20*a*), so the third capacitor C3 in the second shift register unit ASG2 starts to be charged, and when the third capacitor C3 is charged until the transistor of the drive gate line in the second shift register unit ASG2, i.e., the fourteenth transistor T14, can be turned on, the fourteenth transistor T14 is turned on, and the signal received by the clock block signal terminal CLKBIN of the second shift register unit ASG2, i.e., the first clock signal CLK1, will be output from the output terminal GOUT2 of the second shift register unit ASG2 through the fourteenth transistor T14, and in the first period of time of the second shift register unit ASG2, the first clock signal CLK1 is at the low level, so the output terminal GOUT2 of the second shift register unit ASG2 outputs a low level signal; and when the first clock signal CLK1 is changed from the low level to the high level, the second shift register unit ASG2 proceeds from the first period of time to a second period of time. In the second period of time of the second shift register unit ASG2, the second initial trigger signal STV2 is at the low level, and the tenth transistor T10 in the second shift register unit ASG2 is turned off, but since the third capacitor C3 stores the voltage signal at the pull-up node P2 in the second shift register unit ASG2, the fourteenth transistor T14 in the second shift register unit ASG2 is still turned on, and since the first clock signal CLK1 is at the high level in this period of time, the output terminal GOUT2 of the second shift register unit ASG2 outputs a high level signal, and a bootstrap effect of the third capacitor C3 will have the potential at the pull-up node P2 of the second shift register unit ASG2 further boosted; and when the first clock signal CLK1 is changed from the high level to the low level, the second shift register unit ASG2 proceeds from the second period of time to a third period of time. In the third period of time of the second shift register unit ASG2, the second initial trigger signal STV2 is at the low level, so the tenth transistor T10 in the second shift register unit ASG2 is turned off, but due to the storage function of the third capacitor C3 in the second shift register unit ASG2, the fourteenth transistor T14 in the second shift register unit ASG2 is still turned on, and since the first clock signal CLK1 is at the low level in this period of time, the output terminal GOUT2 of the second shift register unit ASG2 outputs a low level signal, when the backward select signal terminal GN+1 of the second shift register unit ASG2 receives a high level signal and the backward scan signal terminal BWIN thereof receives a low level signal, that is, the output terminal GOUT4 of the fourth shift register unit ASG4 outputs a high level signal (when the third clock signal CLK3 is at the high level, the output terminal GOUT4 of the fourth shift register unit ASG4 outputs a high level signal) and the backward scan signal BW is at the low level (the backward scan signal BW is at the low level all the time in FIG. 20*a*), the third capacitor C3 in the second shift register unit ASG2 is discharged, and when it is discharged until the voltage at the gate of the fourteenth transistor T14 in the second shift register unit ASG2 is below the voltage at which the fourteenth transistor T14 can be turned on, the fourteenth transistor T14 in the second shift register unit ASG2 is turned off, and the third period of time of the second shift register unit ASG2 ends, where the first period of time, the second period of time and the third period of time of the second shift register unit ASG2 are periods of time in which the gate line connected with the second shift register unit ASG2 is enabled.

In FIG. 20*a*, in a first period of time of the q-th (q=3, 4, . . . , N) shift register unit ASGq, when the output terminal GOUTq−2 of the (q−2)-th shift register unit ASGq−2 received by the forward select signal terminal GN−1 thereof is at the high level (when the mod((q−3)/4)-th clock signal CLK mod((q−3)/4) is at the high level, the output terminal GoutTq−2 of the (q−2)-th shift register unit ASGq−2 outputs a high level signal), and the forward scan signal FW received by the forward scan signal terminal FWIN thereof is at the high level (the forward scan signal FW is at the high level all the time in FIG. 20*a*), the third capacitor C3 in the q-th shift register unit ASGq is charged, and when the third capacitor C3 is charged until the transistor of the drive gate line in the q-th shift register unit ASGq, i.e., the fourteenth transistor T14, can be turned on, the fourteenth transistor T14 is turned on, and the signal received by the clock block signal terminal CLKBIN of the q-th shift register unit ASGq, i.e., the mod((q−1)/4)-th clock signal CLK mod((q−1)/4), will be output from the output terminal GOUTq of the q-th shift register unit ASGq through the fourteenth transistor T14, and in the first period of time of the q-th shift register unit ASGq, the mod((q−1)/4)-th clock signal CLK mod((q−1)/4) is at the low level, so the output terminal GOUTq of the q-th shift register unit ASGq outputs a low level signal; and after the mod((q−1)/4)-th clock signal CLK mod((q−1)/4) is changed from the low level to the high level, the first period of time of the q-th shift register unit ASGq ends, and the q-th shift register unit ASGq proceeds to a second period of time. In the second period of time of the q-th shift register unit ASGq, the mod((q−3)/4)-th clock signal CLK mod((q−3)/4) is at the low level, and the tenth transistor T10 in the q-th shift register unit ASGq is turned off, and the signal at the pull-up node Pq in the q-th shift register unit ASGq can only be such a signal stored on the third capacitor C3 in the q-th shift register unit ASGq that can have the fourteenth transistor T14 in the q-th shift register unit ASGq turned on, and since the mod((q−1)/4)-th clock signal CLK mod((q−1)/4) is at the high level in this period of time, the output terminal GOUTq of the q-th shift register unit ASGq outputs a high level signal, and a bootstrap effect of the third capacitor C3 will have the potential at the pull-up node Pq of the q-th shift register unit ASGq further boosted. After the mod((q−1)/4)-th clock signal CLK mod((q−1)/4) is changed from the high level to the low level, the second period of time of the q-th shift register unit ASGq ends, and the q-th shift register unit ASGq proceeds to a third period of time. In the third period of time of the q-th shift register unit ASGq, the mod((q−3)/4)-th clock signal CLK mod((q−3)/4) is at the low level, and the tenth transistor T10 in the q-th shift register unit ASGq is turned off, but due to the storage function of the third capacitor C3 in the q-th shift register unit ASGq, the fourteenth transistor T14 in the q-th shift register unit ASGq is still turned on, and since the mod((q−1)/4)-th clock signal CLK mod((q−1)/4) is at the low level in this period of time, the output terminal GOUTq of the q-th shift register unit ASGq outputs a low level signal, and when the backward select signal terminal GN+1 of the q-th shift register unit ASGq receives a high level signal and the backward scan signal terminal BWIN thereof receives a low level signal, that is, the output terminal GOUTq+2 of the (q+2)-th shift register unit ASGq+2 outputs a high level signal (when the mod((q+1)/4)-th clock signal CLK mod((q+1)/4) is at the high level, the output terminal GOUTq+2 of the (q+2)-th shift register unit ASGq+2 outputs a high level signal) and the backward scan signal BW is at the low level (the backward scan signal BW is at the low level all the time in FIG. 20*a*), the third capacitor C3 in the q-th shift register unit ASGq is discharged, and when it is discharged until the voltage at the gate of the fourteenth transistor T14 in the q-th shift register unit ASGq is below the voltage at which the fourteenth transistor T14 can be turned on, the fourteenth transistor T14 in the q-th shift register unit ASGq is turned off, and the third period of time of the q-th shift register unit ASGq ends.

Particularly the first period of time, the second period of time and the third period of time of the q-th shift register unit ASGq are periods of time in which the gate line connected with the q-th shift register unit ASGq is enabled.

In FIG. 20*a*, since the signal received by the backward select signal terminal GN+1 of the (N−1)-th shift register unit ASGN−1 is the first initial trigger signal STV1 which will be at the high level to thereby trigger the start of scanning only when one frame starts to be scanned and which will be at the low level at other times, the backward select signal terminal GN+1 of the (N−1)-th shift register unit ASGN−1 will be at the high level only when one frame starts to be scanned and will be at the low level at other times, so the eleventh transistor T11 in the (N−1)-th shift register unit ASGN−1 can not be turned on so that the third capacitor C3 in the (N−1)-th shift register unit ASGN−1 can not be discharged through the eleventh transistor T11, so that the fourteenth transistor T14 in the (N−1)-th shift register unit ASGN−1 can not be turned off; and the fourteenth transistor T14 in the (N−1)-th shift register unit ASGN−1 can have the signal at the gate thereof (i.e., the signal stored on the third capacitor C3) released through the twelfth transistor T12 in the (N−1)-th shift register unit ASGN−1 to thereby be turned off only when the reset signal terminal RSTIN in the (N−1)-th shift register unit ASGN−1 receives a high level signal (that is, the reset signal RST is at the high level after the end of scanning a preceding frame and before the start of scanning a next frame); and when the reset signal RST is at the high level, the thirteenth transistor T13 in the (N−1)-th shift register unit ASGN−1 is turned on so that the gate line connected with the (N−1)-th shift register unit ASGN−1 receives a low level signal. Thus the third period of time of the (N−1)-th shift register unit ASGN−1 will end only when the reset signal terminal RSTIN thereof receives a high level signal (that is, the reset signal RST is changed from the low level signal to the high level signal).

In FIG. 20*a*, since the signal received by the backward select signal terminal GN+1 of the N-th shift register unit ASGN is the second initial trigger signal STV2 which will be at the high level to thereby trigger the start of scanning only when one frame starts to be scanned and which will be at the low level at other times, the backward select signal terminal GN+1 of the N-th shift register unit ASGN will be at the high level only when one frame starts to be scanned and will be at the low level at other times, so the eleventh transistor T11 in the N-th shift register unit ASGN can not be turned on so that the third capacitor C3 in the N-th shift register unit ASGN can not be discharged through the s eleventh transistor T11, so the fourteenth transistor T14 in the N-th shift register unit ASGN can not be turned off; and the fourteenth transistor T14 in the N-th shift register unit ASGN can have the signal at the gate thereof (i.e., the signal stored on the third capacitor C3) released through the twelfth transistor T12 in the N-th shift register unit ASGN to thereby be turned off only when the reset signal terminal RSTIN in the N-th shift register unit ASGN receives a high level signal (that is, the reset signal RST is at the high level after the end of scanning a preceding frame and before the start of scanning a next frame); and when the reset signal RST is at the high level, the thirteenth transistor T13 in the N-th shift register unit ASGN is turned on so that the gate line connected with the N-th shift register unit ASGN receives a low level signal. Thus the third period of time of the N-th shift register unit ASGN will end only when the reset signal terminal RSTIN thereof receives a high level signal (that is, the reset signal RST is changed from the low level signal to the high level signal).

In FIG. 20*a*, with each of the shift register units, when the reset signal terminal RSTIN thereof receives a high level signal (that is, the reset signal RST is at the high level), the gate of the fourteenth transistor T14 therein will be connected with the initial trigger signal terminal STVIN, and since both the first initial trigger signal STV1 and the second initial trigger signal STV2 are at the low level when the reset signal RST is at the high level, the fourteenth transistor T14 will be turned off, and the gate line connected with the each shift register unit will also receive a low level signal to thereby eliminate an influence of a residual signal after the end of scanning the preceding frame upon the succeeding frame. Thus the reset signal, the first initial trigger signal and the second initial trigger signal can be used in place of a low level signal.

In FIG. 20*b*, in a first period of time of the N-th (N represents an integer multiple of 4) shift register unit ASGN, the second initial trigger signal STV2 received by the backward select signal terminal GN+1 thereof is at the high level, and the eleventh transistor T11 in the N-th shift register unit ASGN is turned on, and in the meantime the backward scan signal BW received by the backward scan signal terminal BWIN thereof is at the high level (the backward scan signal BW is at the high level all the time in FIG. 20*b*), so the third capacitor C3 in the N-th shift register unit ASGN starts to be charged, and when the third capacitor C3 is charged until the transistor of the drive gate line in the N-th shift register unit ASGN, i.e., the fourteenth transistor T14, can be turned on, the fourteenth transistor T14 is turned on, and the signal received by the clock block signal terminal CLKBIN of the N-th shift register unit ASGN, i.e., the third clock signal CLK3, will be output from the output terminal GOUTN of the N-th shift register unit ASGN through the fourteenth transistor T14, and in the first period of time of the N-th shift register unit ASGN, the third clock signal CLK3 is at the low level, so the output terminal GOUTN of the N-th shift register unit ASGN outputs a low level signal; and when the third clock signal CLK3 is changed from the low level to the high level, the N-th shift register unit ASGN proceeds from the first period of time to a second period of time. In the second period of time of the N-th shift register unit ASGN, the second initial trigger signal STV2 is at the low level, so the eleventh transistor T11 in the N-th shift register unit ASGN is turned off, but since the third capacitor C3 stores the voltage signal at the pull-up node P2 in the N-th shift register unit ASGN, the fourteenth transistor T14 in the N-th shift register unit ASGN is still turned on, and since the third clock signal CLK3 is at the high level in this period of time, the output terminal GOUTN of the N-th shift register unit ASGN outputs a high level signal, and a bootstrap effect of the third capacitor C3 will have the potential at the pull-up node PN of the N-th shift register unit ASGN further boosted; and when the third clock signal CLK3 is changed from the high level to the low level, the N-th shift register unit ASGN proceeds from the second period of time to a third period of time. In the third period of time of the N-th shift register unit ASGN, the second initial trigger signal STV2 is at the low level, so the eleventh transistor T11 in the N-th shift register unit ASGN is turned off, but due to the storage function of the third capacitor C3 in the N-th shift register unit ASGN, the fourteenth transistor T14 in the N-th shift register unit ASGN is still turned on, and since the third clock signal CLK3 is at the low level in this period of time, the output terminal GOUTN of the N-th shift register unit ASGN outputs a low level signal, when the forward select signal terminal GN−1 of the N-th shift register unit ASGN receives a high level signal and the forward scan signal terminal FWIN terminal thereof receives a low level signal, that is, the output terminal GOUTN−2 of the (N−2)-th shift register unit ASGN−2 outputs a high level signal (when the first clock signal CLK1 is at the high level, the output terminal GOUTN−2 of the (N−2)-th shift register unit ASGN−2 outputs a high level signal) and the forward scan signal FW is at the low level (the forward scan signal FW is at the low level all the time in FIG. 20*b*), the third capacitor C3 in the N-th shift register unit ASGN is discharged, and when it is discharged until the voltage at the gate of the fourteenth transistor T14 in the N-th shift register unit ASGN is below the voltage at which the fourteenth transistor T14 can be turned on, the fourteenth transistor T14 in the N-th shift register unit ASGN is turned off, and the third period of time of the N-th shift register unit ASGN ends, where the first period of time, the second period of time and the third period of time of the N-th shift register unit ASGN are periods of time in which the gate line connected with the N-th shift register unit ASGN is enabled.

In FIG. 20*b*, in a first period of time of the (N−1)-th shift register unit ASGN−1, the first initial trigger signal STV1 received by the backward select signal terminal GN+1 thereof is at the high level, and the eleventh transistor T11 in the (N−1)-th shift register unit ASGN−1 is turned on, and in the meantime the backward scan signal BW received by the backward scan signal terminal BWIN thereof is at the high level (the backward scan signal BW is at the high level all the time in FIG. 20*b*), so the third capacitor C3 in the (N−1)-th shift register unit ASGN−1 starts to be charged, and when the third capacitor C3 is charged until the transistor of the drive gate line in the (N−1)-th shift register unit ASGN−1, i.e., the fourteenth transistor T14, can be turned on, the fourteenth transistor T14 is turned on, and the signal received by the clock block signal terminal CLKBIN of the (N−1)-th shift register unit ASGN−1, i.e., the second clock signal CLK2, will be output from the output terminal GOUTN−1 of the (N−1)-th shift register unit ASGN−1 through the fourteenth transistor T14, and in the first period of time of the (N−1)-th shift register unit ASGN−1, the second clock signal CLK2 is at the low level, so the output terminal GOUTN−1 of the (N−1)-th shift register unit ASGN−1 outputs a low level signal; and when the second clock signal CLK2 is changed from the low level to the high level, the (N−1)-th shift register unit ASGN−1 proceeds from the first period of time to a second period of time. In the second period of time of the (N−1)-th shift register unit ASGN−1, the first initial trigger signal STV1 is at the low level, so the eleventh transistor T11 in the (N−1)-th shift register unit ASGN−1 is turned off, but due to the storage function of the third capacitor C3, the fourteenth transistor T14 in the (N−1)-th shift register unit ASGN−1 is still turned on, and since the second clock signal CLK2 is at the high level in this period of time, the output terminal GOUTN−1 of the (N−1)-th shift register unit ASGN−1 outputs a high level signal, and a bootstrap effect of the third capacitor C3 will have the potential at the pull-up node PN−1 of the (N−1)-th shift register unit ASGN−1 further boosted; and when the second clock signal CLK2 is changed from the high level to the low level, the (N−1)-th shift register unit ASGN−1 proceeds from the second period of time to a third period of time. In the third period of time of the (N−1)-th shift register unit ASGN−1, the first initial trigger signal STV1 is at the low level, so the eleventh transistor T11 in the (N−1)-th shift register unit ASGN−1 is turned off, but due to the storage function of the third capacitor C3 in the (N−1)-th shift register unit ASGN−1, the fourteenth transistor T14 in the (N−1)-th shift register unit ASGN−1 is still turned on, and since the second clock signal CLK2 is at the low level in this period of time, the output terminal GOUTN−1 of the (N−1)-th shift register unit ASGN−1 outputs a low level signal, when the forward select signal terminal GN−1 of the (N−1)-th shift register unit ASGN−1 receives a high level signal and the forward scan signal terminal FWIN thereof receives a low level signal, that is, the output terminal GOUTN−3 of the (N−3)-th shift register unit ASGN−3 outputs a high level signal (when the 0th clock signal CLK0 is at the high level, the output terminal GOUTN−3 of the (N−3)-th shift register unit ASGN−3 outputs a high level signal) and the forward scan signal FW is at the low level (the forward scan signal FW is at the low level in FIG. 20*b*), the third capacitor C3 in the (N−1)-th shift register unit ASGN−1 is discharged, and when it is discharged until the voltage at the gate of the fourteenth transistor T14 in the (N−1)-th shift register unit ASGN−1 is below the voltage at which the fourteenth transistor T14 can be turned on, the fourteenth transistor T14 in the (N−1)-th shift register unit ASGN−1 is turned off, and the third period of time of the (N−1)-th shift register unit ASGN−1 ends, where the first period of time, the second period of time and the third period of time of the (N−1)-th shift register unit ASGN−1 are periods of time in which the gate line connected with the (N−1)-th shift register unit ASGN−1 is enabled.

In FIG. 20*b*, in a first period of time of the q-th (q=1, 2, 3, 4, . . . , N−2) shift register unit ASGq, when the output terminal GOUTq+2 of the (q+2)-th shift register unit ASGq+2 received by the backward select signal terminal GN+1 thereof is at the high level (when the mod((q+1)/4)-th clock signal CLK mod((q+1)/4) is at the high level, the output terminal GOUTq+2 of the (q+2)-th shift register unit ASGq+2 outputs a high level signal), and the backward scan signal BW received by the backward scan signal terminal BWIN thereof is at the high level, the third capacitor C3 in the q-th shift register unit ASGq is charged, and when the third capacitor C3 is charged until the transistor of the drive gate line in the q-th shift register unit ASGq, i.e., the fourteenth transistor T14, can be turned on, the fourteenth transistor T14 is turned on, and the signal received by the clock block signal terminal CLKBIN of the q-th shift register unit ASGq, i.e., the mod((q−1)/4)-th clock signal CLK mod((q−1)/4), will be output from the output terminal GOUTq of the q-th shift register unit ASGq through the fourteenth transistor T14, and in the first period of time of the q-th shift register unit ASGq, the mod((q−1)/4)-th clock signal CLK mod((q−1)/4) is at the low level, so the output terminal GOUTq of the q-th shift register unit ASGq outputs a low level signal; and after the mod((q+1)/4)-th clock signal CLK mod((q+1)/4) is changed from the high level to the low level, the third capacitor C3 in the q-th shift register unit ASGq will not be further charged but can only perform the storage function even if the backward scan signal BW is at the high level, and after the mod((q−1)/4)-th clock signal CLK mod((q−1)/4) is changed from the low level to the high level, the first period of time of the q-th shift register unit ASGq ends, and the q-th shift register unit ASGq proceeds to a second period of time. In the second period of time of the q-th shift register unit ASGq, the mod((q+1)/4)-th clock signal CLK mod((q+1)/4) is at the low level, the eleventh transistor T11 in the q-th shift register unit ASGq is turned off, and the signal at the pull-up node Pq in the q-th shift register unit ASGq can only be such a signal stored on the third capacitor C3 in the q-th shift register unit ASGq that can have the fourteenth transistor T14 in the q-th shift register unit ASGq turned on, and since the mod((q−1)/4)-th clock signal CLK mod((q−1)/4) is at the high level in this period of time, the output terminal GOUTq of the q-th shift register unit ASGq outputs a high level signal, and a bootstrap effect of the third capacitor C3 will have the potential at the pull-up node Pq of the q-th shift register unit ASGq further boosted. After the mod((q−1)/4)-th clock signal CLK mod((q−1)/4) is changed from the high level to the low level, the second period of time of the q-th shift register unit ASGq ends, and the q-th shift register unit ASGq proceeds to a third period of time. In the third period of time of the q-th shift register unit ASGq, the mod((q+1)/4)-th clock signal CLK mod((q+1)/4) is at the low level, and the eleventh transistor T11 in the q-th shift register unit ASGq is turned off, but due to the storage function of the third capacitor C3 in the q-th shift register unit ASGq, the fourteenth transistor T14 in the q-th shift register unit ASGq is still turned on, and since the mod((q−1)/4)-th clock signal CLK mod((q−1)/4) is at the low level in this period of time, the output terminal GOUTq of the q-th shift register unit ASGq outputs a low level signal, and when the forward select signal terminal GN−1 of the q-th shift register unit ASGq receives a high level signal and the forward scan signal terminal FWIN thereof receives a low level signal, that is, the output terminal GOUTq−2 of the (q−2)-th shift register unit ASGq−2 outputs a high level signal (when the mod((q−3)/4)-th clock signal CLK mod((q−3)/4) is at the high level, the output terminal GOUTq−2 of the (q−2)-th shift register unit ASGq−2 outputs a high level signal) and the forward scan signal FW is at the low level, the third capacitor C3 in the q-th shift register unit ASGq is discharged, and when it is discharged until the voltage at the gate of the fourteenth transistor T14 in the q-th shift register unit ASGq is below the voltage at which the fourteenth transistor T14 can be turned on, the fourteenth transistor T14 in the q-th shift register unit ASGq is turned off, and the third period of time of the q-th shift register unit ASGq ends.

Particularly the first period of time, the second period of time and the third period of time of the q-th shift register unit ASGq are periods of time in which the gate line connected with the q-th shift register unit ASGq is enabled.

In FIG. 20*b*, since the signal received by the forward select signal terminal GN−1 of the first shift register unit ASG1 is the first initial trigger signal STV1 which will be at the high level to thereby trigger the start of scanning only when one frame starts to be scanned and which will be at the low level at other times, the forward select signal terminal GN−1 of the first shift register unit ASG1 will be at the high level only when one frame starts to be scanned and will be at the low level at other times, so the tenth transistor T10 in the first shift register unit ASG1 can not be turned on so that the third capacitor C3 in the first shift register unit ASG1 can not be discharged through the tenth transistor T10, so that the fourteenth transistor T14 in the first shift register unit ASG1 can not be turned off; and the fourteenth transistor T14 in the first shift register unit ASG1 can have the signal at the gate thereof (i.e., the signal stored on the third capacitor C3) released through the twelfth transistor T12 in the first shift register unit ASG1 to thereby be turned off only when the reset signal terminal RSTIN in the first shift register unit ASG1 receives a high level signal (that is, the reset signal RST is at the high level after the end of scanning a preceding frame and before the start of scanning a next frame); and when the reset signal RST is at the high level, the thirteenth transistor T13 in the first shift register unit ASG1 is turned on so that the gate line connected with the first shift register unit ASG1 receives a low level signal. Thus the third period of time of the first shift register unit ASG1 will end only when the reset signal terminal RSTIN thereof receives a high level signal (that is, the reset signal RST is changed from the low level signal to the high level signal).

In FIG. 20*b*, since the signal received by the forward select signal terminal GN−1 of the second shift register unit ASG2 is the second initial trigger signal STV2 which will be at the high level to thereby trigger the start of scanning only when one frame starts to be scanned and which will be at the low level at other times, the forward select signal terminal GN−1 of the second shift register unit ASG2 will be at the high level only when one frame starts to be scanned and will be at the low level at other times, so the tenth transistor T10 in the second shift register unit ASG2 can not be turned on so that the third capacitor C3 in the second shift register unit ASG2 can not be discharged through the tenth transistor T10, so that the fourteenth transistor T14 in the second shift register unit ASG2 can not be turned off; and the fourteenth transistor T14 in the second shift register unit ASG2 can have the signal at the gate thereof (i.e., the signal stored on the third capacitor C3) released through the twelfth transistor T12 in the second shift register unit ASG2 to thereby be turned off only when the reset signal terminal RSTIN in the second shift register unit ASG2 receives a high level signal (that is, the reset signal RST is at the high level after the end of scanning a preceding frame and before the start of scanning a next frame); and when the reset signal RST is at the high level, the thirteenth transistor T13 in the second shift register unit ASG2 is turned on so that the gate line connected with the second shift register unit ASG2 receives a low level signal. Thus the third period of time of the second shift register unit ASG2 will end only when the reset signal terminal RSTIN thereof receives a high level signal (that is, the reset signal RST is changed from the low level signal to the high level signal).

In FIG. 20*b*, with each of the shift register units, when the reset signal terminal RSTIN thereof receives a high level signal (that is, the reset signal RST is at the high level), the gate of the fourteenth transistor T14 therein will be connected with the initial trigger signal terminal STVIN, and since both the first initial trigger signal STV1 and the second initial trigger signal STV2 are at the low level when the reset signal RST is at the high level, the fourteenth transistor T14 will be turned off, and the gate line connected with the each shift register unit will also receive a low level signal to thereby eliminate an influence of a residual signal after the end of scanning the preceding frame upon the succeeding frame.

Figure 21:
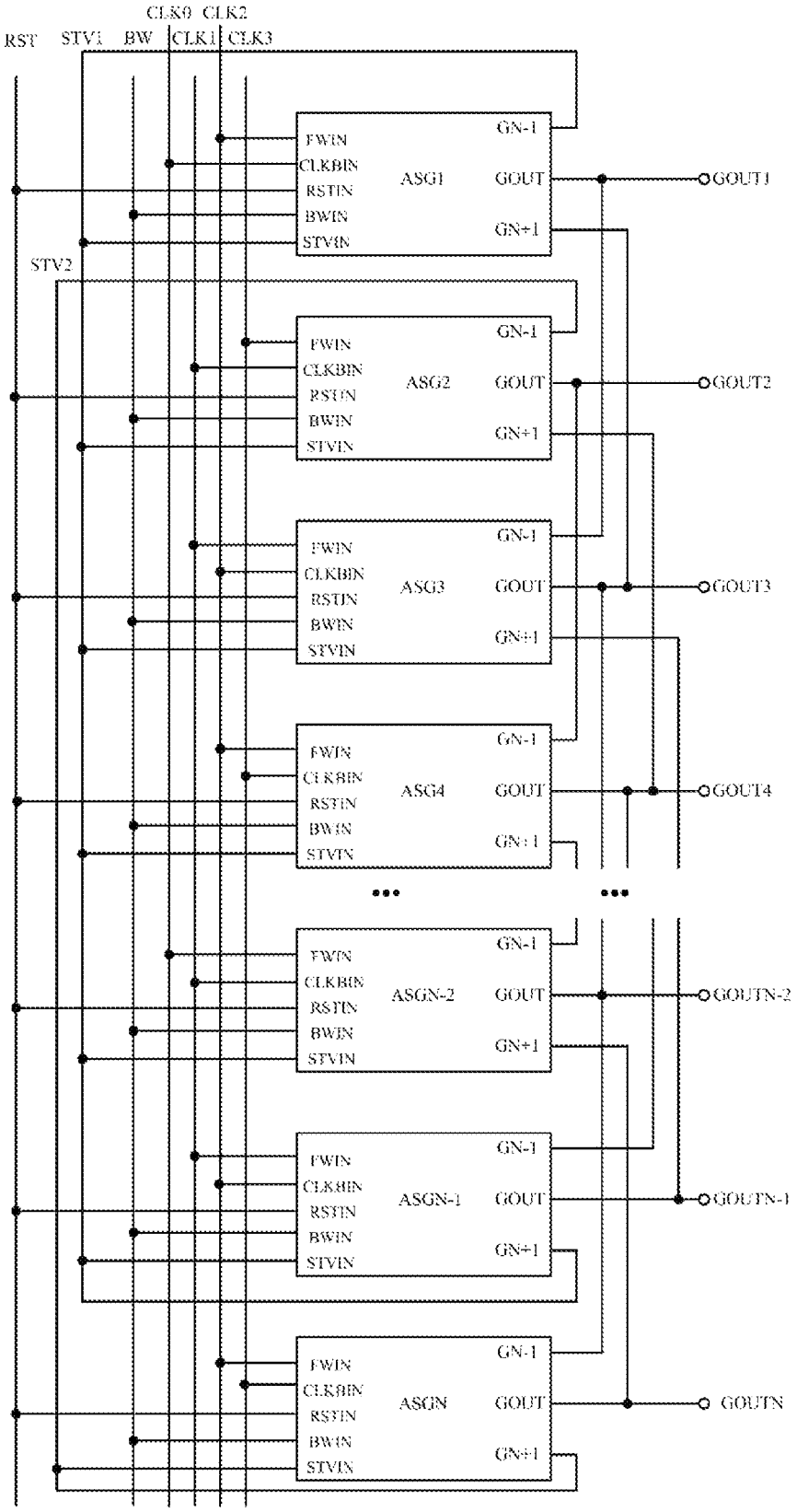
FIG. 21 is a seventh schematic structural diagram of a gate drive apparatus according to an embodiment of the present invention.

Furthermore respective clocks signals can also be reused as forward scan signals FWs in a gate drive apparatus according to an embodiment of the invention, and the gate drive apparatus can be structured as illustrated in FIG. 21. The gate drive apparatus in FIG. 21 is different from the gate drive apparatus in FIG. 17 in that a transmission line is required to be specially arranged to transmit the forward scan signals received by the respective register units in the gate drive apparatus illustrated in FIG. 17, and the clock signals can be reused as the forward scan signals received by the respective register units in the gate drive apparatus illustrated in FIG. 21. The clock signals can be reused as the forward scan signals received by the respective register units in the gate drive apparatus illustrated in FIG. 21 particularly as follows: a signal received by a forward scan signal terminal FWIN of each of the shift register units other than the first two shift register units is the same as the signal received by the clock block signal terminal CLKBIN of the preceding shift register unit to the shift register unit, the forward scan signal terminal FWIN of the first shift register unit ASG1 receives the second clock signal CLK2, and the forward scan signal terminal FWIN of the second shift register unit ASG2 receives the third clock signal CLK3; and when the 0th clock signal is at the high level, the second clock signal CLK2 is at the low level, and when the second clock signal CLK2 is at the high level, the 0th clock signal CLK0 is at the low level; when the first clock signal CLK1 is at the high level, the third clock signal CLK3 is at the low level, and when the third clock signal CLK3 is at the high level, the first clock signal CLK1 is at the low level; and a period of time in which the n-th clock signal CLKn is at the high level overlaps with a period of time in which the (n+1)-th clock signal CLKn+1 is at the high level by a length of time no less than a third preset length of time, where n=0, 1, 2, 3, and when n+1>3, the (n+1)-th clock signal CLKn+1 is a mod((n+1)/4)-th clock signal CLK mod((n+1)/4); and In forward scanning, a period of time in which the first initial trigger signal STV1 is at the high level overlaps with the period of time in which the second clock signal CLK2 is at the high by a length of time no less than a period of time it takes to charge a gate of a transistor of a drive gate line in the first shift register unit ASG1 to the voltage at which the transistor can be turned on stably and no more than one cycle of the second clock signal CLK2, and a period of time in which the second initial trigger signal STV2 is at the high level overlaps with the period of time in which the third clock signal CLK3 is at the high level at a time by a length of time no less than a period of time it takes to charge a gate of a transistor of a drive gate line in the second shift register unit ASG2 to the voltage at which the transistor can be turned on stably and no more than one cycle of the third clock signal CLK3.

The respective shift register units in the gate drive apparatus illustrated in FIG. 21 each can be structured as the shift register unit illustrated in FIG. 19 or can alternatively be embodied as a shift register unit in another structure. The shift register units in the gate drive apparatus will not be limited in structure as long as scanning can be performed with the connection scheme illustrated in FIG. 21.

Figure 22A:
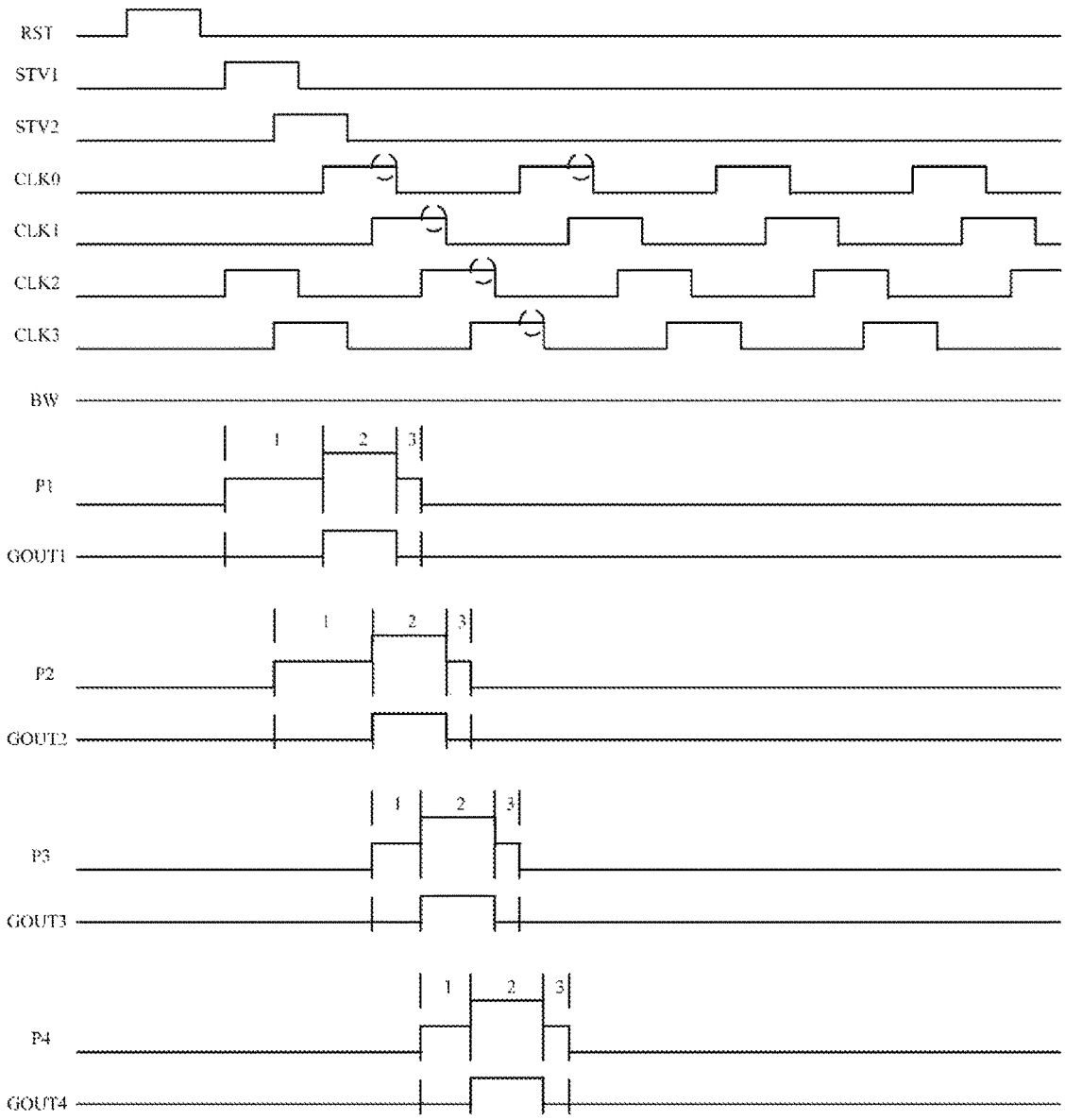
FIG. 22*a* is a timing diagram of the gate drive apparatus illustrated in FIG. 21 in forward scanning.
Figure 22B:
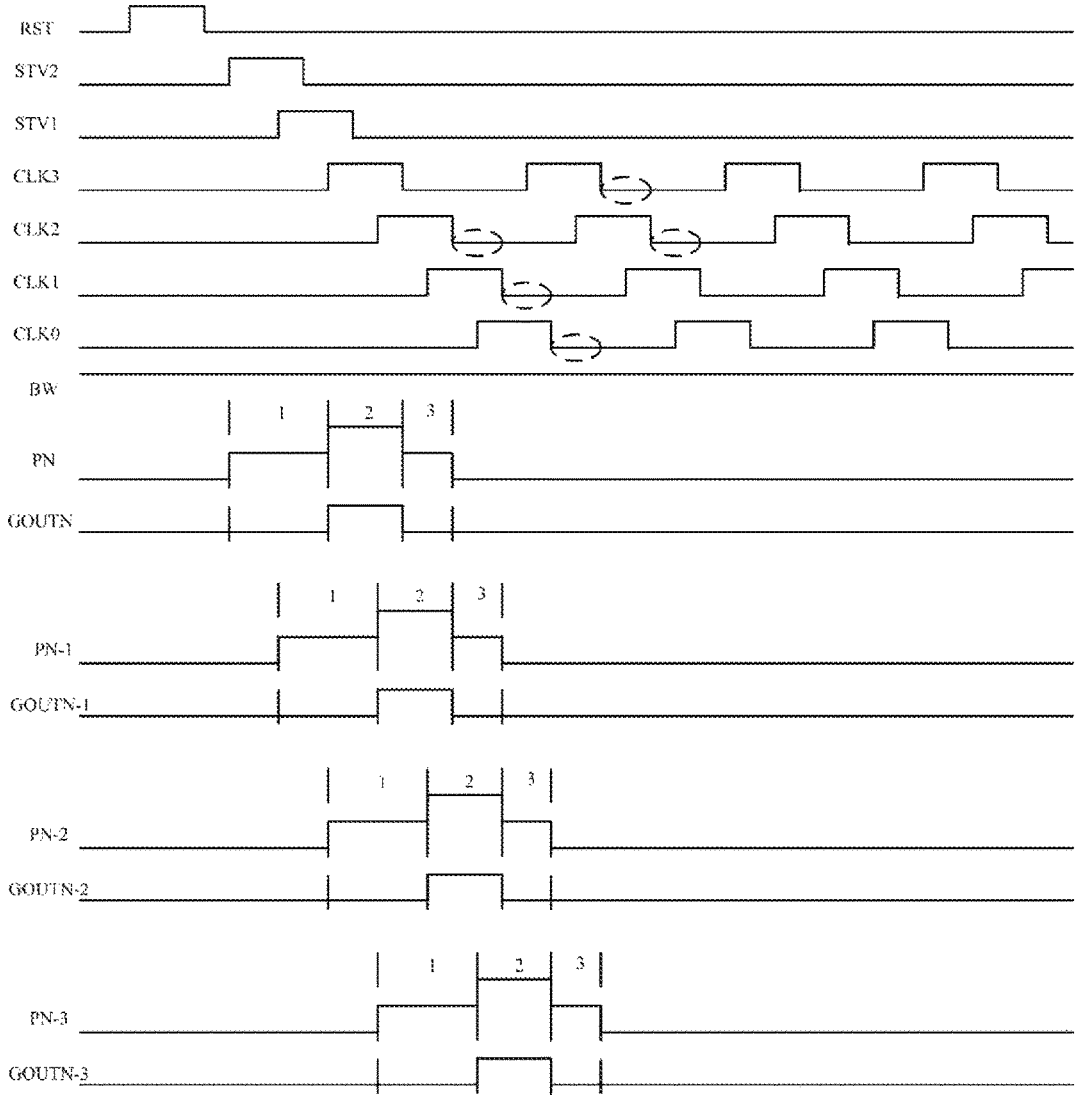
FIG. 22*b* is a timing diagram of the gate drive apparatus illustrated in FIG. 21 in backward scanning.

Operating timings of the gate drive apparatus illustrated in FIG. 21 in forward scanning and backward scanning will be described below by way of an example where the respective shift register units in the gate drive apparatus illustrated in FIG. 21 each are structured as the shift register unit illustrated in FIG. 19. FIG. 22*a* illustrates an operating timing diagram of the gate drive apparatus illustrated in FIG. 21 in forward scanning, and FIG. 22*b* illustrates an operating timing diagram of the gate drive apparatus illustrated in FIG. 21 in backward scanning, where FIG. 22*a* illustrates an operating timing diagram of only the first four shift register units in the gate drive apparatus, and FIG. 22*b* illustrates an operating timing diagram of only the last four shift register units in the gate drive apparatus.

In FIG. 22*a*, in a first period of time of the first shift register unit ASG1, the first initial trigger signal STV1 received by the forward select signal terminal GN−1 thereof is at the high level, and the tenth transistor T10 in the first shift register unit ASG1 is turned on, and in the meantime the second clock signal CLK2 received by the forward scan signal terminal FWIN thereof is at the high level, so the third capacitor C3 in the first shift register unit ASG1 starts to be charged, and when the third capacitor C3 is charged until the transistor of the drive gate line in the first shift register unit ASG1, i.e., the fourteenth transistor T14, can be turned on, the fourteenth transistor T14 is turned on, and the signal received by the clock block signal terminal CLKBIN of the first shift register unit ASG1, i.e., the 0th clock signal CLK0, will be output from the output terminal GOUT1 of the first shift register unit ASG1 through the fourteenth transistor T14, and in the first period of time of the first shift register unit ASG1, the 0th clock signal CLK0 is at the low level, so the output terminal GOUT1 of the first shift register unit ASG1 outputs a low level signal; and when the 0th clock signal CLK0 is changed from the low level to the high level, the first shift register unit ASG1 proceeds from the first period of time to a second period of time.

An operating principle of the first shift register unit ASG1 in FIG. 22*a* in a second period of time is the same as the operating principle of the first shift register unit ASG1 in FIG. 20*a* in the second period of time; and an operating principle of the first shift register unit ASG1 in FIG. 22*a* in a third period of time is the same as the operating principle of the first shift register unit ASG1 in FIG. 20*a* in the third period of time, where the first period of time, the second period of time and the third period of time of the first shift register unit ASG1 are periods of time in which the gate line connected with the first shift register unit ASG1 is enabled.

Since the third capacitor C3 in the first shift register unit ASG1 is charged when the first initial trigger signal STV1 is at the high level and the second clock signal CLK2 is at the high level, in order to ensure that the fourteenth transistor T14 in the first shift register unit ASG1 can be turned on stably, the period of time in which the first initial trigger signal STV1 is at the high level overlaps with the period of time in which the second clock signal CLK2 is at the high level by a length of time no less than the length of time it takes to charge the third capacitor C3 in the first shift register unit ASG1 to the voltage at which the fourteenth transistor T14 in the first shift register unit ASG1 can be turned on stably.

In FIG. 22*a*, in a first period of time of the second shift register unit ASG2, the second initial trigger signal STV2 received by the forward select signal terminal GN−1 thereof is at the high level, and the tenth transistor T10 in the second shift register unit ASG2 is turned on, and in the meantime the third clock signal CLK3 received by the forward scan signal terminal FWIN thereof is at the high level, so the third capacitor C3 in the second shift register unit ASG2 starts to be charged, and when the third capacitor C3 is charged until the transistor of the drive gate line in the second shift register unit ASG2, i.e., the fourteenth transistor T14, can be turned on, the fourteenth transistor T14 is turned on, and the signal received by the clock block signal terminal CLKBIN of the second shift register unit ASG2, i.e., the first clock signal CLK1, will be output from the output terminal GOUT2 of the second shift register unit ASG2 through the fourteenth transistor T14, and in the first period of time of the second shift register unit ASG2, the first clock signal CLK1 is at the low level, so the output terminal GOUT2 of the second shift register unit ASG2 outputs a low level signal; and when the first clock signal CLK1 is changed from the low level to the high level, the second shift register unit ASG2 proceeds from the first period of time to a second period of time.

An operating principle of the second shift register unit ASG2 in FIG. 22*a* in a second period of time is the same as the operating principle of the second shift register unit ASG2 in FIG. 20*a* in the second period of time; and an operating principle of the second shift register unit ASG2 in FIG. 22*a* in a third period of time is the same as the operating principle of the second shift register unit ASG2 in FIG. 20*a* in the third period of time, where the first period of time, the second period of time and the third period of time of the second shift register unit ASG2 are periods of time in which the gate line connected with the second shift register unit ASG2 is enabled.

Since the third capacitor C3 in the second shift register unit ASG2 is charged when the second initial trigger signal STV2 is at the high level and the third clock signal CLK3 is at the high level, in order to ensure that the fourteenth transistor T14 in the second shift register unit ASG2 can be turned on stably, the period of time in which the second initial trigger signal STV2 is at the high level overlaps with the period of time in which the third clock signal CLK3 is at the high level by a length of time no less than the length of time it takes to charge the third capacitor C3 in the second shift register unit ASG2 to the voltage at which the fourteenth transistor T14 in the second shift register unit ASG2 can be turned on stably.

In FIG. 22*a*, in a first period of time of the q-th (q=3, 4, . . . , N) shift register unit ASGq, when the output terminal GOUTq−2 of the (q−2)-th shift register unit ASGq−2 received by the forward select signal terminal GN−1 thereof is at the high level (when the mod((q−3)/4)-th clock signal CLK mod((q−3)/4) is at the high level, the output terminal GoutTq−2 of the (q−2)-th shift register unit ASGq−2 outputs a high level signal) and the mod((q−2)/4)-th clock signal CLK mod((q−2)/4) received by the forward scan signal terminal FWIN thereof is at the high level, the third capacitor C3 in the q-th shift register unit ASGq is charged, and when the third capacitor C3 is charged until the transistor of the drive gate line in the q-th shift register unit ASGq, i.e., the fourteenth transistor T14, can be turned on, the fourteenth transistor T14 is turned on, and the signal received by the clock block signal terminal CLKBIN of the q-th shift register unit ASGq, i.e., the mod((q−1)/4)-th clock signal CLK mod((q−1)/4), will be output from the output terminal GOUTq of the q-th shift register unit ASGq through the fourteenth transistor T14, and in the first period of time of the q-th shift register unit ASGq, the mod((q−1)/4)-th clock signal CLK mod((q−1)/4) is at the low level; and after the mod((q−1)/4)-th clock signal CLK mod((q−1)/4) is changed from the high level to the low level, the first period of time of the q-th shift register unit ASGq ends, and the q-th shift register unit ASGq proceeds to a second period of time.

An operating principle of the q-th shift register unit ASGq in FIG. 22*a* in a second period of time is the same as the operating principle of the q-th shift register unit ASGq in FIG. 20*a* in the second period of time; and an operating principle of the q-th shift register unit ASGq in FIG. 22*a* in a third period of time is the same as the operating principle of the q-th shift register unit ASGq in FIG. 20*a* in the third period of time, where the first period of time, the second period of time and the third period of time of the q-th shift register unit ASGq are periods of time in which the gate line connected with the q-th shift register unit ASGq is enabled.

Since after the mod((q−3)/4)-th clock signal CLK mod ((q−3)/4) is changed from the high level to the low level, the tenth transistor T10 in the q-th shift register unit ASGq is turned off, the third capacitor C3 in the q-th shift register unit ASGq will not be further charged but can only perform the storage function even if the mod((q−2)/4)-th clock signal CLK mod((q−2)/4) is at the high level. That is, the third capacitor C3 in the q-th shift register unit ASGq can be charged only when the mod((q−3)/4)-th clock signal CLK mod((q−3)/4) and the mod((q−2)/4)-th clock signal CLK mod((q−2)/4) is at the high level, so in order to ensure that the fourteenth transistor T14 in the q-th shift register unit ASGq can be turned on stably, the period of time in which the mod((q−3)/4)-th clock signal CLK mod((q−3)/4) is at the high level shall overlap with the period of time in which the mod((q−2)/4)-th clock signal CLK mod((q−2)/4) is at the high level by a length of time no less than the third preset length of time, where the third preset length of time is the length of time it takes to charge the third capacitor C3 in the q-th shift register unit ASGq to the voltage at which the fourteenth transistor T14 therein can be turned on stably; and where a period of time in which the third capacitor C3 in the q-th shift register unit ASGq can be charged is a period of time denoted in FIG. 22*a* by a dotted circle.

In FIG. 22*a*, since the signal received by the backward select signal terminal GN+1 of the (N−1)-th shift register unit ASGN−1 is the first initial trigger signal STV1 which will be at the high level to thereby trigger the start of scanning only when one frame starts to be scanned and which will be at the low level at other times, the backward select signal terminal GN+1 of the (N−1)-th shift register unit ASGN−1 will be at the high level only when one frame starts to be scanned and will be at the low level at other times, so the eleventh transistor T11 in the (N−1)-th shift register unit ASGN−1 can not be turned on so that the third capacitor C3 in the (N−1)-th shift register unit ASGN−1 can not be discharged through the eleventh transistor T11, so that the fourteenth transistor T14 in the (N−1)-th shift register unit ASGN−1 can not be turned off; and the fourteenth transistor T14 in the (N−1)-th shift register unit ASGN−1 can have the signal at the gate thereof (i.e., the signal stored on the third capacitor C3) released through the twelfth transistor T12 in the (N−1)-th shift register unit ASGN−1 (at this time the initial trigger signal terminal STVIN in the (N−1)-th shift register unit ASGN−1 is at the low level) to thereby be turned off only when the reset signal terminal RSTIN in the (N−1)-th shift register unit ASGN−1 receives a high level signal (that is, the reset signal RST is at the high level after the end of scanning a preceding frame and before the start of scanning a next frame); and when the reset signal RST is at the high level, the thirteenth transistor T13 in the (N−1)-th shift register unit ASGN−1 is turned on so that the gate line connected with the (N−1)-th shift register unit ASGN−1 receives a low level signal. Thus the third period of time of the (N−1)-th shift register unit ASGN−1 will end only when the reset signal terminal RSTIN thereof receives a high level signal (that is, the reset signal RST is changed from the low level signal to the high level signal).

In FIG. 22*a*, since the signal received by the backward select signal terminal GN+1 of the N-th shift register unit ASGN is the second initial trigger signal STV2 which will be at the high level to thereby trigger the start of scanning only when one frame starts to be scanned and which will be at the low level at other times, the backward select signal terminal GN+1 of the N-th shift register unit ASGN will be at the high level only when one frame starts to be scanned and will be at the low level at other times, so the eleventh transistor T11 in the N-th shift register unit ASGN can not be turned on so that the third capacitor C3 in the N-th shift register unit ASGN can not be discharged through the eleventh transistor T11, so the fourteenth transistor T14 in the N-th shift register unit ASGN can not be turned off; and the fourteenth transistor T14 in the N-th shift register unit ASGN can have the signal at the gate thereof (i.e., the signal stored on the third capacitor C3) released through the twelfth transistor T12 in the N-th shift register unit ASGN (at this time the initial trigger signal terminal STVIN in the (N−1)-th shift register unit ASGN−1 is at the low level) to thereby be turned off only when the reset signal terminal RSTIN in the N-th shift register unit ASGN receives a high level signal (that is, the reset signal RST is at the high level after the end of scanning a preceding frame and before the start of scanning a next frame); and when the reset signal RST is at the high level, the thirteenth transistor T13 in the N-th shift register unit ASGN is turned on so that the gate line connected with the N-th shift register unit ASGN receives a low level signal. Thus the third period of time of the N-th shift register unit ASGN will end only when the reset signal terminal RSTIN thereof receives a high level signal (that is, the reset signal RST is changed from the low level signal to the high level signal).

In FIG. 22*a*, with each of the shift register units, when the reset signal terminal RSTIN thereof receives a high level signal (that is, the reset signal RST is at the high level), the gate of the fourteenth transistor T14 therein will be connected with the initial trigger signal terminal STVIN, and since both the first initial trigger signal STV1 and the second initial trigger signal STV2 are at the low level when the reset signal RST is at the high level, the fourteenth transistor T14 will be turned off, and the gate line connected with the each shift register unit will also receive a low level signal to thereby eliminate an influence of a residual signal after the end of scanning the preceding frame upon the succeeding frame. Thus the reset signal, the first initial trigger signal and the second initial trigger signal can be used in place of a low level signal.

An operating principle of the N-th shift register unit ASGN in FIG. 22*b* in a first period of time is the same as the operating principle of the N-th shift register unit ASGN in FIG. 20*a* in the first period of time; and an operating principle of the N-th shift register unit ASGN in FIG. 22*b* in a second period of time is the same as the operating principle of the N-th shift register unit ASGN in FIG. 20*b* in the second period of time.

In FIG. 22*b*, in the third period of time of the N-th shift register unit ASGN, the second initial trigger signal STV2 is at the low level, so the eleventh transistor T11 in the N-th shift register unit ASGN is turned off, but due to the storage function of the third capacitor C3 in the N-th shift register unit ASGN, the fourteenth transistor T14 in the N-th shift register unit ASGN is still turned on, and since the third clock signal CLK3 is at the low level in this period of time, the output terminal GOUTN of the N-th shift register unit ASGN outputs a low level signal, when the forward select signal terminal GN−1 of the N-th shift register unit ASGN receives a high level signal and the forward scan signal terminal FWIN terminal thereof receives a low level signal, that is, the output terminal GOUTN−2 of the (N−2)-th shift register unit ASGN−2 outputs a high level signal (when the first clock signal CLK1 is at the high level, the output terminal GOUTN−2 of the (N−2)-th shift register unit ASGN−2 outputs a high level signal) and the second clock signal CLK2 is at the low level, the third capacitor C3 in the N-th shift register unit ASGN is discharged, and when it is discharged until the voltage at the gate of the fourteenth transistor T14 in the N-th shift register unit ASGN is below the voltage at which the fourteenth transistor T14 can be turned on, the fourteenth transistor T14 in the N-th shift register unit ASGN is turned off, and the third period of time of the N-th shift register unit ASGN ends, where the first period of time, the second period of time and the third period of time of the N-th shift register unit ASGN are periods of time in which the gate line connected with the N-th shift register unit ASGN is enabled.

Since the third capacitor C3 in the N-th shift register unit ASGN is discharged when the first clock signal CLK1 is at the high level and the second clock signal CLK2 is at the low level, in order to ensure that the fourteenth transistor T14 in the N-th shift register unit ASGN can be turned off, the period of time in which the first clock signal CLK1 is at the high level overlaps with the period of time in which the second clock signal CLK2 is at the low level by a length of time no less than the length of time it takes to discharge the third capacitor C3 in the N-th shift register unit ASGN to a voltage below the voltage at which the fourteenth transistor T14 in the N-th shift register unit ASGN can be turned off.

An operating principle of the (N−1)-th shift register unit ASGN−1 in FIG. 22*b* in a first period of time is the same as the operating principle of the (N−1)-th shift register unit ASGN−1 in FIG. 20*a* in the first period of time; and an operating principle of the (N−1)-th shift register unit ASGN−1 in FIG. 22*b* in a second period of time is the same as the operating principle of the (N−1)-th shift register unit ASGN−1 in FIG. 20*b* in the second period of time.

In FIG. 22*b*, in a third period of time of the (N−1)-th shift register unit ASGN−1, the first initial trigger signal STV1 is at the low level, so the eleventh transistor T11 in the (N−1)-th shift register unit ASGN−1 is turned off, but due to the storage function of the third capacitor C3 in the (N−1)-th shift register unit ASGN−1, the fourteenth transistor T14 in the (N−1)-th shift register unit ASGN−1 is still turned on, and since the second clock signal CLK2 is at the low level in this period of time, the output terminal GOUTN−1 of the (N−1)-th shift register unit ASGN−1 outputs a low level signal, when the forward select signal terminal GN−1 of the (N−1)-th shift register unit ASGN−1 receives a high level signal and the forward scan signal terminal FWIN thereof receives a low level signal, that is, the output terminal GOUTN−3 of the (N−3)-th shift register unit ASGN−3 outputs a high level signal (when the 0th clock signal CLK0 is at the high level, the output terminal GOUTN−3 of the (N−3)-th shift register unit ASGN−3 outputs a high level signal) and the first clock signal CLK1 is at the low level, the third capacitor C3 in the (N−1)-th shift register unit ASGN−1 is discharged, and when it is discharged until the voltage at the gate of the fourteenth transistor T14 in the (N−1)-th shift register unit ASGN−1 is below the voltage at which the fourteenth transistor T14 can be turned on, the fourteenth transistor T14 in the (N−1)-th shift register unit ASGN−1 is turned off, and the third period of time of the (N−1)-th shift register unit ASGN−1 ends, where the first period of time, the second period of time and the third period of time of the (N−1)-th shift register unit ASGN−1 are periods of time in which the gate line connected with the (N−1)-th shift register unit ASGN−1 is enabled.

Since the third capacitor C3 in the (N−1)-th shift register unit ASGN−1 is discharged when the 0th clock signal CLK0 is at the high level and the first clock signal CLK1 is at the low level, in order to ensure that the fourteenth transistor T14 in the (N−1)-th shift register unit ASGN−1 can be turned off, the period of time in which the 0th clock signal CLK0 is at the high level overlaps with the period of time in which the first clock signal CLK1 is at the low level by a length of time no less than the length of time it takes to discharge the third capacitor C3 in the (N−1)-th shift register unit ASGN−1 to a voltage below the voltage at which the fourteenth transistor T14 in the (N−1)-th shift register unit ASGN−1 can be turned on.

An operating principle of the q-th shift register unit ASGq in FIG. 22*b* in a first period of time is the same as the operating principle of the q-th shift register unit ASGq in FIG. 20*b* in the first period of time; and an operating principle of the q-th shift register unit ASGq in FIG. 22*b* in a second period of time is the same as the operating principle of the q-th shift register unit ASGq in FIG. 20*b* in the second period of time.

In FIG. 22*b*, in a third period of time of the q-th (q=1, 2, 3, 4, . . . , N−2) shift register unit ASGq, the mod((q+1)/4)-th clock signal CLK mod((q+1)/4) is at the low level, and the eleventh transistor T11 in the q-th shift register unit ASGq is turned off, but due to the storage function of the third capacitor C3 in the q-th shift register unit ASGq, the fourteenth transistor T14 in the q-th shift register unit ASGq is still turned on, and since the mod((q−1)/4)-th clock signal CLK mod((q−1)/4) is at the low level in this period of time, the output terminal GOUTq of the q-th shift register unit ASGq outputs a low level signal, and when the forward select signal terminal GN−1 of the q-th shift register unit ASGq receives a high level signal and the forward scan signal terminal FWIN thereof receives a low level signal, that is, the output terminal GOUTq−2 of the (q−2)-th shift register unit ASGq−2 outputs a high level signal (when the mod((q−3)/4)-th clock signal CLK mod((q−3)/4) is at the high level, the output terminal GOUTq−2 of the (q−2)-th shift register unit ASGq−2 outputs a high level signal) and the mod((q−2)/4)-th clock signal CLK mod((q−2)/4) is at the low level, the third capacitor C3 in the q-th shift register unit ASGq is discharged, and when it is discharged until the voltage at the gate of the fourteenth transistor T14 in the q-th shift register unit ASGq is below the voltage at which the fourteenth transistor T14 can be turned on, the fourteenth transistor T14 in the q-th shift register unit ASGq is turned off, and the third period of time of the q-th shift register unit ASGq ends, where the first period of time, the second period of time and the third period of time of the q-th shift register unit ASGq are periods of time in which the gate line connected with the q-th shift register unit ASGq is enabled.

Since in the third period of time of the q-th shift register unit ASGq, the third capacitor C3 in the q-th shift register unit ASGq can be discharged only when the mod((q−3)/4)-th clock signal CLK mod((q−3)/4) is at the high level and the mod((q−2)/4)-th clock signal CLK mod((q−2)/4) is at the low level, in order to ensure that the fourteenth transistor T14 in the q-th shift register unit ASGq can be turned off, the period of time in which the mod((q−3)/4)-th clock signal CLK mod((q−3)/4) is at the high level shall overlap with the period of time in which the mod((q−2)/4)-th clock signal CLK mod((q−2)/4) is at the low level by a length of time no less than the length of time it takes to discharge the third capacitor C3 in the q-th shift register unit ASGq until the voltage at the gate of the fourteenth transistor T14 therein is below the voltage at which the fourteenth transistor T14 can be turned on, where a period of time in which the third capacitor C3 in the q-th shift register unit ASGq can be discharged is a period of time denoted in FIG. 22*b* by a dotted ellipse.

In FIG. 22*b*, since the signal received by the forward select signal terminal GN−1 of the first shift register unit ASG1 is the first initial trigger signal STV1 which will be at the high level to thereby trigger the start of scanning only when one frame starts to be scanned and which will be at the low level at other times, the forward select signal terminal GN−1 of the first shift register unit ASG1 will be at the high level only when one frame starts to be scanned and will be at the low level at other times, so the tenth transistor T10 in the first shift register unit ASG1 can not be turned on so that the third capacitor C3 in the first shift register unit ASG1 can not be discharged through the tenth transistor T10, so that the fourteenth transistor T14 in the first shift register unit ASG1 can not be turned off; and the fourteenth transistor T14 in the first shift register unit ASG1 can have the signal at the gate thereof (i.e., the signal stored on the third capacitor C3) released through the twelfth transistor T12 in the first shift register unit ASG1 (at this time the initial trigger signal terminal STVIN of the first shift register unit ASG1 is at the low level) to thereby be turned off only when the reset signal terminal RSTIN in the first shift register unit ASG1 receives a high level signal (that is, the reset signal RST is at the high level after the end of scanning a preceding frame and before the start of scanning a next frame); and when the reset signal RST is at the high level, the thirteenth transistor T13 in the first shift register unit ASG1 is turned on so that the gate line connected with the first shift register unit ASG1 receives a low level signal. Thus the third period of time of the first shift register unit ASG1 will end only when the reset signal terminal RSTIN thereof receives a high level signal (that is, the reset signal RST is changed from the low level signal to the high level signal).

In FIG. 22*b*, since the signal received by the forward select signal terminal GN−1 of the second shift register unit ASG2 is the second initial trigger signal STV2 which will be at the high level to thereby trigger the start of scanning only when one frame starts to be scanned and which will be at the low level at other times, the forward select signal terminal GN−1 of the second shift register unit ASG2 will be at the high level only when one frame starts to be scanned and will be at the low level at other times, so the tenth transistor T10 in the second shift register unit ASG2 can not be turned on so that the third capacitor C3 in the second shift register unit ASG2 can not be discharged through the tenth transistor T10, so that the fourteenth transistor T14 in the second shift register unit ASG2 can not be turned off; and the fourteenth transistor T14 in the second shift register unit ASG2 can have the signal at the gate thereof (i.e., the signal stored on the third capacitor C3) released through the twelfth transistor T12 in the second shift register unit ASG2 (at this time the initial trigger signal terminal STVIN of the second shift register unit ASG2 is at the low level) to thereby be turned off only when the reset signal terminal RSTIN in the second shift register unit ASG2 receives a high level signal (that is, the reset signal RST is at the high level after the end of scanning a preceding frame and before the start of scanning a next frame); and when the reset signal RST is at the high level, the thirteenth transistor T13 in the second shift register unit ASG2 is turned on so that the gate line connected with the second shift register unit ASG2 receives a low level signal. Thus the third period of time of the second shift register unit ASG2 will end only when the reset signal terminal RSTIN thereof receives a high level signal (that is, the reset signal RST is changed from the low level signal to the high level signal).

In FIG. 22*b*, with each of the shift register units, when the reset signal terminal RSTIN thereof receives a high level signal (that is, the reset signal RST is at the high level), the gate of the fourteenth transistor T14 therein will be connected with the initial trigger signal terminal STVIN, and since both the first initial trigger signal STV1 and the second initial trigger signal STV2 are at the low level when the reset signal RST is at the high level, the fourteenth transistor T14 will be turned off, and the gate line connected with the each shift register unit will also receive a low level signal to thereby eliminate an influence of a residual signal after the end of scanning the preceding frame upon the succeeding frame.

Figure 23:
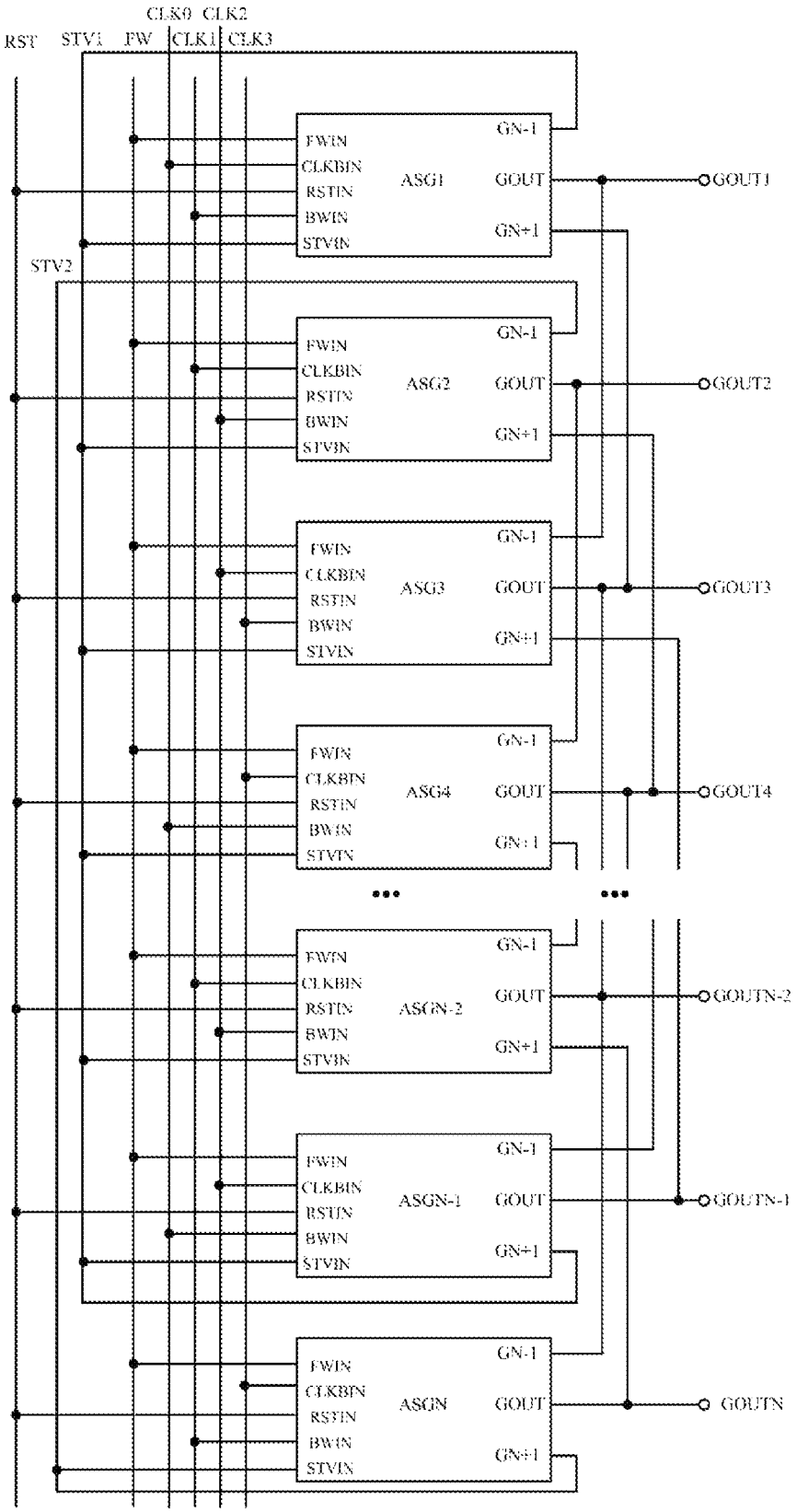
FIG. 23 is an eighth schematic structural diagram of a gate drive apparatus according to an embodiment of the present invention.

Furthermore respective clocks signals can also be reused as backward scan signals BWs in a gate drive apparatus according to an embodiment of the invention, and the gate drive apparatus can be structured as illustrated in FIG. 23. The gate drive apparatus in FIG. 23 is different from the gate drive apparatus in FIG. 17 in that a transmission line is required to be specially arranged to transmit the backward scan signals received by the respective register units in the gate drive apparatus illustrated in FIG. 17, and the clock signals can be reused as the backward scan signals received by the respective register units in the gate drive apparatus illustrated in FIG. 23. The clock signals can be reused as the backward scan signals received by the respective register units in the gate drive apparatus illustrated in FIG. 23 particularly as follows: a signal received by a backward scan signal terminal BWIN of each of the shift register units other than the last two shift register units is the same as the signal received by the clock block signal terminal CLKBIN of the succeeding shift register unit to the shift register unit, a backward scan signal terminal BWIN of the (N−1)-th shift register unit ASGN−1 receives a mod((mod((N−2)/4)+2)/4)-th clock signal CLK mod((mod((N−2)/4)+2)/4), and a backward scan signal terminal BWIN of the N-th shift register unit ASGN receives a mod((mod((N−1)/4)+2)/4)-th clock signal CLK mod((mod((N−1)/4)+2)/4); when the 0th clock signal is at the high level, the second clock signal CLK2 is at the low level, and when the second clock signal CLK2 is at the high level, the 0th clock signal CLK0 is at the low level; when the first clock signal CLK1 is at the high level, the third clock signal CLK3 is at the low level, and when the third clock signal CLK3 is at the high level, the first clock signal CLK1 is at the low level; and a period of time in which the n-th clock signal CLKn is at the high level overlaps with a period of time in which the (n+1)-th clock signal CLKn+1 is at the high level by a length of time no less than a fourth preset length of time, where n=0, 1, 2, 3, and when n+1>3, the (n+1)-th clock signal CLKn+1 is a mod ((n+1)/4)-th clock signal CLK mod((n+1)/4); and In backward scanning, if N represents an odd number, then a period of time in which the first initial trigger signal STV1 is at the high level overlaps with the period of time in which the mod((mod((N−1)/4)+2)/4)-th clock signal CLK mod((mod((N−1)/4)+2)/4) is at the high level at a time by a length of time no less than a period of time it takes to charge a gate of a transistor of a drive gate line in the N-th shift register unit ASGN to the voltage at which the transistor can be turned on stably and no more than one cycle of the mod((mod((N−1)/4)+2)/4)-th clock signal CLK mod((mod ((N−1)/4)+2)/4), and a period of time in which the second initial trigger signal STV2 is at the high level overlaps with the period of time in which the mod((mod((N−2)/4)+2)/4)-th clock signal CLK mod((mod((N−2)/4)+2)/4) is at the high level at a time by a length of time no less than a period of time it takes to charge a gate of a transistor of a drive gate line in the (N−1)-th shift register unit ASGN−1 to the voltage at which the transistor can be turned on stably and no more than one cycle of the mod((mod((N−2)/4)+2)/4)-th clock signal CLK mod((mod((N−2)/4)+2)/4); and if N represents an even number, then the period of time in which the first initial trigger signal STV1 is at the high level overlaps with the period of time in which the mod((mod((N−2)/4)+2)/4)-th clock signal CLK mod((mod((N−2)/4)+2)/4) is at the high level at a time by a length of time no less than a period of time it takes to charge the gate of the transistor of the drive gate line in the (N−1)-th shift register unit ASGN−1 to the voltage at which the transistor can be turned on stably and no more than one cycle of the mod((mod((N−2)/4)+2)/4)-th clock signal CLK mod((mod((N−2)/4)+2)/4), and the period of time in which the second initial trigger signal STV2 is at the high level overlaps with the period of time in which the mod((mod((N−1)/4)+2)/4)-th clock signal CLK mod((mod((N−1)/4)+2)/4) is at the high level at a time by a length of time no less than a period of time it takes to charge the gate of the transistor of the drive gate line in the N-th shift register unit ASGN to the voltage at which the transistor can be turned on stably and no more than one cycle of the mod((mod((N−1)/4)+2)/4)-th clock signal CLK mod ((mod((N−1)/4)+2)/4).

The respective shift register units in the gate drive apparatus illustrated in FIG. 23 each can be structured as the shift register unit illustrated in FIG. 19 or can alternatively be embodied as a shift register unit in another structure. The shift register units in the gate drive apparatus will not be limited in structure as long as scanning can be performed with the connection scheme illustrated in FIG. 23.

Figure 24A:
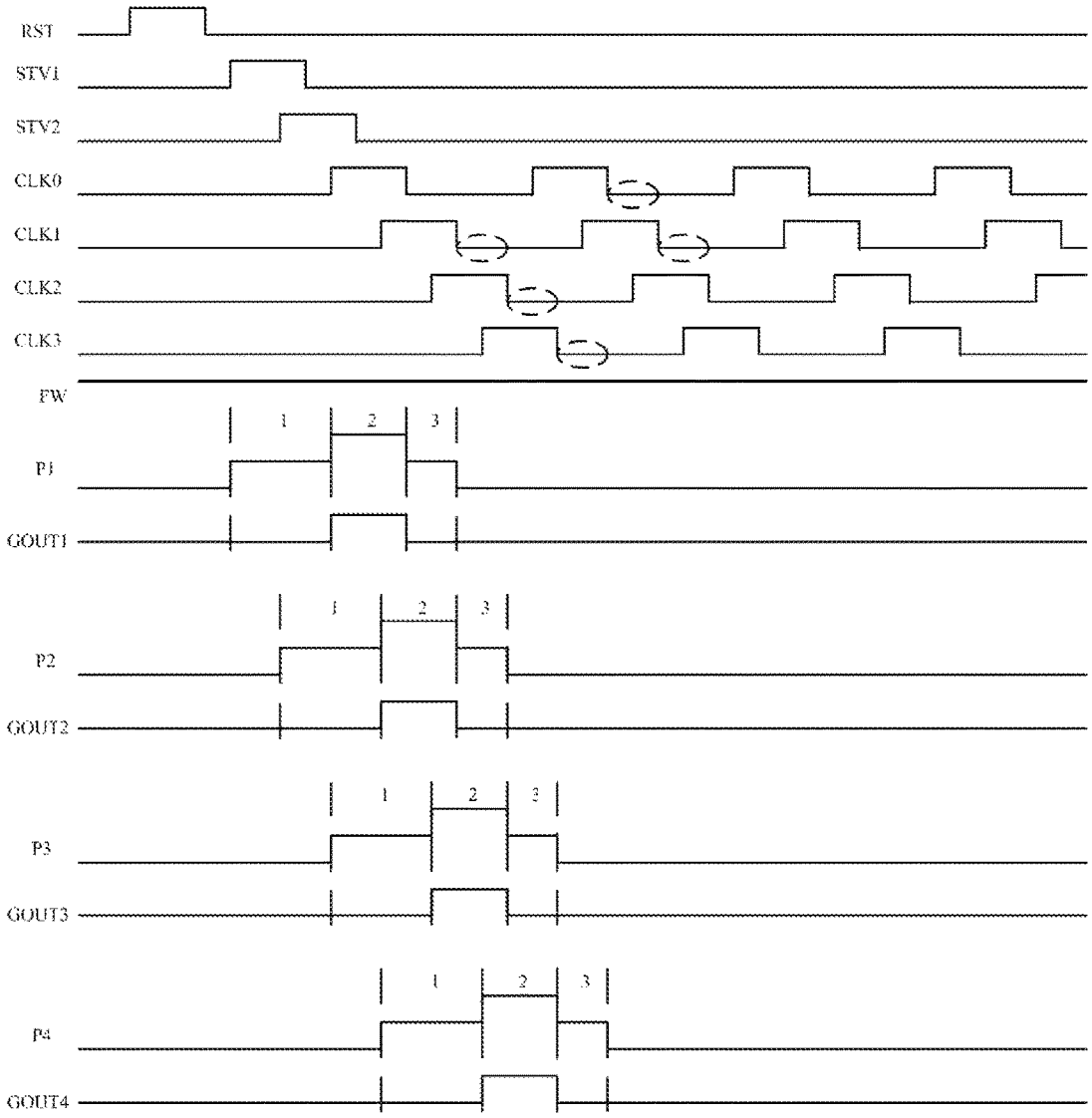
FIG. 24*a* is a timing diagram of the gate drive apparatus illustrated in FIG. 23 in forward scanning.
Figure 24B:
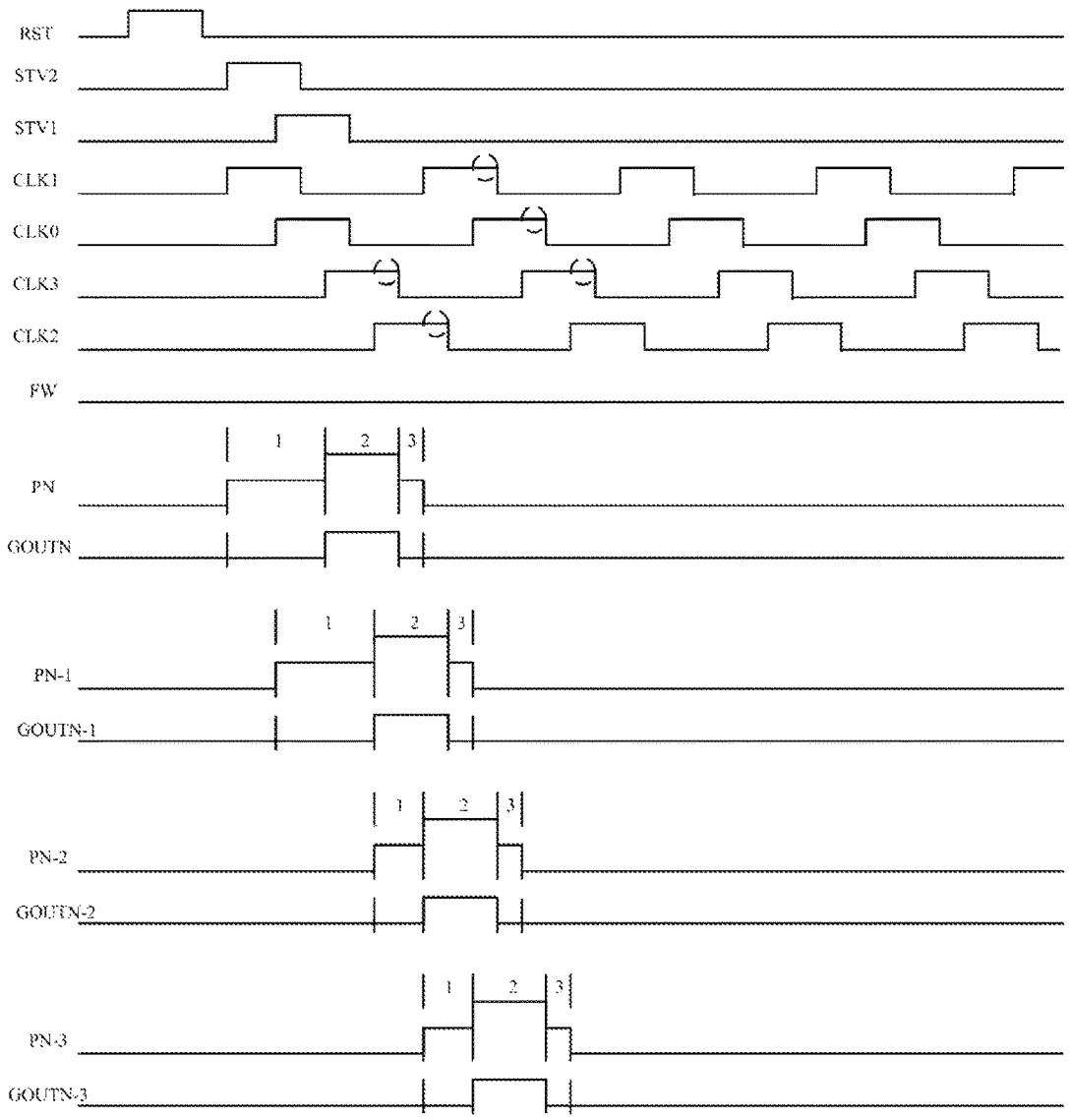
FIG. 24*b* is a timing diagram of the gate drive apparatus illustrated in FIG. 23 in backward scanning.

Operating timings of the gate drive apparatus illustrated in FIG. 23 in forward scanning and backward scanning will be described below by way of an example where the respective shift register units in the gate drive apparatus illustrated in FIG. 23 each are structured as the shift register unit illustrated in FIG. 19. FIG. 24*a* illustrates an operating timing diagram of the gate drive apparatus illustrated in FIG. 23 in forward scanning, and FIG. 24*b* illustrates an operating timing diagram of the gate drive apparatus illustrated in FIG. 23 in backward scanning, where FIG. 24*a* illustrates an operating timing diagram of only the first four shift register units in the gate drive apparatus, and FIG. 24*b* illustrates an operating timing diagram of only the last four shift register units in the gate drive apparatus.

An operating principle of the first shift register unit ASG1 in FIG. 24*a* in a first period of time is the same as the operating principle of the first shift register unit ASG1 in FIG. 20*a* in the first period of time; and an operating principle of the first shift register unit ASG1 in FIG. 24*a* in a second period of time is the same as the operating principle of the first shift register unit ASG1 in FIG. 20*a* in the second period of time.

In FIG. 24*a*, in a third period of time of the first shift register unit ASG1, the first initial trigger signal STV1 is at the low level, so the tenth transistor T10 in the first shift register unit ASG1 is turned off, but due to the storage function of the third capacitor C3 in the first shift register unit ASG1, the fourteenth transistor T14 in the first shift register unit ASG1 is still turned on, and since the 0th clock signal CLK0 is at the low level in this period of time, the output terminal GOUT1 of the first shift register unit ASG1 outputs a low level signal, when the backward select signal terminal GN+1 of the first shift register unit ASG1 receives a high level signal and the backward scan signal terminal BWIN thereof receives a low level signal, that is, the output terminal GOUT3 of the third shift register unit ASG3 outputs a high level signal (when the second clock signal CLK2 is at the high level, the output terminal GOUT3 of the third shift register unit ASG3 outputs a high level signal) and the first clock signal CLK1 is at the low level, the third capacitor C3 in the first shift register unit ASG1 is discharged, and when it is discharged until the voltage at the gate of the fourteenth transistor T14 in the first shift register unit ASG1 is below the voltage at which the fourteenth transistor T14 can be turned on, the fourteenth transistor T14 in the first shift register unit ASG1 is turned off, and the third period of time of the first shift register unit ASG1 ends, where the first period of time, the second period of time and the third period of time of the first shift register unit ASG1 are periods of time in which the gate line connected with the first shift register unit ASG1 is enabled.

Since the third capacitor C3 in the first shift register unit ASG1 is discharged when the second clock signal CLK2 is at the high level and the first clock signal CLK1 is at the low level, in order to ensure that the fourteenth transistor T14 in the first shift register unit ASG1 can be turned on stably, the period of time in which the second clock signal CLK2 is at the high level is at the high level overlaps with the period of time in which the first clock signal CLK1 is at the low level by a length of time no less than the length of time it takes to discharge the third capacitor C3 in the first shift register unit ASG1 to a voltage below the voltage at which the fourteenth transistor T14 in the first shift register unit ASG1 can be turned on stably.

An operating principle of the second shift register unit ASG2 in FIG. 24*a* in a first period of time is the same as the operating principle of the second shift register unit ASG2 in FIG. 20*a* in the first period of time; and an operating principle of the second shift register unit ASG2 in FIG. 24*a* in a second period of time is the same as the operating principle of the second shift register unit ASG2 in FIG. 20*a* in the second period of time.

As illustrated in FIG. 24*a*, in a third period of time of the second shift register unit ASG2, the second initial trigger signal STV2 is at the low level, and the tenth transistor T10 in the second shift register unit ASG2 is turned off, but due to the storage function of the third capacitor C3 in the second shift register unit ASG2, the fourteenth transistor T14 in the second shift register unit ASG2 is still turned on, and since the first clock signal CLK1 is at the low level in this period of time, the output terminal GOUT2 of the second shift register unit ASG2 outputs a low level signal, when the backward select signal terminal GN+1 of the second shift register unit ASG2 receives a high level signal and the backward scan signal terminal BWIN thereof receives a low level signal, that is, the output terminal GOUT4 of the fourth shift register unit ASG4 outputs a high level signal (when the third clock signal CLK3 is at the high level, the output terminal GOUT4 of the fourth shift register unit ASG4 outputs a high level signal) and the second clock signal CLK2 is at the low level, the third capacitor C3 in the second shift register unit ASG2 is discharged, and when it is discharged until the voltage at the gate of the fourteenth transistor T14 in the second shift register unit ASG2 is below the voltage at which the fourteenth transistor T14 can be turned on, the fourteenth transistor T14 in the second shift register unit ASG2 is turned off, and the third period of time of the second shift register unit ASG2 ends, where the first period of time, the second period of time and the third period of time of the second shift register unit ASG2 are periods of time in which the gate line connected with the second shift register unit ASG2 is enabled.

Since the third capacitor C3 in the second shift register unit ASG2 is discharged when the third clock signal CLK3 is at the high level and the third clock signal CLK2 is at the low level, in order to ensure that the fourteenth transistor T14 in the second shift register unit ASG2 can be turned off, the period of time in which the third clock signal CLK3 is at the high level overlaps with the period of time in which the second clock signal CLK2 is at the low level by a length of time no less than the length of time it takes to discharge the third capacitor C3 in the second shift register unit ASG2 until the voltage at the gate of the fourteenth transistor T14 in the second shift register unit ASG2 is below the voltage at which the fourteenth transistor T14 can be turned on.

An operating principle of the q-th (q=3, 4, . . . , N) shift register unit ASGq in FIG. 20*a* in a first period of time is the same as the operating principle of the q-th shift register unit ASGq in FIG. 24*a* in the first period of time; and an operating principle of the q-th shift register unit ASGq in FIG. 20*a* in a second period of time is the same as the operating principle of the q-th shift register unit ASGq in FIG. 24*a* in the second period of time.

In FIG. 24*a*, in a third period of time of the q-th shift register unit ASGq, the mod((q−3)/4)-th clock signal CLK mod((q−3)/4) is at the low level, and the tenth transistor T10 in the q-th shift register unit ASGq is turned off, but due to the storage function of the third capacitor C3 in the q-th shift register unit ASGq, the fourteenth transistor T14 in the q-th shift register unit ASGq is still turned on, and since the mod((q−1)/4)-th clock signal CLK mod((q−1)/4) is at the low level in this period of time, the output terminal GOUTq of the q-th shift register unit ASGq outputs a low level signal, and when the backward select signal terminal GN+1 of the q-th shift register unit ASGq receives a high level signal and the backward scan signal terminal BWIN thereof receives a low level signal, that is, the output terminal GOUTq+2 of the (q+2)-th shift register unit ASGq+2 outputs a high level signal (when the mod((q+1)/4)-th clock signal CLK mod((q+1)/4) is at the high level, the output terminal GOUTq+2 of the (q+2)-th shift register unit ASGq+2 outputs a high level signal) and the mod(q/4)-th clock signal CLK mod(q/4) is at the low level, the third capacitor C3 in the q-th shift register unit ASGq is discharged, and when it is discharged until the voltage at the gate of the fourteenth transistor T14 in the q-th shift register unit ASGq is below the voltage at which the fourteenth transistor T14 can be turned on, the fourteenth transistor T14 in the q-th shift register unit ASGq is turned off, and the third period of time of the q-th shift register unit ASGq ends.

Particularly the first period of time, the second period of time and the third period of time of the q-th shift register unit ASGq are periods of time in which the gate line connected with the q-th shift register unit ASGq is enabled.

In FIG. 24*a*, since in the third period of time of the q-th shift register unit ASGq, the third capacitor C3 in the q-th shift register unit ASGq can be discharged only when the mod((q+1)/4)-th clock signal CLK mod((q+1)/4) is at the high level and the mod(q/4)-th clock signal CLK mod(q/4) is at the low level, in order to ensure that the fourteenth transistor T14 in the q-th shift register unit ASGq can be turned off, the period of time in which the mod((q+1)/4)-th clock signal CLK mod((q+1)/4) is at the high level shall overlap with the period of time in which the mod(q/4)-th clock signal CLK mod(q/4) is at the low level by a length of time no less than the length of time it takes to discharge the third capacitor C3 in the q-th shift register unit ASGq to a voltage below the voltage at which the fourteenth transistor T14 in the q-th shift register unit ASGq can be turned on, where a period of time in which the third capacitor C3 in the q-th shift register unit ASGq can be discharged is a period of time denoted in FIG. 24*a* by a dotted ellipse.

In FIG. 24*a*, since the signal received by the backward select signal terminal GN+1 of the (N−1)-th shift register unit ASGN−1 is the first initial trigger signal STV1 which will be at the high level to thereby trigger the start of scanning only when one frame starts to be scanned and which will be at the low level at other times, the backward select signal terminal GN+1 of the (N−1)-th shift register unit ASGN−1 will be at the high level only when one frame starts to be scanned and will be at the low level at other times, so the eleventh transistor T11 in the (N−1)-th shift register unit ASGN−1 can not be turned on so that the third capacitor C3 in the (N−1)-th shift register unit ASGN−1 can not be discharged through the eleventh transistor T11, so that the fourteenth transistor T14 in the (N−1)-th shift register unit ASGN−1 can not be turned off; and the fourteenth transistor T14 in the (N−1)-th shift register unit ASGN−1 can have the signal at the gate thereof (i.e., the signal stored on the third capacitor C3) released through the twelfth transistor T12 in the (N−1)-th shift register unit ASGN−1 (at this time the initial trigger signal terminal STVIN in the (N−1)-th shift register unit ASGN−1 is at the low level) to thereby be turned off only when the reset signal terminal RSTIN in the (N−1)-th shift register unit ASGN−1 receives a high level signal (that is, the reset signal RST is at the high level after the end of scanning a preceding frame and before the start of scanning a next frame); and when the reset signal RST is at the high level, the thirteenth transistor T13 in the (N−1)-th shift register unit ASGN−1 is turned on so that the gate line connected with the (N−1)-th shift register unit ASGN−1 receives a low level signal. Thus the third period of time of the (N−1)-th shift register unit ASGN−1 will end only when the reset signal terminal RSTIN thereof receives a high level signal (that is, the reset signal RST is changed from the low level signal to the high level signal).

In FIG. 24*a*, since the signal received by the backward select signal terminal GN+1 of the N-th shift register unit ASGN is the second initial trigger signal STV2 which will be at the high level to thereby trigger the start of scanning only when one frame starts to be scanned and which will be at the low level at other times, the backward select signal terminal GN+1 of the N-th shift register unit ASGN will be at the high level only when one frame starts to be scanned and will be at the low level at other times, so the eleventh transistor T11 in the N-th shift register unit ASGN can not be turned on so that the third capacitor C3 in the N-th shift register unit ASGN can not be discharged through the eleventh transistor T11, so the fourteenth transistor T14 in the N-th shift register unit ASGN can not be turned off; and the fourteenth transistor T14 in the N-th shift register unit ASGN can have the signal at the gate thereof (i.e., the signal stored on the third capacitor C3) released through the twelfth transistor T12 in the N-th shift register unit ASGN (at this time the initial trigger signal terminal STVIN in the (N−1)-th shift register unit ASGN−1 is at the low level) to thereby be turned off only when the reset signal terminal RSTIN in the N-th shift register unit ASGN receives a high level signal (that is, the reset signal RST is at the high level after the end of scanning a preceding frame and before the start of scanning a next frame); and when the reset signal RST is at the high level, the thirteenth transistor T13 in the N-th shift register unit ASGN is turned on so that the gate line connected with the N-th shift register unit ASGN receives a low level signal. Thus the third period of time of the N-th shift register unit ASGN will end only when the reset signal terminal RSTIN thereof receives a high level signal (that is, the reset signal RST is changed from the low level signal to the high level signal).

In FIG. 24*a*, with each of the shift register units, when the reset signal terminal RSTIN thereof receives a high level signal (that is, the reset signal RST is at the high level), the gate of the fourteenth transistor T14 therein will be connected with the initial trigger signal terminal STVIN, and since both the first initial trigger signal STV1 and the second initial trigger signal STV2 are at the low level when the reset signal RST is at the high level, the fourteenth transistor T14 will be turned off, and the gate line connected with the each shift register unit will also receive a low level signal to thereby eliminate an influence of a residual signal after the end of scanning the preceding frame upon the succeeding frame. Thus the reset signal, the first initial trigger signal and the second initial trigger signal can be used in place of a low level signal.

In FIG. 24*b*, in a first period of time of the N-th (N represents an integer multiple of 4) shift register unit ASGN, the second initial trigger signal STV2 received by the backward select signal terminal GN+1 thereof is at the high level, and the eleventh transistor T11 in the N-th shift register unit ASGN is turned on, and in the meantime the first clock signal CLK1 received by the backward scan signal terminal BWIN thereof is at the high level, so the third capacitor C3 in the N-th shift register unit ASGN starts to be charged, and when the third capacitor C3 is charged until the transistor of the drive gate line in the N-th shift register unit ASGN, i.e., the fourteenth transistor T14, can be turned on, the fourteenth transistor T14 is turned on, and the signal received by the clock block signal terminal CLKBIN of the N-th shift register unit ASGN, i.e., the third clock signal CLK3, will be output from the output terminal GOUTN of the N-th shift register unit ASGN through the fourteenth transistor T14, and in the first period of time of the N-th shift register unit ASGN, the third clock signal CLK3 is at the low level, so the output terminal GOUTN of the N-th shift register unit ASGN outputs a low level signal; and when the third clock signal CLK3 is changed from the low level to the high level, the N-th shift register unit ASGN proceeds from the first period of time to a second period of time.

An operating principle of the N-th shift register unit ASGN in FIG. 24*b* in a second period of time is the same as the operating principle of the N-th shift register unit ASGN in FIG. 20*a* in the second period of time; and an operating principle of the N-th shift register unit ASGN in FIG. 24*b* in a third period of time is the same as the operating principle of the N-th shift register unit ASGN in FIG. 20*b* in the third period of time.

Since the third capacitor C3 in the N-th shift register unit ASGN is discharged when the second initial trigger signal STV2 is at the high level and the first clock signal CLK1 is at the high level, in order to ensure that the fourteenth transistor T14 in the N-th shift register unit ASGN can be turned on stably, the period of time in which the second initial trigger signal STV2 is at the high level overlaps with the period of time in which the first clock signal CLK1 is at the high level by a length of time no less than the length of time it takes to charge the third capacitor C3 in the N-th shift register unit ASGN to the voltage at which the fourteenth transistor T14 in the N-th shift register unit ASGN can be turned off.

In FIG. 24*b*, in a first period of time of the (N−1)-th shift register unit ASGN−1, the first initial trigger signal STV1 received by the backward select signal terminal GN+1 thereof is at the high level, and the eleventh transistor T11 in the (N−1)-th shift register unit ASGN−1 is turned on, and in the meantime the 0th clock signal CLK0 received by the backward scan signal terminal BWIN thereof is at the high level, so the third capacitor C3 in the (N−1)-th shift register unit ASGN−1 starts to be charged, and when the third capacitor C3 is charged until the transistor of the drive gate line in the (N−1)-th shift register unit ASGN−1, i.e., the fourteenth transistor T14, can be turned on, the fourteenth transistor T14 is turned on, and the signal received by the clock block signal terminal CLKBIN of the (N−1)-th shift register unit ASGN−1, i.e., the second clock signal CLK2, will be output from the output terminal GOUTN−1 of the (N−1)-th shift register unit ASGN−1 through the fourteenth transistor T14, and in the first period of time of the (N−1)-th shift register unit ASGN−1, the second clock signal CLK2 is at the low level, so the output terminal GOUTN−1 of the (N−1)-th shift register unit ASGN−1 outputs a low level signal; and when the second clock signal CLK2 is changed from the low level to the high level, the (N−1)-th shift register unit ASGN−1 proceeds from the first period of time to a second period of time.

An operating principle of the (N−1)-th shift register unit ASGN−1 in FIG. 24*b* in a second period of time is the same as the operating principle of the (N−1)-th shift register unit ASGN−1 in FIG. 20*a* in the second period of time; and an operating principle of the (N−1)-th shift register unit ASGN−1 in FIG. 24*b* in a third period of time is the same as the operating principle of the (N−1)-th shift register unit ASGN−1 in FIG. 20*b* in the third period of time.

In FIG. 24*b*, since the third capacitor C3 in the (N−1)-th shift register unit ASGN−1 is discharged when the first initial trigger signal STV1 is at the high level and the 0th clock signal CLK0 is at the high level, in order to ensure that the fourteenth transistor T14 in the (N−1)-th shift register unit ASGN−1 can be turned on stably, the period of time in which the first initial trigger signal STV1 is at the high level overlaps with the period of time in which the 0th clock signal CLK0 is at the high level by a length of time no less than the length of time it takes to charge the third capacitor C3 in the (N−1)-th shift register unit ASGN−1 to the voltage at which the fourteenth transistor T14 in the (N−1)-th shift register unit ASGN−1 can be turned on.

Particularly the first period of time, the second period of time and the third period of time of the (N−1)-th shift register unit ASGN−1 are periods of time in which the gate line connected with the (N−1)-th shift register unit ASGN−1 is enabled.

In FIG. 24*b*, in a first period of time of the q-th (q=1, 2, 3, 4, . . . , N−2) shift register unit ASGq, when the output terminal GOUTq+2 of the (q+2)-th shift register unit ASGq+2 received by the backward select signal terminal GN+1 thereof is at the high level (when the mod((q+1)/4)-th clock signal CLK mod((q+1)/4) is at the high level, the output terminal GOUTq+2 of the (q+2)-th shift register unit ASGq+2 outputs a high level signal), and the mod(q/4)-th clock signal CLK mod(q/4) received by the backward scan signal terminal BWIN thereof is at the high level, the third capacitor C3 in the q-th shift register unit ASGq is charged, and when the third capacitor C3 is charged until the transistor of the drive gate line in the q-th shift register unit ASGq, i.e., the fourteenth transistor T14, can be turned on, the fourteenth transistor T14 is turned on, and the signal received by the clock block signal terminal CLKBIN of the q-th shift register unit ASGq, i.e., the mod((q−1)/4)-th clock signal CLK mod((q−1)/4), will be output from the output terminal GOUTq of the q-th shift register unit ASGq through the fourteenth transistor T14, and in the first period of time of the q-th shift register unit ASGq, the mod((q−1)/4)-th clock signal CLK mod((q−1)/4) is at the low level, so the output terminal GOUTq of the q-th shift register unit ASGq outputs a low level signal; and after the mod((q+1)/4)-th clock signal CLK mod((q+1)/4) is changed from the high level to the low level, the third capacitor C3 in the q-th shift register unit ASGq will not be further charged but can only perform the storage function, and after the mod((q−1)/4)-th clock signal CLK mod((q−1)/4) is changed from the low level to the high level, the first period of time of the q-th shift register unit ASGq ends, and the q-th shift register unit ASGq proceeds to a second period of time.

An operating principle of the q-th shift register unit ASGq in FIG. 24*b* in a second period of time is the same as the operating principle of the q-th shift register unit ASGq in FIG. 20*b* in the second period of time; and an operating principle of the q-th shift register unit ASGq in FIG. 24*b* in a third period of time is the same as the operating principle of the q-th shift register unit ASGq in FIG. 20*b* in the third period of time.

Since the third capacitor C3 in the q-th shift register unit ASGq can be charged only when the mod((q+1)/4)-th clock signal CLK mod((q+1)/4) is at the high level and the mod(q/4)-th clock signal CLK mod(q/4) is at the high level, in order to ensure that the fourteenth transistor T14 in the q-th shift register unit ASGq can be turned on stably, the period of time in which the mod((q+1)/4)-th clock signal CLK mod((q+1)/4) is at the high level shall overlap with the period of time in which the mod(q/4)-th clock signal CLK mod(q/4) is at the high level by a length of time no less than the length of time it takes to charge the third capacitor C3 in the q-th shift register unit ASGq to the voltage at which the fourteenth transistor T14 in the q-th shift register unit ASGq can be turned on stably, where a period of time in which the third capacitor C3 in the q-th shift register unit ASGq can be charged is a period of time denoted in FIG. 24*b* by a dotted ellipse.

Particularly the first period of time, the second period of time and the third period of time of the q-th shift register unit ASGq are periods of time in which the gate line connected with the q-th shift register unit ASGq is enabled.

In FIG. 24*b*, since the signal received by the forward select signal terminal GN−1 of the first shift register unit ASG1 is the first initial trigger signal STV1 which will be at the high level to thereby trigger the start of scanning only when one frame starts to be scanned and which will be at the low level at other times, the forward select signal terminal GN−1 of the first shift register unit ASG1 will be at the high level only when one frame starts to be scanned and will be at the low level at other times, so the tenth transistor T10 in the first shift register unit ASG1 can not be turned on so that the third capacitor C3 in the first shift register unit ASG1 can not be discharged through the tenth transistor T10, and thus the fourteenth transistor T14 in the first shift register unit ASG1 can not be turned off; and the fourteenth transistor T14 in the first shift register unit ASG1 can have the signal at the gate thereof (i.e., the signal stored on the third capacitor C3) released through the twelfth transistor T12 in the first shift register unit ASG1 (at this time the initial trigger signal terminal STVIN of the first shift register unit ASG1 is at the low level) to thereby be turned off only when the reset signal terminal RSTIN in the first shift register unit ASG1 receives a high level signal (that is, the reset signal RST is at the high level after the end of scanning a preceding frame and before the start of scanning a next frame); and when the reset signal RST is at the high level, the thirteenth transistor T13 in the first shift register unit ASG1 is turned on so that the gate line connected with the first shift register unit ASG1 receives a low level signal. Thus the third period of time of the first shift register unit ASG1 will end only when the reset signal terminal RSTIN thereof receives a high level signal (that is, the reset signal RST is changed from the low level signal to the high level signal).

In FIG. 24*b*, since the signal received by the forward select signal terminal GN−1 of the second shift register unit ASG2 is the second initial trigger signal STV2 which will be at the high level to thereby trigger the start of scanning only when one frame starts to be scanned and which will be at the low level at other times, the forward select signal terminal GN−1 of the second shift register unit ASG2 will be at the high level only when one frame starts to be scanned and will be at the low level at other times, so the tenth transistor T10 in the second shift register unit ASG2 can not be turned on so that the third capacitor C3 in the second shift register unit ASG2 can not be discharged through the tenth transistor T10, and thus the fourteenth transistor T14 in the second shift register unit ASG2 can not be turned off; and the fourteenth transistor T14 in the second shift register unit ASG2 can have the signal at the gate thereof (i.e., the signal stored on the third capacitor C3) released through the twelfth transistor T12 in the second shift register unit ASG2 (at this time the initial trigger signal terminal STVIN of the second shift register unit ASG2 is at the low level) to thereby be turned off only when the reset signal terminal RSTIN in the second shift register unit ASG2 receives a high level signal (that is, the reset signal RST is at the high level after the end of scanning a preceding frame and before the start of scanning a next frame); and when the reset signal RST is at the high level, the thirteenth transistor T13 in the second shift register unit ASG2 is turned on so that the gate line connected with the second shift register unit ASG2 receives a low level signal. Thus the third period of time of the second shift register unit ASG2 will end only when the reset signal terminal RSTIN thereof receives a high level signal (that is, the reset signal RST is changed from the low level signal to the high level signal).

In FIG. 24*b*, with each of the shift register units, when the reset signal terminal RSTIN thereof receives a high level signal (that is, the reset signal RST is at the high level), the gate of the fourteenth transistor T14 therein will be connected with the initial trigger signal terminal STVIN, and since both the first initial trigger signal STV1 and the second initial trigger signal STV2 are at the low level when the reset signal RST is at the high level, the fourteenth transistor T14 will be turned off, and the gate line connected with the each shift register unit will also receive a low level signal to thereby eliminate an influence of a residual signal after the end of scanning the preceding frame upon the succeeding frame.

Figure 25:
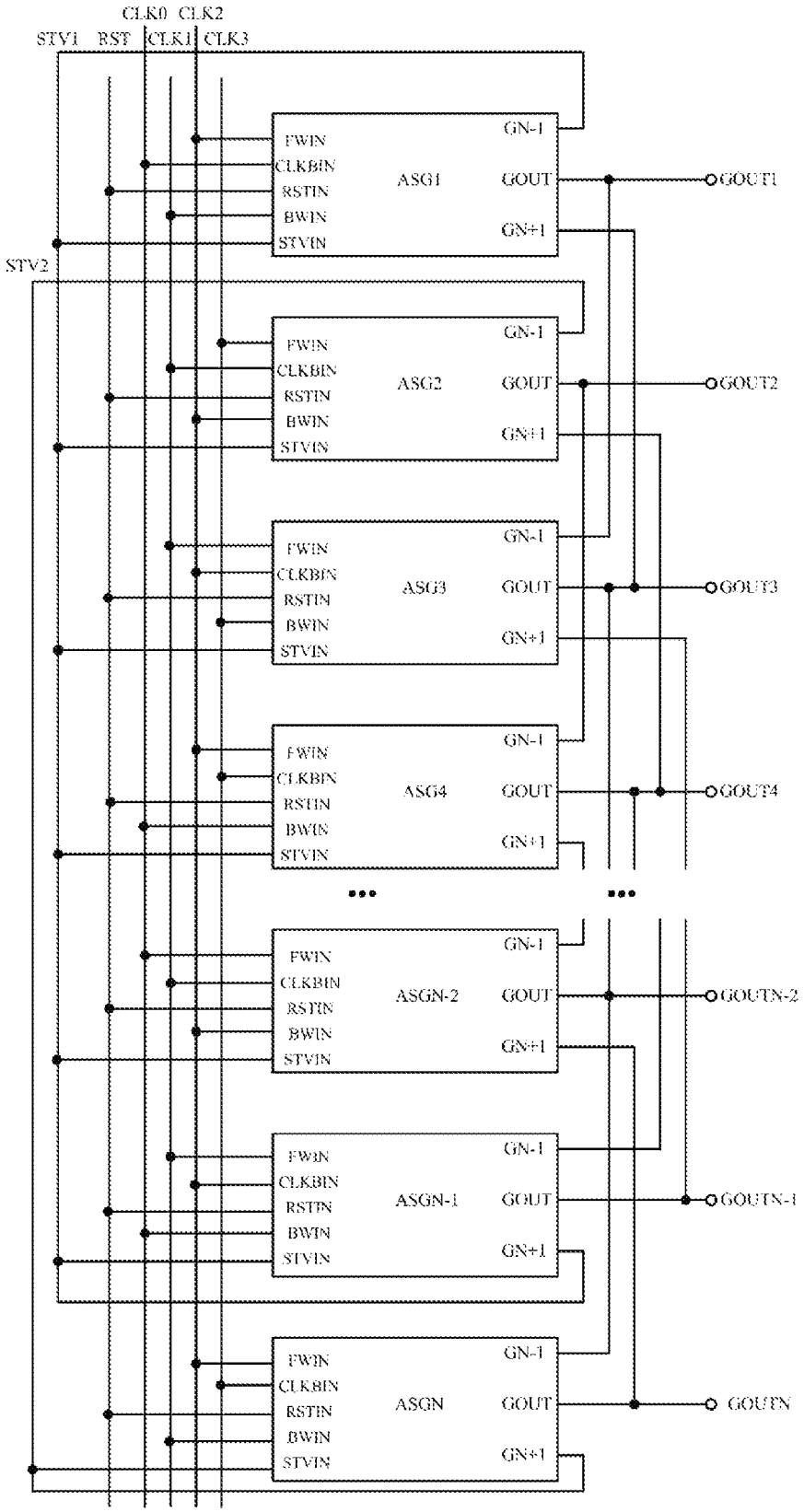
FIG. 25 is a ninth schematic structural diagram of a gate drive apparatus according to an embodiment of the present invention.

Furthermore the respective clocks signals can also be reused as the backward scan signals BWs in the gate drive apparatus illustrated in FIG. 21, and the gate drive apparatus can be structured as illustrated in FIG. 25. The gate drive apparatus in FIG. 25 is different from the gate drive apparatus in FIG. 21 in that a transmission line is required to be specially arranged to transmit the backward scan signals received by the respective register units in the gate drive apparatus illustrated in FIG. 21, and the clock signals can be reused as the backward scan signals received by the respective register units in the gate drive apparatus illustrated in FIG. 25. The clock signals can be reused as the backward scan signals received by the respective register units in the gate drive apparatus illustrated in FIG. 25 particularly as follows:

The number N of shift register units in the gate drive apparatus is an integer multiple of 4; the signal received by the backward scan signal terminal BWIN of each of the shift register units other than the last two shift register units is the same as the signal received by the clock block signal terminal CLKBIN of the succeeding shift register unit to the shift register unit, the backward scan signal terminal BWIN of the (N−1)-th shift register unit ASGN−1 receives the 0th clock signal CLK0, and the backward scan signal terminal BWIN of the N-th shift register unit ASGN receives the first clock signal CLK1; and In backward scanning, the period of time in which the first initial trigger signal STV1 is at the high level overlaps with the period of time in which the 0th clock signal CLK0 is at the high level at time by a length of time no less than the length of time it takes to charge the gate of the transistor of the drive gate line in the (N−1)-th shift register unit ASGN−1 to the voltage at which the transistor can be turned on stably and no more than one cycle of the 0th clock signal CLK0, and the period of time in which the second initial trigger signal STV2 is at the high level overlaps with the period of time in which the first clock signal CLK1 is at the high level at time by a length of time no less than the length of time it takes to charge the gate of the transistor of the drive gate line in the N-th shift register unit ASGN to the voltage at which the transistor can be turned on stably and no more than one cycle of the first clock signal CLK1.

The respective shift register units in the gate drive apparatus illustrated in FIG. 25 each can be structured as the shift register unit illustrated in FIG. 19 or can alternatively be embodied as a shift register unit in another structure. The shift register units in the gate drive apparatus will not be limited in structure as long as scanning can be performed with the connection scheme illustrated in FIG. 25.

Figure 26A:
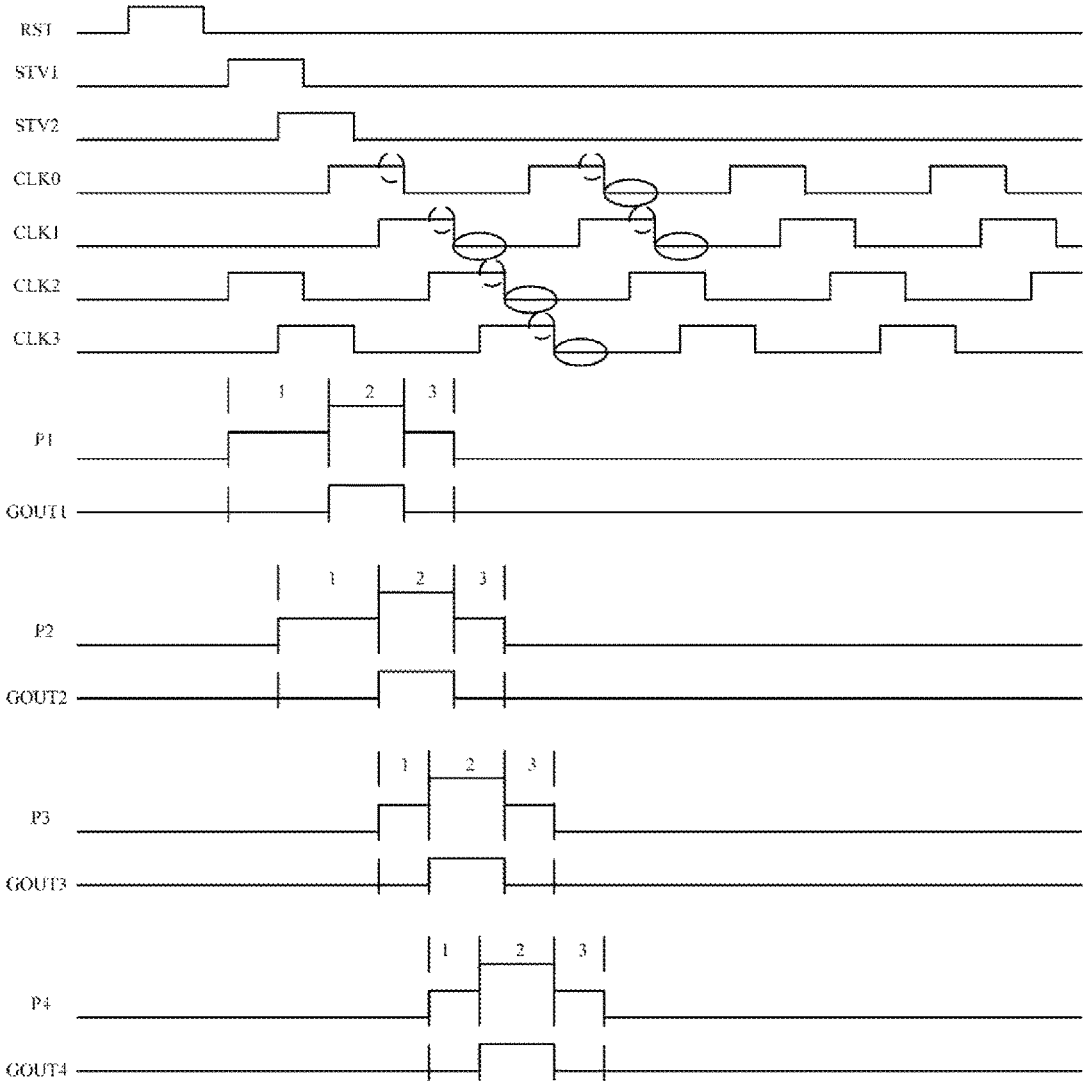
FIG. 26*a* is a timing diagram of the gate drive apparatus illustrated in FIG. 25 in forward scanning.

Operating timings of the gate drive apparatus illustrated in FIG. 25 in forward scanning and backward scanning will be described below by way of an example where the respective shift register units in the gate drive apparatus illustrated in FIG. 25 each are structured as the shift register unit illustrated in FIG. 19. FIG. 26*a* illustrates an operating timing diagram of the gate drive apparatus illustrated in FIG. 25 in forward scanning, and FIG. 26*b* illustrates an operating timing diagram of the gate drive apparatus illustrated in FIG. 26 in backward scanning, where FIG. 26*a* illustrates an operating timing diagram of only the first four shift register units in the gate drive apparatus, and FIG. 25*b* illustrates an operating timing diagram of only the last four shift register units in the gate drive apparatus.

An operating principle of the l-th (l=1, 2, 3, . . . , N) shift register unit in FIG. 26*a* in a first period of time is the same as the operating principle of the l-th shift register unit in FIG. 22*a* in the first period of time, an operating principle of the l-th shift register unit in FIG. 26*a* in a second period of time is the same as the operating principle of the l-th shift register unit in FIG. 22*a* in the second period of time, and an operating principle of the l-th shift register unit in FIG. 26*a* in a third period of time is the same as the operating principle of the l-th shift register unit in FIG. 24*a* in the third period of time. A period of time in which the third capacitor C3 in the shift register unit in FIG. 26*a* can be charged is a period of time in FIG. 26*a* by a dotted ellipse, and a period of time in which the third capacitor C3 in the shift register unit in FIG. 26*a* can be discharged is a period of time in FIG. 26*a* by a solid ellipse.

Figure 26B:
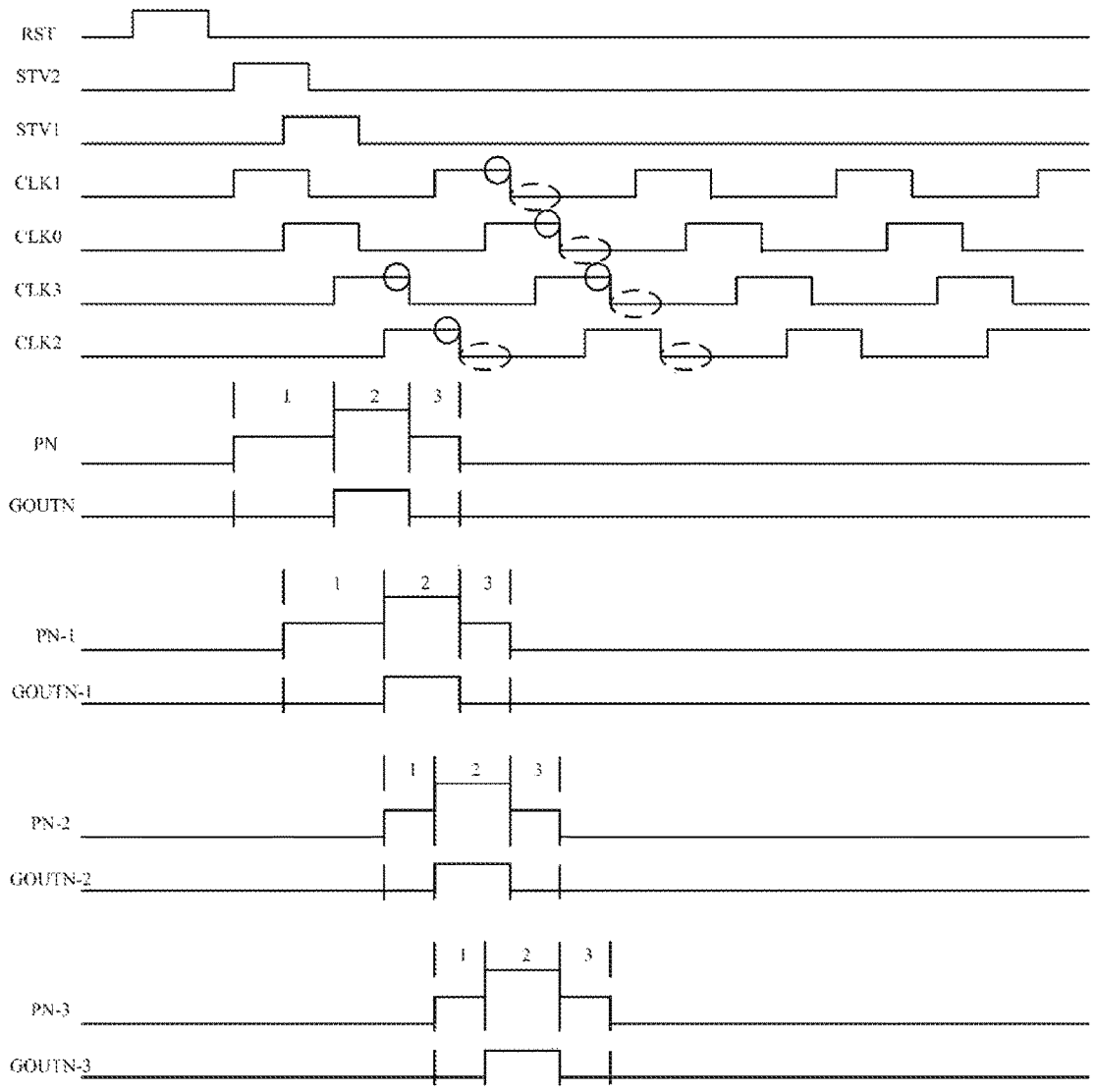
FIG. 26*b* is a timing diagram of the gate drive apparatus illustrated in FIG. 25 in backward scanning.

An operating principle of the l-th (l=1, 2, 3, . . . , N) shift register unit in FIG. 26*b* in a first period of time is the same as the operating principle of the l-th shift register unit in FIG. 24*b* in the first period of time, an operating principle of the l-th shift register unit in FIG. 26*b* in a second period of time is the same as the operating principle of the l-th shift register unit in FIG. 24*b* in the second period of time, and an operating principle of the l-th shift register unit in FIG. 26*b* in a third period of time is the same as the operating principle of the l-th shift register unit in FIG. 22*b* in the third period of time. A period of time in which the third capacitor C3 in the shift register unit in FIG. 26*b* can be charged is a period of time in FIG. 26*b* by a solid ellipse, and a period of time in which the third capacitor C3 in the shift register unit in FIG. 26*b* can be discharged is a period of time in FIG. 26*b* by a dotted ellipse.

Furthermore the same signal can be used for both the first initial trigger signal and the second initial trigger signal used by the gate drive apparatuses illustrated in FIG. 17, FIG. 21, FIG. 23 and FIG. 25, and at this time the first initial trigger signal and the second initial trigger signal are combined into a same signal, i.e., an initial trigger signal.

Figure 27:
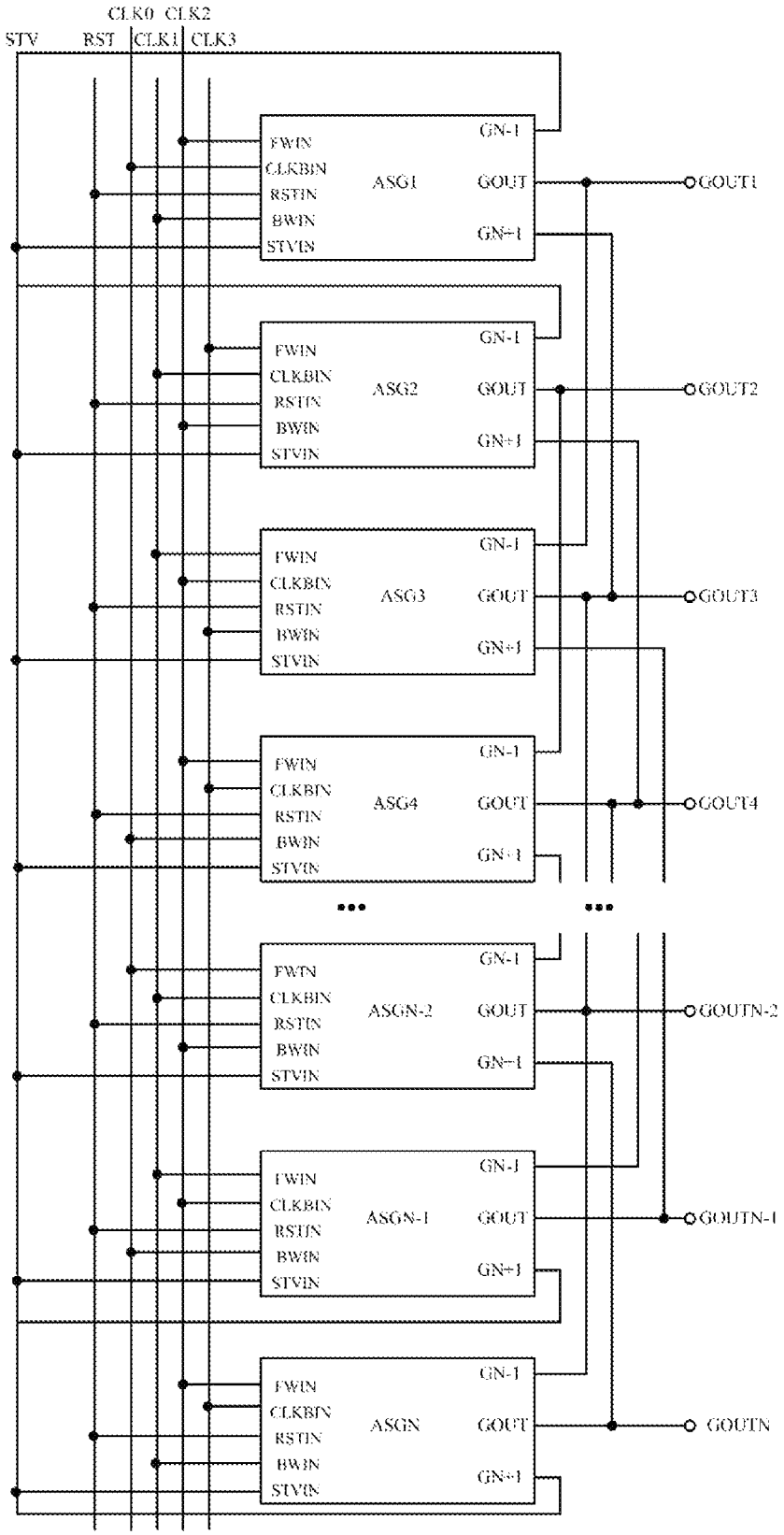
FIG. 27 is a tenth schematic structural diagram of a gate drive apparatus according to an embodiment of the present invention.

When the same signal used for both the first initial trigger signal and the second initial trigger signal used by the gate drive apparatus illustrated in FIG. 25, the structure of the gate drive apparatus is as illustrated in FIG. 27. The structure of the gate drive apparatus illustrated in FIG. 27 is different from the structure of the gate drive apparatus illustrated in FIG. 25 only in that the forward select signal terminal GN−1 in the first shift register unit ASG1 in the gate drive apparatus illustrated in FIG. 25 receives the first initial trigger signal STV1, the forward select signal terminal GN−1 in the second shift register unit ASG2 receives the second initial trigger signal STV2, the backward select signal terminal GN+1 in the (N−1)-th shift register unit ASGN−1 receives the first initial trigger signal STV1, and the backward select signal terminal GN+1 in the N-th shift register unit ASGN receives the second initial trigger signal STV2; and the forward select signal terminal GN−1 in the first shift register unit ASG1, the forward select signal terminal GN−1 in the second shift register unit ASG2, the backward select signal terminal GN+1 in the (N−1)-th shift register unit ASGN−1 and the backward select signal terminal GN+1 in the N-th shift register unit ASGN in the gate drive apparatus illustrated in FIG. 27 each receive the same signal, i.e., an initial trigger signal STV.

When the same signal used for both the first initial trigger signal and the second initial trigger signal used by the gate drive apparatus illustrated in FIG. 17, the difference of the structure of the gate drive apparatus from the structure of the gate drive apparatus illustrated in FIG. 17 is the same as the difference of the structure of the gate drive apparatus illustrated in FIG. 25 from the structure of the gate drive apparatus illustrated in FIG. 27; when the same signal used for both the first initial trigger signal and the second initial trigger signal used by the gate drive apparatus illustrated in FIG. 21, the difference of the structure of the gate drive apparatus from the structure of the gate drive apparatus illustrated in FIG. 21 is the same as the difference of the structure of the gate drive apparatus illustrated in FIG. 25 from the structure of the gate drive apparatus illustrated in FIG. 27; and when the same signal used for both the first initial trigger signal and the second initial trigger signal used by the gate drive apparatus illustrated in FIG. 23, the difference of the structure of the gate drive apparatus from the structure of the gate drive apparatus illustrated in FIG. 23 is the same as the difference of the structure of the gate drive apparatus illustrated in FIG. 25 from the structure of the gate drive apparatus illustrated in FIG. 27;

The number N of shift register units in the gate drive apparatus illustrated in FIG. 27 is also an integer multiple of 4, which can ensure scanning from the first shift register unit ASG1 to the N-th shift register unit ASGN in forward scanning as well as scanning from the N-th shift register unit ASGN to the first shift register unit ASG1 in backward scanning to thereby avoid scanning from being started concurrently from the first shift register unit ASG1 and the (N−1)-th shift register unit ASGN−1 and/or scanning from being started concurrently from the second shift register unit ASG2 and the N-th shift register unit ASGN.

The respective shift register units in the gate drive apparatus illustrated in FIG. 27 each can be structured as the shift register unit illustrated in FIG. 19 can alternatively be embodied as a shift register unit in another structure. The shift register units in the gate drive apparatus will not be limited in structure as long as scanning can be performed with the connection scheme illustrated in FIG. 27.

Figure 28A:
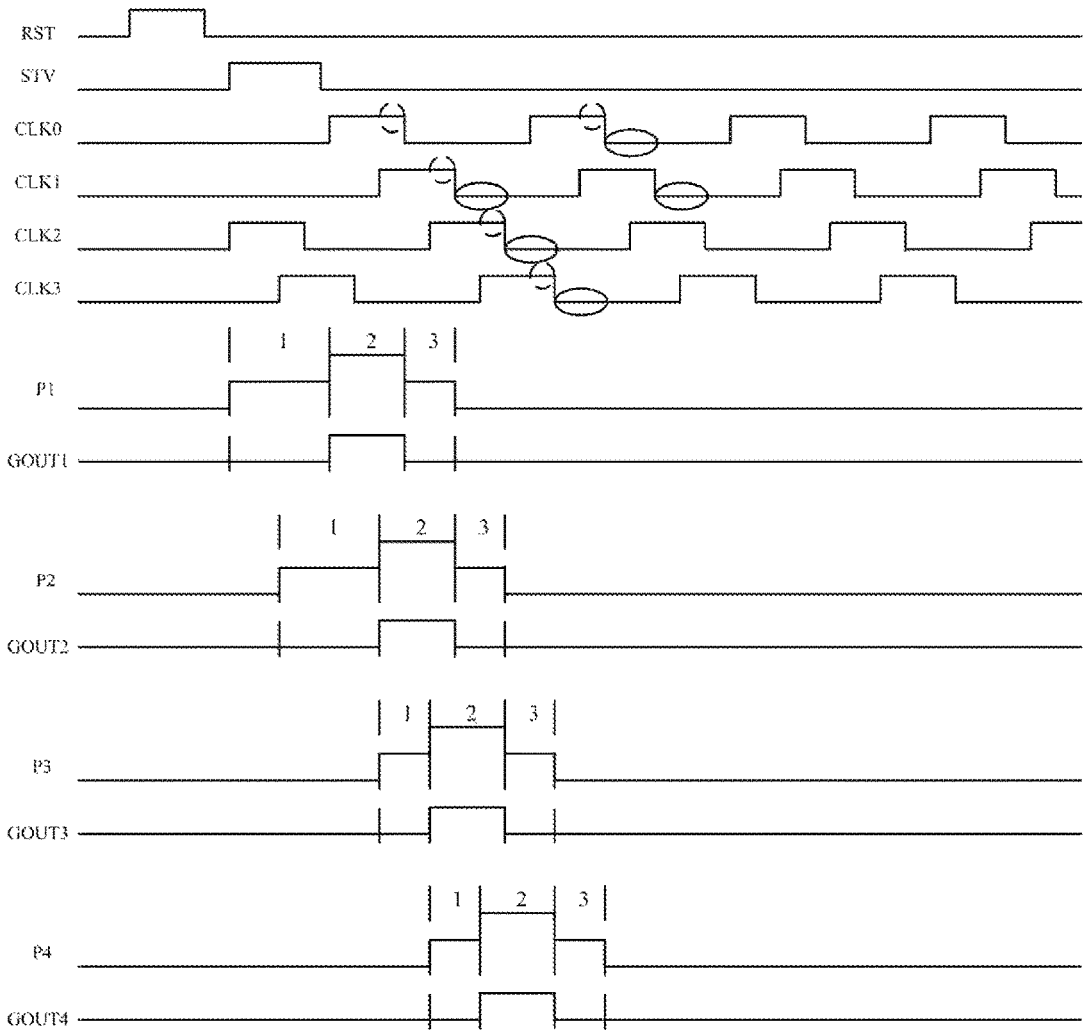
FIG. 28*a* is a timing diagram of the gate drive apparatus illustrated in FIG. 27 in forward scanning.
Figure 28B:
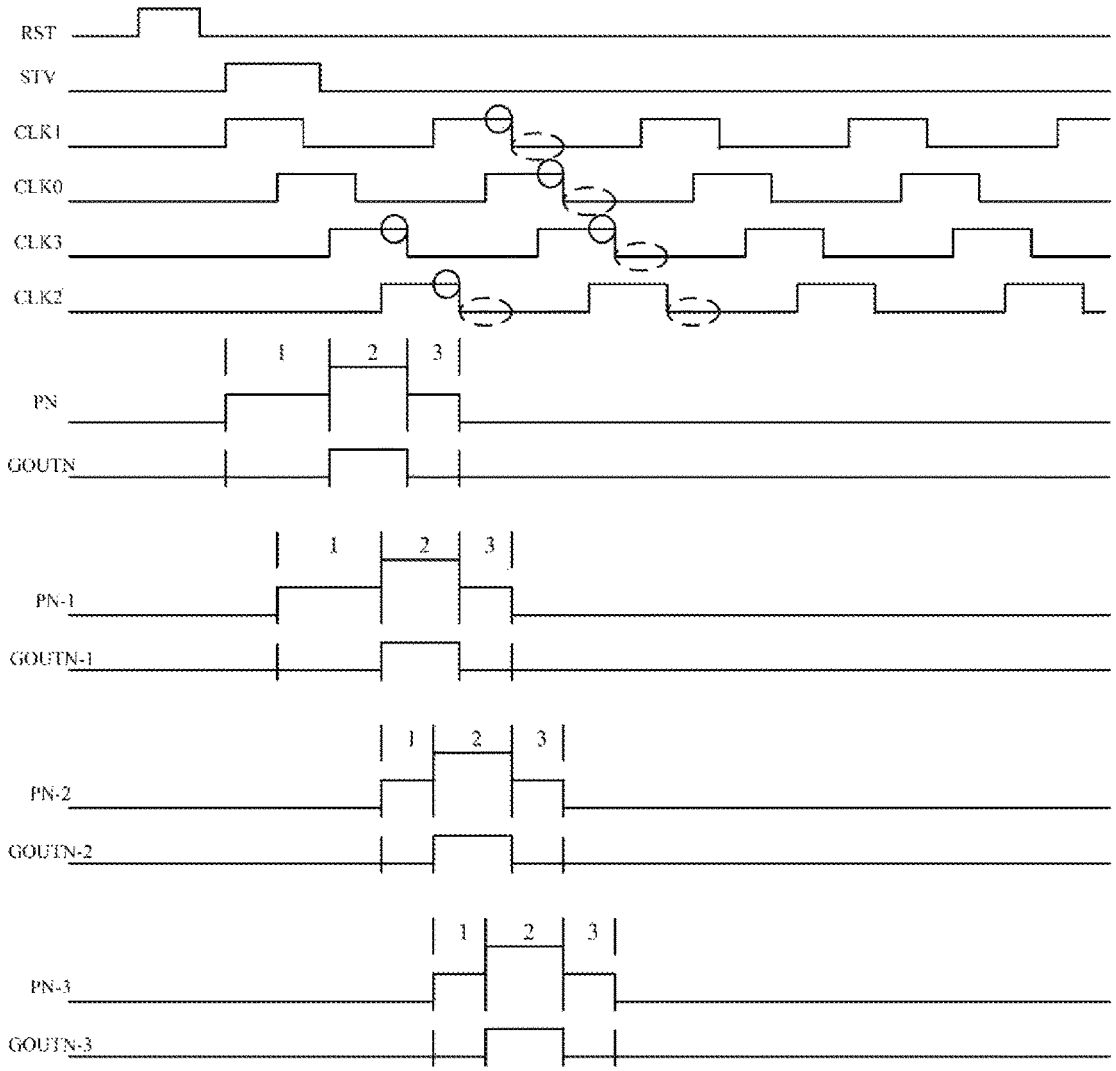
FIG. 28*b* is a timing diagram of the gate drive apparatus illustrated in FIG. 27 in backward scanning.

Operating timings of the gate drive apparatus illustrated in FIG. 27 in forward scanning and backward scanning will be described below by way of an example where the respective shift register units in the gate drive apparatus illustrated in FIG. 27 each are structured as the shift register unit illustrated in FIG. 19. FIG. 28*a* illustrates an operating timing diagram of only the first four shift register units in the gate drive apparatus, and FIG. 28*b* illustrates an operating timing diagram of only the last four shift register units in the gate drive apparatus.

In forward scanning by the gate drive apparatus illustrated in FIG. 27 (i.e., the timing diagram in FIG. 28*a*), an operating principle of the m-th (m=1, 2, . . . , N) shift register unit therein is the same as the operating principle of the m-th shift register unit in the gate drive apparatus illustrated in FIG. 26*a*, so a repeated description thereof will be omitted here. In backward scanning by the gate drive apparatus illustrated in FIG. 27 (i.e., the timing diagram in FIG. 28*b*), an operating principle of the m-th shift register unit therein is the same as the operating principle of the m-th shift register unit in the gate drive apparatus illustrated in FIG. 26*b*, so a repeated description thereof will be omitted here.

When the same signal is used for the first initial trigger signal and the second initial trigger signal used by the gate drive apparatus illustrated in FIG. 17, in forward scanning by the gate drive apparatus, an operating principle of the m-th (m=1, 2, . . . , N) shift register unit therein is the same as the operating principle of the m-th shift register unit in the gate drive apparatus illustrated in FIG. 20*a*, so a repeated description thereof will be omitted here; and when the same signal is used for the first initial trigger signal and the second initial trigger signal used by the gate drive apparatus illustrated in FIG. 17, in backward scanning by the gate drive apparatus, an operating principle of the m-th (m=1, 2, . . . , N) shift register unit therein is the same as the operating principle of the m-th shift register unit in the gate drive apparatus illustrated in FIG. 20*b*, so a repeated description thereof will be omitted here.

When the same signal is used for the first initial trigger signal and the second initial trigger signal used by the gate drive apparatus illustrated in FIG. 21, in forward scanning by the gate drive apparatus, an operating principle of the m-th (m=1, 2, . . . , N) shift register unit therein is the same as the operating principle of the m-th shift register unit in the gate drive apparatus illustrated in FIG. 22*a*, so a repeated description thereof will be omitted here; and when the same signal is used for the first initial trigger signal and the second initial trigger signal used by the gate drive apparatus illustrated in FIG. 21, in backward scanning by the gate drive apparatus, an operating principle of the m-th (m=1, 2, . . . , N) shift register unit therein is the same as the operating principle of the m-th shift register unit in the gate drive apparatus illustrated in FIG. 22*b*, so a repeated description thereof will be omitted here.

When the same signal is used for the first initial trigger signal and the second initial trigger signal used by the gate drive apparatus illustrated in FIG. 23, in forward scanning by the gate drive apparatus, an operating principle of the m-th (m=1, 2, . . . , N) shift register unit therein is the same as the operating principle of the m-th shift register unit in the gate drive apparatus illustrated in FIG. 24*a*, so a repeated description thereof will be omitted here; and when the same signal is used for the first initial trigger signal and the second initial trigger signal used by the gate drive apparatus illustrated in FIG. 23, in backward scanning by the gate drive apparatus, an operating principle of the m-th (m=1, 2, . . . , N) shift register unit therein is the same as the operating principle of the m-th shift register unit in the gate drive apparatus illustrated in FIG. 24*b*, so a repeated description thereof will be omitted here.

Figure 29:
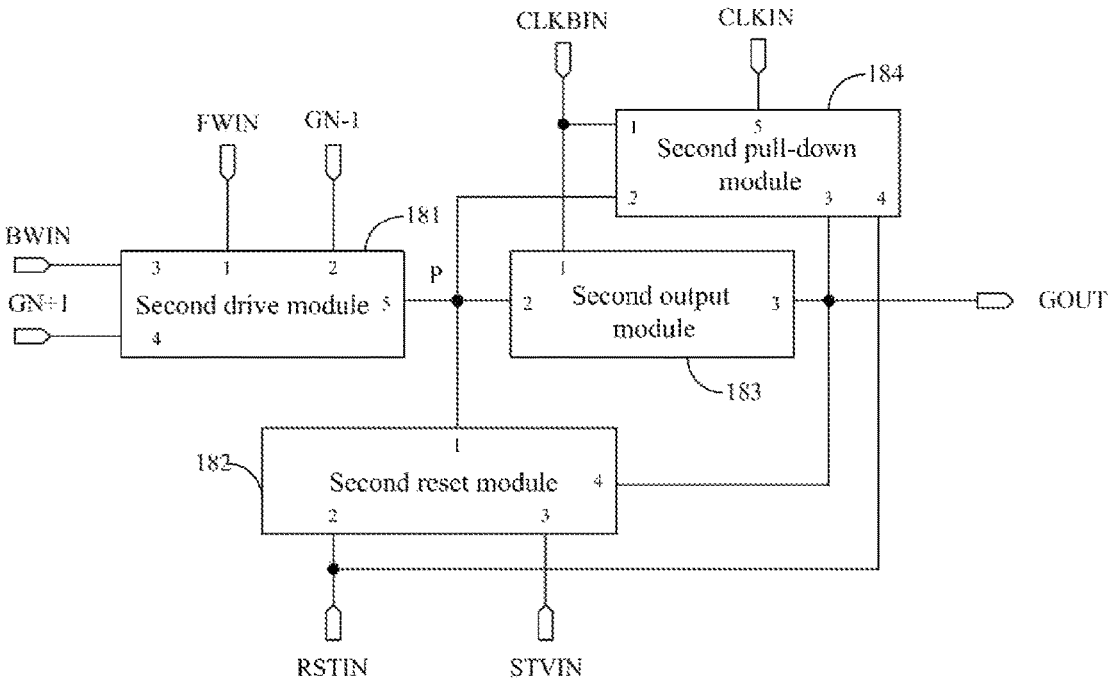
FIG. 29 is a fourth schematic structural diagram of a shift register unit in a gate drive apparatus according to an embodiment of the present invention.

Furthermore a second pull-down module can be further added to the structure of the shift register unit illustrated in FIG. 18, and the structure of the shift register unit with the second pull-down module added thereto is as illustrated in FIG. 29 where a clock signal terminal is added to each of the shift register units with the second pull-down module added thereto. As illustrated in FIG. 29, a first terminal of the second pull-down module 184 is the clock block signal terminal CLKBIN of each of the shift register units, a second terminal of the second pull-down module 184 is connected with the second terminal of the second output module 182, a third terminal of the second pull-down module 184 is connected with the third terminal of the second output module 182, a fourth terminal of the second pull-down module 184 is the reset signal terminal RSTIN of the shift register unit, and a fifth terminal of the second pull-down module 184 is the clock signal terminal CLKIN of the shift register unit; and the second pull-down module 184 is configured to output the reset signal RST received by the fourth terminal thereof through the second terminal and the third terminal thereof respectively when the second terminal thereof is at the low level and the clock block signal CLKB is at the high level, and to output the reset signal RST received by the fourth terminal thereof through the third terminal thereof when the clock signal terminal CLKIN is at the high level.

When the respective shift register units in the gate drive apparatus each are structured as the shift register unit illustrated in FIG. 29, the clock signal terminal of the k-th (k=1, 2, . . . , N) shift register unit in the gate drive apparatus receives the mod((mod((k−1)/4)+2)/4)-th clock signal.

Figure 30:
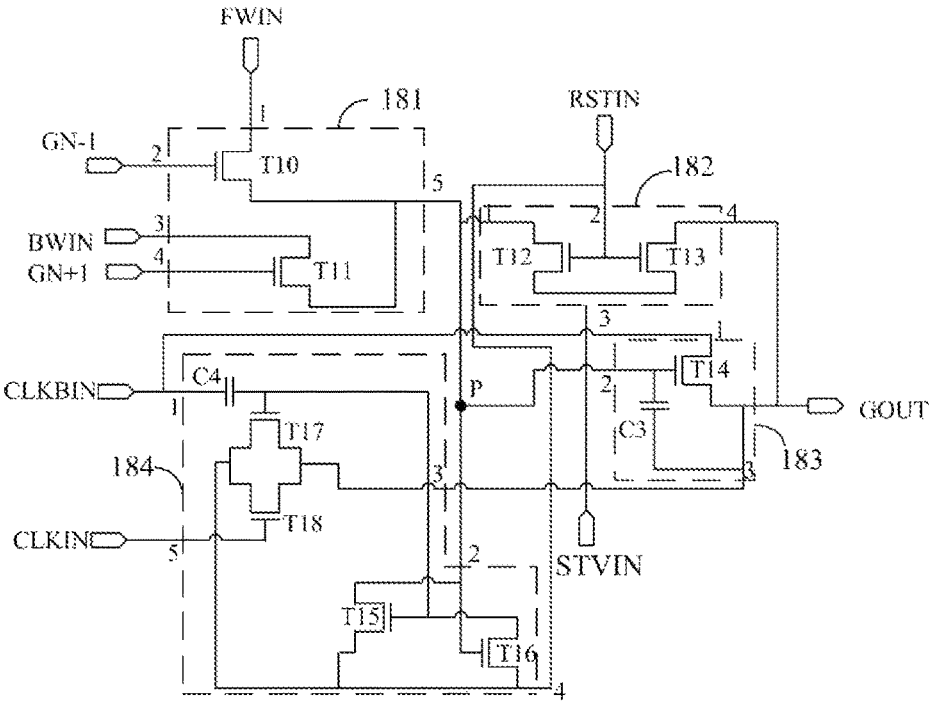
FIG. 30 is a fourth circuit diagram of a shift register unit in a gate drive apparatus according to an embodiment of the present invention.

Furthermore the shift register unit illustrated in FIG. 29 can be structured as a circuit structure illustrated in FIG. 30. As illustrated in FIG. 30, the second pull-down module 184 includes a fourth capacitor C4, a fifteenth transistor T15, a sixteenth transistor T16, an seventh transistor T17 and an eighteenth transistor T18; a first S/D of the fifteenth transistor T15 is the second terminal of the second pull-down module 184, a gate of the fifteenth transistor T15 is connected with the fourth capacitor C4, a second S/D of the fifteenth transistor T15 is the fourth terminal of the second pull-down module 184, and one terminal of the fourth capacitor C4 unconnected with the gate of the fifteenth transistor T15 is the first terminal of the second pull-down module 184; a first S/D of the sixteenth transistor T16 is connected with the gate of the fifteenth transistor T15, a gate of the sixteenth transistor T16 is the second terminal of the second pull-down module 184, and a second S/D of the sixteenth transistor T16 is the fourth terminal of the second pull-down module 184; a first S/D of the seventh transistor T17 is the third terminal of the second pull-down module 184, a gate of the seventh transistor T17 is connected with the gate of the fifteenth transistor T15, and a second S/D of the seventh transistor T17 is the fourth terminal of the second pull-down module 184; a first S/D of the eighteenth transistor T18 is the third terminal of the second pull-down module 184, a gate of the eighteenth transistor T18 is the fifth terminal of the second pull-down module 184, and a second S/D of the eighteenth transistor T18 is the fourth terminal of the second pull-down module 184; the fifteenth transistor T15 is configured to be turned on to pull the second terminal of the second pull-down module 184, i.e., the pull-up node P, down to the low level when the gate thereof is at the high level and to be turned off when the gate thereof is at the low level; the sixteenth transistor T16 is configured to be turned on to transmit the signal received by the reset signal terminal RSTIN to the gate of the fifteenth transistor T15, i.e., to pull the level at the gate of the fifteenth transistor T15 down to the low level, when the second terminal of the second pull-down module 184, i.e., the pull-up node P, is at the high level and to be turned off when the second terminal of the second pull-down module 184 is at the low level; the seventh transistor T17 is configured to be turned on transmit the signal received by the reset signal terminal RSTIN to the output terminal GOUT of the shift register unit, i.e., to pull the output terminal GOUT of the shift register unit down to the low level, when the gate thereof is at the high level and to be turned off when the gate thereof is at the low level; and the eighteen transistor T18 is configured to be turned on transmit the signal received by the reset signal terminal RSTIN to the output terminal GOUT of the shift register unit i.e., to pull the output terminal GOUT of the shift register unit down to the low level, when the clock signal terminal CLKIN is at the high level and to be turned off when the clock signal terminal CLKIN is at the low level.

Since the reset signal is at the low level at the time in the course of scanning the current frame, the reset signal can be used in place of a low level signal in the course of scanning the current frame.

Particularly the gate of the fifth transistor T15 and the gate of the seventh transistor T17 can be at the high level only when the pull-up node P is at the low level and the clock block signal terminal CLKBIN is at the high level.

The circuit in FIG. 30 other than the second pull-down module 184 is structurally the same as the circuit in FIG. 19, so a repeated description thereof will be omitted here.

The shift register units in the gate drive apparatuses illustrated in FIG. 17, FIG. 21, FIG. 23 and FIG. 25 each can be structured as the shift register unit illustrated in FIG. 30. When a shift register unit in a gate drive apparatus is structured as the shift register unit illustrated in FIG. 30, operating principles thereof in first, second and third periods of time are the same as the operating principles of the shift register unit structured as illustrated in FIG. 19 in the in first, second and third periods of time respectively In forward scanning, if the respective shift register units in the gate drive apparatus each include the first pull-down module, then a low level signal over the gate lines connected with the respective shift register units in the gate drive apparatus other than the last two shift register units will not be influenced by a clock signal at the high level in the period of time in which the gate lines thereof are disabled. In backward scanning, if the respective shift register units in the gate drive apparatus each include the first pull-down module, then a low level signal over the gate lines connected with the respective shift register units in the gate drive apparatus other than the first shift register unit and the second shift register unit will not be influenced by a clock signal at the high level in the period of time in which the gate lines thereof are disabled.

When the respective shift register units in the gate drive apparatus illustrated in FIG. 17 each are structured as illustrated in FIG. 30, operating diagrams thereof in forward scanning are still as illustrated in FIG. 20*a*, and operating diagrams thereof in backward scanning are still as illustrated in FIG. 20*b*. When the respective shift register units in the gate drive apparatus illustrated in FIG. 21 each are structured as illustrated in FIG. 30, operating diagrams thereof in forward scanning are still as illustrated in FIG. 22*a*, and operating diagrams thereof in backward scanning are still as illustrated in FIG. 22*b*. When the respective shift register units in the gate drive apparatus illustrated in FIG. 23 each are structured as illustrated in FIG. 30, operating diagrams thereof in forward scanning are still as illustrated in FIG. 24*a*, and operating diagrams thereof in backward scanning are still as illustrated in FIG. 24*b*. When the respective shift register units in the gate drive apparatus illustrated in FIG. 25 each are structured as illustrated in FIG. 30, operating diagrams thereof in forward scanning are still as illustrated in FIG. 26*a*, and operating diagrams thereof in backward scanning are still as illustrated in FIG. 26*b*. When the respective shift register units in the gate drive apparatus illustrated in FIG. 27 each are structured as illustrated in FIG. 30, operating diagrams thereof in forward scanning are still as illustrated in FIG. 28*a*, and operating diagrams thereof in backward scanning are still as illustrated in FIG. 28*b*.

For transistors in the field of liquid crystal displays, drains and sources thereof are not distinguished definitely from each other, so the first S/Ds of the transistors as referred to in the embodiments of the invention can be the sources (or the drains), and the second S/Ds of the transistors can be the drains (or the sources) of the transistors. If the sources of the transistors are the first S/Ds, then the drains of the transistors are the second S/Ds; and if the drains of the transistors are the first S/Ds, then the sources of the transistors are the second S/Ds.

A display apparatus according to an embodiment of the invention includes the gate drive apparatus according to any one of the embodiments of the invention.

Those skilled in the art can appreciate that the drawings are merely schematic diagrams of preferred embodiments of the invention, and the modules or the flows in the drawings may not be necessary to put the invention into practice.

Those skilled in the art can appreciate that the modules in the apparatuses according to the embodiments of the invention can be distributed in the apparatuses according to the embodiments as described in the embodiments or can be located in one or more of the apparatuses according to the embodiments with corresponding modifications. The modules in the embodiments above can be combined into a single module or can be further divided into a plurality of sub-modules.

The embodiments of the invention above have been numbered only for the purpose of a description without suggesting any superiority of one of the embodiments over another.

Evidently those skilled in the art can make various modifications and variations to the invention without departing from the spirit and scope of the invention. Thus the invention is also intended to encompass these modifications and variations thereto so long as the modifications and variations come into the scope of the claims appended to the invention and their equivalents.

The invention claimed is:

1. A gate drive apparatus, comprising N shift register units, wherein a forward select signal terminal of the p-th shift register unit receives a signal output by the (p−2)-th shift register unit, wherein p=3,4,...,N, and a backward select signal terminal of the r-th shift register unit receives a signal output by the (r+2)-th shift register unit, and r=1,2,...,N−2; a forward select signal terminal of the first shift register unit receives a first initial trigger signal, and a forward select signal terminal of the second shift register unit receives a second initial trigger signal;

wherein if N represents an even number, a backward select signal terminal of the second last shift register unit receives the first initial trigger signal, a backward select signal terminal of the last shift register unit receives the second initial trigger signal;

wherein if N represents an odd number, the backward select signal terminal of the last shift register unit receives the first initial trigger signal, the backward select signal terminal of the second last shift register unit receives the second initial trigger signal;

wherein a clock block signal terminal of the k-th shift register unit receives a mod((k−1)/4)-th clock signal, wherein k=1,2,...,N;

wherein a signal received by a forward scan signal terminal of each of the shift register units other than the first two shift register units is the same as the signal received by the clock block signal terminal of the prior shift register unit to the shift register unit, wherein a forward scan signal terminal of the first shift register unit receives a second clock signal, a forward scan signal terminal of the second shift register unit receives a third clock signal;

wherein when the 0th clock signal is at the high level, the second clock signal is at the low level, and when the 0th clock signal is at the low level, the second clock signal is at the high level; when the first clock signal is at the high level, the third clock signal is at the low level, and when the first clock signal is at the low level, the third clock signal is at the high level; and wherein an overlapping length of time of a period of time in which the n-th clock signal is at the high level, and a period of time in which the (n+1)-th clock signal is at the high level is no less than a first preset length of time, wherein n=0,1,2,3, and n+1>3, the (n+1)-th clock signal is a mod((n+1)/4)-th clock signal;

wherein in forward scanning, an overlapping length of time of a period of time in which the first initial trigger signal is at the high level and a period of time in which the second clock signal is at the high level is no less than a period of time it takes to charge a gate of a transistor of a drive gate line in the first shift register unit to the voltage at which the transistor can be turned on stably and the overlapping length of time is no more than one cycle of the second clock signal; and wherein an overlapping length of time of a period of time in which the second initial trigger signal is at the high level and the period of time in which the third clock signal is at the high level is no less than a period of time it takes to charge a gate of a transistor of a drive gate line in the second shift register unit to the voltage at which the transistor can be turned on stably and the overlapping length of time no more than one cycle of the third clock signal.

2. The gate drive apparatus according to claim 1, wherein N=4m, m represents a positive integer, wherein the signal received by the backward scan signal terminal of each of the shift register units other than the last two shift register units is the same as the signal received by the clock block signal terminal of the succeeding shift register unit to the shift register unit, the backward scan signal terminal of the (N−1)-th shift register unit receives the 0th clock signal, and the backward scan signal terminal of the N-th shift register unit receives the first clock signal, and wherein in backward scanning, a period of time in which the first initial trigger signal is at the high level overlaps with the period of time in which the 0th clock signal is at the high level at a time by a length of time no less than a period of time it takes to charge a gate of a transistor of a drive gate line in the (N−1)-th shift register unit to the voltage at which the transistor can be turned on stably and no more than one cycle of the 0th clock signal, and a period of time in which the second initial trigger signal is at the high level overlaps with the period of time in which the first clock signal is at the high level at a time by a length of time no less than a period of time it takes to charge a gate of a transistor of a drive gate line in the N-th shift register unit to the voltage at which the transistor can be turned on stably and no more than one cycle of the first clock signal.

3. The gate drive apparatus according to claim 2, each of the shift register units further comprises, an initial trigger signal terminal and a reset signal terminal, wherein the reset signal terminal of each of the shift register units receives a reset signal which is at a high level after the end of scanning a preceding frame and before the start of scanning a current frame and at a low level in scanning the current frame, and the initial trigger signal terminal of each of the shift register units receives the first initial trigger signal or the second initial trigger signal, and when the reset signal is at the high level, both the first initial trigger signal and the second initial trigger signal are at the low level, when the first initial trigger signal is at the high level, the reset signal is at the low level, and when the second initial trigger signal is at the high level, the reset signal is at the low level, and wherein the shift register units each is configured to charge a gate of a transistor of a drive gate line therein by a high level signal received by a forward/backward scan signal terminal until the transistor is turned on stably when the forward/backward select signal terminal receives a high level signal and the forward/backward scan signal terminal receives the high level signal, to output the signal received by the clock block signal terminal after the transistor is turned on stably; to discharge the gate of the transistor of the drive gate line therein by a low level signal received by the backward/forward scan signal terminal until the transistor is turned off stably when the backward/forward select signal terminal receives a high level signal and the backward/forward scan signal terminal receives the low level signal; and to pull down the potential at the gate of the transistor of the drive gate line therein by the signal received by the initial trigger signal terminal and output the signal received by the initial trigger signal terminal when the reset signal terminal is at the high level.

4. The gate drive apparatus according to claim 1, wherein each of the shift register units comprises a low level signal terminal of each of the shift register units receives a low level signal, and a reset signal terminal of each of the shift register units receives a reset signal which is at a high level after the end of scanning a preceding frame and before the start of scanning a current frame and at a low level in scanning the current frame.

5. The gate drive apparatus according to claim 1, each of the shift register units further comprises an initial trigger signal terminal and a reset signal terminal, wherein the reset signal terminal of each of the shift register units receives a reset signal which is at a high level after the end of scanning a preceding frame and before the start of scanning a current frame and at a low level in scanning the current frame, and the initial trigger signal terminal of each of the shift register units receives the first initial trigger signal or the second initial trigger signal; and when the reset signal is at the high level, both the first initial trigger signal and the second initial trigger signal are at the low level, when the first initial trigger signal is at the high level, the reset signal is at the low level, and when the second initial trigger signal is at the high level, the reset signal is at the low level; and wherein the shift register units each is configured to charge a gate of a transistor of a drive gate line therein by a high level signal received by a forward/backward scan signal terminal until the transistor is turned on stably when the forward/backward select signal terminal receives a high level signal and the forward/backward scan signal terminal receives the high level signal, to output the signal received by the clock block signal terminal after the transistor is turned on stably; to discharge the gate of the transistor of the drive gate line therein by a low level signal received by the backward/forward scan signal terminal until the transistor is turned off stably when the backward/forward select signal terminal receives a high level signal and the backward/forward scan signal terminal receives the low level signal; and to pull down the potential at the gate of the transistor of the drive gate line therein by the signal received by the initial trigger signal terminal and output the signal received by the initial trigger signal terminal when the reset signal terminal is at the high level.

6. The gate drive apparatus according to claim 1, wherein the first initial trigger signal is the same as the second initial trigger signal.

7. The gate drive apparatus according to claim 1, wherein each of the shift register units in the gate drive apparatus further comprises a first drive module, a first output module and a first reset module, wherein a first terminal of the first drive module is the forward scan signal terminal of the shift register unit, a second terminal of the first drive module is the forward select signal terminal of the shift register unit, a third terminal of the first drive module is a backward scan signal terminal of the shift register unit, a fourth terminal of the first drive module is the backward select signal terminal of the shift register unit, and a fifth terminal of the first drive module is connected with a second terminal of the first output module; a first terminal of the first output module is the clock block signal terminal of the shift register unit, and a third terminal of the first output module is an output terminal of the shift register unit; and a first terminal of the first reset module is connected with the second terminal of the first output module, a second terminal of the first reset module is the reset signal terminal of the shift register unit, a third terminal of the first reset module is the low level signal terminal of the shift register unit, and a fourth terminal of the first reset module is the third terminal of the first output module, wherein the first drive module is configured to output the signal received by the forward scan signal terminal through the fifth terminal thereof when the forward select signal terminal receives a high level signal and to output the signal received by the backward scan signal terminal through the fifth terminal thereof when the backward select signal terminal receives a high level signal, wherein the first reset module is configured to output the signal received by the low level signal terminal through the first terminal and the fourth terminal thereof respectively when the reset signal terminal receives a high level signal, and wherein the first output terminal is configured, upon reception of a high level signal through the second terminal thereof, to store the high level signal and to output the signal received by the clock block signal terminal through the output terminal of the shift register unit; and upon reception of a low level signal through the second terminal thereof, to store the low level signal without outputting the signal received by the clock block signal terminal through the output terminal of the shift register unit.

8. The gate drive apparatus according to claim 7, wherein a clock signal terminal of the k-th shift register unit in the gate drive apparatus receives the mod((mod((k−1)/4)+2)/4)-th clock signal, and k=1,2,...,N; and the respective shift register units in the gate drive apparatus each further comprises a first pull-down module, wherein a first terminal of the first pull-down module is the clock block signal terminal of each of the shift register units, a second terminal of the first pull-down module is connected with the second terminal of the first output module, a third terminal of the first pull-down module is connected with the third terminal of the first output module, a fourth terminal of the first pull-down module is the low level signal terminal of the shift register unit, and a fifth terminal of the first pull-down module is the clock signal terminal of the shift register unit, and wherein the first pull-down module is configured to output a low level signal received by the fourth terminal thereof through the second terminal and the third terminal thereof respectively when the second terminal thereof is at the low level and the clock block signal is at the high level, and to output the low level signal received by the fourth terminal thereof through the third terminal thereof when the clock signal terminal is at the high level.

9. The gate drive apparatus according to claim 8, wherein the first pull-down module comprises a second capacitor, a sixth transistor, a seventh transistor, an eighth transistor and a ninth transistor, wherein a first pole of the sixth transistor is the second terminal of the first pull-down module, a gate of the sixth transistor is connected with the second capacitor, a second pole of the sixth transistor is the fourth terminal of the first pull-down module, and one terminal of the second capacitor unconnected with the gate of the sixth transistor is the first terminal of the first pull-down module; a first pole of the seventh transistor is connected with the gate of the sixth transistor, a gate of the seventh transistor is the second terminal of the first pull-down module, and a second pole of the seventh transistor is the fourth terminal of the first pull-down module; a first pole of the eighth transistor is the third terminal of the first pull-down module, a gate of the eighth transistor is connected with the gate of the sixth transistor, and a second pole of the eighth transistor is the fourth terminal of the first pull-down module; a first pole of the ninth transistor is the third terminal of the first pull-down module, a gate of the ninth transistor is the fifth terminal of the first pull-down module, and a second pole of the ninth transistor is the fourth terminal of the first pull-down module, wherein the sixth transistor is configured to be turned on to pull the second terminal of the first pull-down module down to the low level when the gate thereof is at the high level and to be turned off when the gate thereof is at the low level, wherein the seventh transistor is configured to be turned on to pull the level at the gate of the sixth transistor down to the low level when the second terminal of the first pull-down module is at the high level and to be turned off when the second terminal of the first pull-down module is at the low level, wherein the eighth transistor is configured to be turned on to pull the output terminal of the shift register unit down to the low level when the gate thereof is at the high level and to be turned off when the gate thereof is at the low level, and wherein the ninth transistor is configured to be turned on to pull the output terminal of the shift register unit down to the low level when the clock signal terminal is at the high level and to be turned off when the clock signal terminal is at the low level.

10. The gate drive apparatus according to claim 7, wherein the first drive module further comprises a first transistor and a second transistor, wherein a first pole of the first transistor is the first terminal of the first drive module, a gate of the first transistor is the second terminal of the first drive module, and a second pole of the first transistor is the fifth terminal of the first drive module; and a first pole of the second transistor is the fifth terminal of the first drive module, a gate of the second transistor is the fourth terminal of the first drive module, and a second pole of the second transistor is the third terminal of the first drive module, wherein the first transistor is configured to be turned on to transmit the signal received by the forward scan signal terminal to the fifth terminal of the first drive module when the forward select signal terminal receives a high level signal and to be turned off without further transmitting the signal received by the forward scan signal terminal to the fifth terminal of the first drive module when the forward select signal terminal receives a low level signal; and wherein the second transistor is configured to be turned on to transmit the signal received by the backward scan signal terminal to the fifth terminal of the first drive module when the backward select signal terminal receives a high level signal and to be turned off without further transmitting the signal received by the backward scan signal terminal to the fifth terminal of the first drive module when the backward select signal terminal receives a low level signal.

11. The gate drive apparatus according to claim 7, wherein the first reset module further comprises a third transistor and a fourth transistor, wherein a first pole of the third transistor is the first terminal of the first reset module, a gate of the third transistor is the second terminal of the first reset module, and a second pole of the third transistor is the third terminal of the first reset module, and a first pole of the fourth transistor is the third terminal of the first reset module, the gate of the fourth transistor is the second terminal of the first reset module, and a second pole of the fourth transistor is the fourth terminal of the first reset module, wherein the third transistor is configured to be turned on to transmit the signal received by the low level signal terminal to the first terminal of the first reset module when the reset signal terminal is at the high level and to be turned off when the reset signal terminal is at the low level, and wherein the fourth transistor is configured to be turned on to transmit the signal received by the low level signal terminal to the fourth terminal of the first reset module when the reset signal terminal is at the high level and to be turned off when the reset signal terminal is at the low level.

12. The gate drive apparatus according to claim 7, wherein the first output module further comprises a fifth transistor and a first capacitor, wherein a first pole of the fifth transistor is the first terminal of the first output module, a gate of the fifth transistor is connected with one terminal of the first capacitor, the gate of the fifth transistor is the second terminal of the first output module, a second pole of the fifth transistor is the third terminal of the first output module, and the other terminal of the first capacitor is connected with the second pole of the fifth transistor, wherein the fifth transistor is configured to be turned on to transmit the signal received by the clock block signal terminal to the output terminal of the shift register unit when the gate thereof is at the high level and to be turned off when the gate thereof is at the high level, and wherein the first capacitor is configured to storage the signal at the gate of the fifth transistor.

13. A display apparatus, comprising a gate drive apparatus, the gate drive apparatus further comprising N shift register units, wherein a forward select signal terminal of the p-th shift register unit receives a signal output by the (p−2)-th shift register unit, wherein p=3,4,...,N, and a backward select signal terminal of the r-th shift register unit receives a signal output by the (r+2)-th shift register unit, wherein r=1,2,...,N−2; a forward select signal terminal of the first shift register unit receives a first initial trigger signal, and a forward select signal terminal of the second shift register unit receives a second initial trigger signal;

wherein if N represents an even number, a backward select signal terminal of the second last shift register unit receives the first initial trigger signal, a backward select signal terminal of the last shift register unit receives the second initial trigger signal;

wherein if N represents an odd number, the backward select signal terminal of the last shift register unit receives the first initial trigger signal, the backward select signal terminal of the second last shift register unit receives the second initial trigger signal;

wherein a clock block signal terminal of the k-th shift register unit receives a mod((k−1)/4)-th clock signal, wherein k=1,2,... ,N;

wherein a signal received by a forward scan signal terminal of each of the shift register units other than the first two shift register units is the same as the signal received by the clock block signal terminal of the prior shift register unit to the shift register unit, wherein a forward scan signal terminal of the first shift register unit receives a second clock signal, a forward scan signal terminal of the second shift register unit receives a third clock signal;

wherein when the 0th clock signal is at the high level, the second clock signal is at the low level, and when the 0th clock signal is at the low level, the second clock signal is at the high level; when the first clock signal is at the high level, the third clock signal is at the low level, and when the first clock signal is at the low level, the third clock signal is at the high level; and wherein an overlapping length of time of a period of time in which the n-th clock signal is at the high level, and a period of time in which the (n+1)-th clock signal is at the high level by a length of time is no less than a first preset length of time, wherein n=0,1,2,3, and n+1>3, the (n+1)-th clock signal is a mod((n+1)/4)-th clock signal;

wherein in forward scanning, an overlapping length of time of a period of time in which the first initial trigger signal is at the high level and a the period of time in which the second clock signal is at the high level is no less than a period of time it takes to charge a gate of a transistor of a drive gate line in the first shift register unit to the voltage at which the transistor can be turned on stably and the overlapping length of time is no more than one cycle of the second clock signal, and wherein an overlapping length of time of a period of time in which the second initial trigger signal is at the high level and the period of time in which the third clock signal is at the high level is no less than a period of time it takes to charge a gate of a transistor of a drive gate line in the second shift register unit to the voltage at which the transistor can be turned on stably and the overlapping length of time is no more than one cycle of the third clock signal.

14. The display apparatus according to claim 13, wherein N=4m, and m represents a positive integer, wherein the signal received by the backward scan signal terminal of each of the shift register units other than the last two shift register units is the same as the signal received by the clock block signal terminal of the succeeding shift register unit to the shift register unit, the backward scan signal terminal of the (N−1)-th shift register unit receives the 0th clock signal, and the backward scan signal terminal of the N-th shift register unit receives the first clock signal, and wherein in backward scanning, a period of time in which the first initial trigger signal is at the high level overlaps with the period of time in which the 0th clock signal is at the high level at a time by a length of time no less than a period of time it takes to charge a gate of a transistor of a drive gate line in the (N−1)-th shift register unit to the voltage at which the transistor can be turned on stably and no more than one cycle of the 0th clock signal, and a period of time in which the second initial trigger signal is at the high level overlaps with the period of time in which the first clock signal is at the high level at a time by a length of time no less than a period of time it takes to charge a gate of a transistor of a drive gate line in the N-th shift register unit to the voltage at which the transistor can be turned on stably and no more than one cycle of the first clock signal.

15. The display apparatus according to claim 14, wherein each of the shift register units further comprises an initial trigger signal terminal and a reset signal terminal, wherein the reset signal terminal of each of the shift register units receives a reset signal which is at a high level after the end of scanning a preceding frame and before the start of scanning a current frame and at a low level in scanning the current frame; and the initial trigger signal terminal of each of the shift register units receives the first initial trigger signal or the second initial trigger signal, and wherein when the reset signal is at the high level, both the first initial trigger signal and the second initial trigger signal are at the low level, when the first initial trigger signal is at the high level, the reset signal is at the low level, and when the second initial trigger signal is at the high level, the reset signal is at the low level, and wherein the shift register units each are configured to charge a gate of a transistor of a drive gate line therein by a high level signal received by a forward/backward scan signal terminal until the transistor is turned on stably when the forward/backward select signal terminal receives a high level signal and the forward/backward scan signal terminal receives the high level signal; to output the signal received by the clock block signal terminal after the transistor is turned on stably; to discharge the gate of the transistor of the drive gate line therein by a low level signal received by the backward/forward scan signal terminal until the transistor is turned off stably when the backward/forward select signal terminal receives a high level signal and the backward/forward scan signal terminal receives the low level signal; and to pull down the potential at the gate of the transistor of the drive gate line therein by the signal received by the initial trigger signal terminal and output the signal received by the initial trigger signal terminal when the reset signal terminal is at the high level.

16. The display apparatus according to claim 13, wherein each of the shift register units further comprises a low level signal terminal, wherein each shift register units receives a low level signal; and a reset signal terminal of each of the shift register units receives a reset signal which is at a high level after the end of scanning a preceding frame and before the start of scanning a current frame and at a low level in scanning the current frame.

17. The display apparatus according to claim 13, wherein each of the shift register units further comprises an initial trigger signal terminal and a reset signal terminal, wherein the reset signal terminal receives a reset signal which is at a high level after the end of scanning a preceding frame and before the start of scanning a current frame and at a low level in scanning the current frame; and the initial trigger signal terminal of each of the shift register units receives the first initial trigger signal or the second initial trigger signal; and when the reset signal is at the high level, both the first initial trigger signal and the second initial trigger signal are at the low level, when the first initial trigger signal is at the high level, the reset signal is at the low level, and when the second initial trigger signal is at the high level, the reset signal is at the low level, and wherein the shift register units each are configured to charge a gate of a transistor of a drive gate line therein by a high level signal received by a forward/backward scan signal terminal until the transistor is turned on stably when the forward/backward select signal terminal receives a high level signal and the forward/backward scan signal terminal receives the high level signal; to output the signal received by the clock block signal terminal after the transistor is turned on stably; to discharge the gate of the transistor of the drive gate line therein by a low level signal received by the backward/forward scan signal terminal until the transistor is turned off stably when the backward/forward select signal terminal receives a high level signal and the backward/forward scan signal terminal receives the low level signal; and to pull down the potential at the gate of the transistor of the drive gate line therein by the signal received by the initial trigger signal terminal and output the signal received by the initial trigger signal terminal when the reset signal terminal is at the high level.

18. The display apparatus according to claim 13, wherein the first initial trigger signal is the same as the second initial trigger signal.

* * * * *